US011571094B2

(12) United States Patent
Slothower et al.

(10) Patent No.: US 11,571,094 B2
(45) **Date of Patent: *Feb. 7, 2023**

(54) FOOT LEDGE STRUCTURE FOR TOILET

(71) Applicant: Kohler Co., Kohler, WI (US)

(72) Inventors: Erich D. Slothower, Mill Valley, CA (US); Keith E. Muellenbach, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/374,527

(22) Filed: Jul. 13, 2021

(65) Prior Publication Data

US 2021/0338024 A1 Nov. 4, 2021

Related U.S. Application Data

(63) Continuation of application No. 16/858,317, filed on Apr. 24, 2020, now Pat. No. 11,083,350, which is a continuation-in-part of application No. PCT/US2019/031589, filed on May 9, 2019.

(60) Provisional application No. 62/670,403, filed on May 11, 2018.

(51) Int. Cl.
*A47K 17/02* (2006.01)
*A47K 13/24* (2006.01)

(52) U.S. Cl.
CPC ..... *A47K 17/028* (2013.01); *A47K 13/24* (2013.01)

(58) Field of Classification Search
CPC ..... A47K 17/028
USPC ..... 4/479, 484, 485, 486, 446, 466, 471
See application file for complete search history.

(56) References Cited

U.S. PATENT DOCUMENTS 189,074 A 4/1877 Van Keuren
226,747 A 4/1880 Hewitt
360,937 A 4/1887 Weinley
(Continued)

FOREIGN PATENT DOCUMENTS

CN 1220855 A 6/1999
CN 202644698 U 1/2013
(Continued)

OTHER PUBLICATIONS

First Action in Chinese Patent Application No. 201980044365.5, dated Oct. 11, 2021, 10 pages (including English summary).
(Continued)

*Primary Examiner* — Lori L Baker
(74) *Attorney, Agent, or Firm* — Lempia Summerfield Katz LLC

(57) ABSTRACT

A toilet positionable above a floor comprise a toilet base and a foot ledge structure. The toilet base at least partially surrounds a lower portion of a toilet bowl and defines an inner area that at least partially contains the lower portion of the toilet bowl. The foot ledge structure comprises a foot ledge and a base bracket. The foot ledge is elevated above the floor and is movable between a retracted position and an extended position relative to the toilet base. The base bracket is positioned within the inner area of the toilet base and is configured to elevate the foot ledge above the floor. The foot ledge is movably attached to the base bracket. The base bracket is independently attachable to the floor from the toilet base.

19 Claims, 44 Drawing Sheets

(56) References Cited

U.S. PATENT DOCUMENTS

| | | | | | |
|---|---|---|---|---|---|
| 2,243,264 | A * | 5/1941 | Stromblad | A47K 17/028 | 4/254 |
| 4,584,725 | A * | 4/1986 | Oliver | A47K 17/028 | D25/63 |
| 4,710,988 | A * | 12/1987 | Stewart | E03D 5/012 | 4/441 |
| 4,777,672 | A * | 10/1988 | Gebhard | A47K 11/04 | 297/130 |
| 5,282,279 | A * | 2/1994 | Hinton | A47K 17/028 | 4/144.1 |
| 5,857,223 | A * | 1/1999 | Ferdinand | A47K 13/10 | 4/246.1 |
| 6,145,931 | A * | 11/2000 | Subotic | A47C 16/025 | 297/188.11 |
| 7,621,599 | B2 * | 11/2009 | Whalen | B60N 2/90 | 297/423.21 |
| 9,635,946 | B2 * | 5/2017 | Wang | A47C 7/5066 | |
| 9,668,579 | B2 * | 6/2017 | Johnson | A47C 1/0355 | |
| 10,016,101 | B2 * | 7/2018 | Schottenstein | A47C 7/62 | |
| 10,292,549 | B2 * | 5/2019 | Kim | A47K 17/02 | |
| 10,390,668 | B1 * | 8/2019 | Ryder | A47K 17/028 | |
| 10,464,450 | B1 * | 11/2019 | Peterson | B60N 2/2866 | |
| 11,083,350 | B2 * | 8/2021 | Slothower | A47K 13/24 | |
| 2004/0189074 | A1 * | 9/2004 | Seki | A47C 7/506 | 297/423.1 |
| 2006/0226747 | A1 * | 10/2006 | Beaudoin | A47B 88/493 | 312/333 |
| 2008/0184471 | A1 * | 8/2008 | Hampel | A47K 11/02 | 4/479 |
| 2008/0276362 | A1 * | 11/2008 | O'Malley | E03D 11/10 | 4/420 |
| 2012/0084909 | A1 * | 4/2012 | Dunn | A47K 11/06 | 4/483 |
| 2016/0113453 | A1 * | 4/2016 | Good | A47K 17/028 | 4/254 |
| 2016/0360937 | A1 * | 12/2016 | Naik | A47C 16/025 | |
| 2017/0079442 | A1 * | 3/2017 | Edwards | A47C 16/025 | |
| 2018/0020889 | A1 * | 1/2018 | Hall | A61H 35/006 | 4/300 |
| 2020/0008581 | A1 * | 1/2020 | Jones | A47C 7/748 | |

FOREIGN PATENT DOCUMENTS

| | | | |
|---|---|---|---|
| CN | 203716257 | U | 7/2014 |
| CN | 206079616 | U | 4/2017 |
| CN | 106993975 | A | 8/2017 |
| EP | 0 864 288 | A1 | 9/1998 |
| GB | 2490135 | A | 10/2012 |
| JP | 2007-222279 | A | 9/2007 |
| JP | 2007222279 | A | 9/2007 |
| WO | WO-2017/178873 | A1 | 10/2017 |

OTHER PUBLICATIONS

International Search Report and Written Opinion, PCT/US2019/031589, Kohler Co. (dated Aug. 6, 2019).

Chinese Office Action from Chinese Patent Application No. 201980044365.5, dated Apr. 12, 2022, 10 pages (including English Summary).

* cited by examiner

FOOT LEDGE STRUCTURE FOR TOILET

CROSS-REFERENCE TO RELATED PATENT APPLICATIONS

This application is a Continuation under 35 U.S.C § 120 and 37 C.F.R. § 1.53(b) of U.S. patent application Ser. No. 16/858,317 filed Apr. 24, 2020, which is a Continuation-in-Part of International Application No. PCT/US2019/031589, filed May 9, 2019, which claims priority to and the benefit of U.S. Provisional Patent Application No. 62/670,403, filed May 11, 2018. The entire disclosures of the foregoing applications are hereby incorporated by reference herein.

BACKGROUND

The present application relates generally to the field of foot ledges for toilets.

With conventional seated toilets, the user can sit on the seat of the toilet in a seated position with their feet on the floor in order to use the toilet (e.g., have a bowel movement). However, the seated position (in which the user's feet are on the floor) does not anatomically help the user to have a bowel movement due to the angle between the user's femurs and pelvis bone. In particular, in this position, the user's knees are approximately level to or lower than the user's pelvis. This seated position not only anatomically makes having a bowel movement more difficult for the user by putting a strain on the user's colon, but also prevents the user from fully eliminating fecal matter, which may cause health complications.

Comparatively, in the squatting position, the user's femurs are angled upward relative to their pelvis such that the user's knees are above the user's pelvis. The squatting position anatomically helps the user to have a bowel movement and reduces the risk of a variety of different health complications that are associated with having bowel movements in the traditional seated position.

Accordingly, it would be desirable to allow the user to be in a position closer to the squatting position while still sitting on a toilet. Present attempts at obtaining such a position take up room within the bathroom and are not easily stowed while not being used. Furthermore, previous attempts may be in the way of users who would like to use the toilet while standing.

SUMMARY

One embodiment relates to a toilet positionable above a floor. The toilet includes a toilet base and a foot ledge structure. The toilet base at least partially surrounds a lower portion of a toilet bowl and defines an inner area that at least partially contains the lower portion of the toilet bowl. The foot ledge structure comprises a foot ledge and a base bracket. The foot ledge is elevated above the floor and is movable between a retracted position and an extended position relative to the toilet base. The base bracket is positioned within the inner area of the toilet base and is configured to elevate the foot ledge above the floor. The foot ledge is movably attached to the base bracket. The base bracket is independently attachable to the floor from the toilet base.

Another embodiment relates to a foot ledge structure for a toilet base of a toilet. The foot ledge structure includes a foot ledge and a base bracket. The foot ledge is configured to be elevated above a floor and is movable between a retracted position and an extended position relative to the toilet base. The base bracket is positioned within an inner area of the toilet base and is configured to elevate the foot ledge above the floor. The foot ledge is movably attached to the base bracket. The base bracket is independently attachable to the floor from the toilet base.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is not defined by any particular embodiment described herein. Before turning to the figures, which illustrate exemplary embodiments in detail, it should be understood that the application is not limited to the details or methodology set forth in the description or illustrated in the figures. It should also be understood that the terminology is for the purpose of the descriptions only and should not be regarded as limiting.

Referring generally to the figures, disclosed herein is a foot ledge structure for a toilet that provides an area for the user to rest their feet on while sitting on the toilet in order to allow the user to be in a position that is more similar to the squatting position (compared to a normal seated position in which the user's feet are resting on the floor) while still sitting on the toilet. In particular, the foot ledge structure elevates the user's feet (and therefore also the user's knees and the distal end of the user's femurs), thereby decreasing the angle between the user's femurs and pelvis. This anatomical position helps facilitate bowel movements and to prevent health complications.

Toilet

Figure 2:
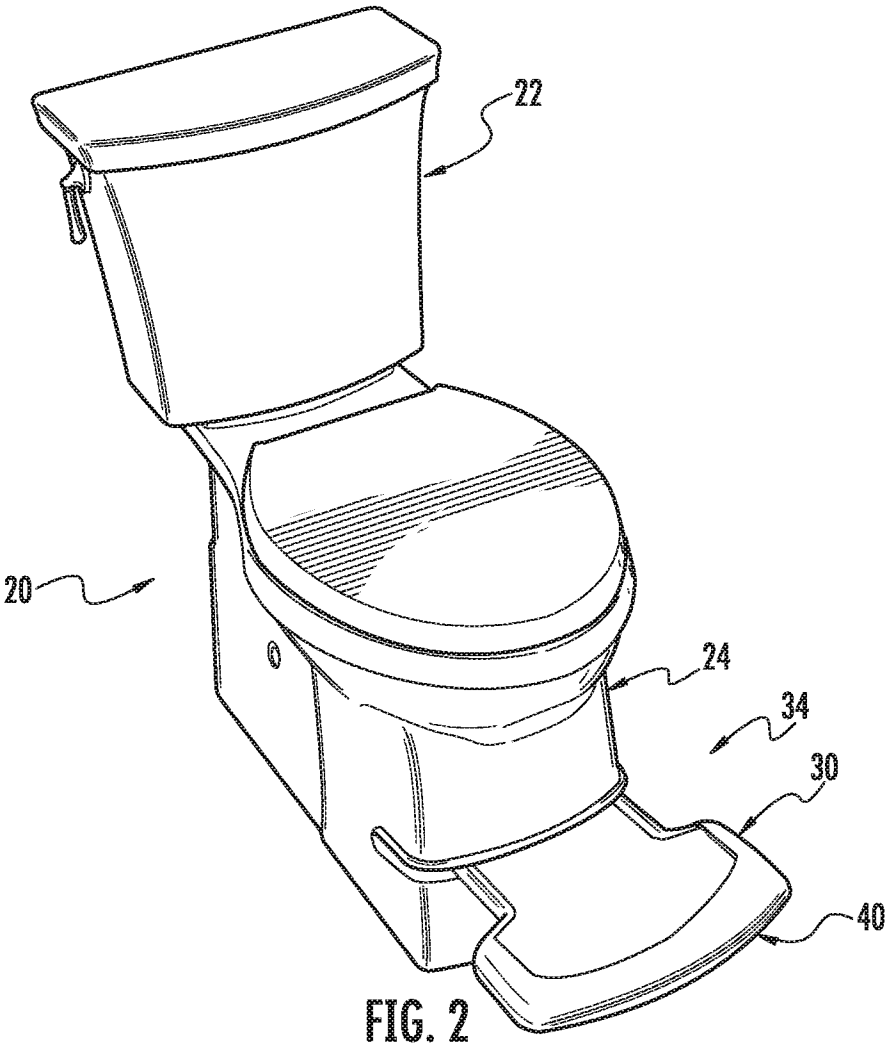
FIG. 2 is a perspective view of the toilet of FIG. 1 with the foot ledge structure in the extended position.
Figure 1:
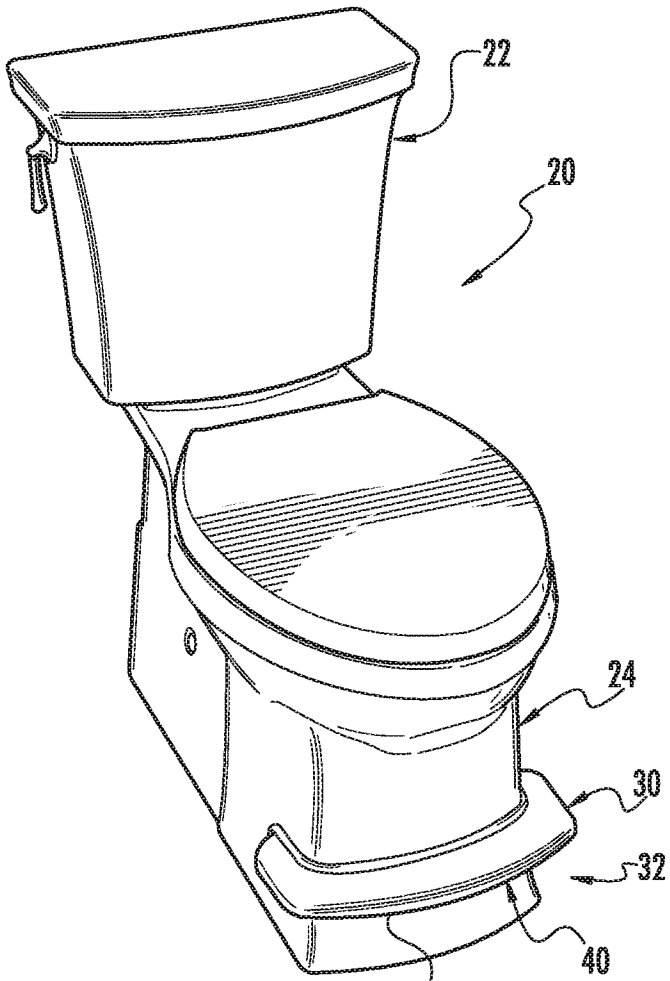
FIG. 1 is a perspective view of a toilet with a foot ledge structure in a retracted position according to one embodiment.

As shown in FIGS. 1-2, a toilet 20 is shown that includes a toilet tank 22 (that provides an area to hold water prior to being flushed into and through the toilet bowl), a toilet base 24, and a foot ledge structure 30. The toilet 20 is positionable above (and optionally on) a floor. As described further herein, the foot ledge structure 30 provides an area for the user to rest their feet on in an elevated position (relative to the floor) while seated on the toilet 20. The foot ledge structure 30 elevates the user's feet above the floor and thus elevates the user's knees, thereby decreasing the angle between the user's femurs and pelvis when the user is seated on the toilet 20.

As shown in FIGS. 1-2, the foot ledge structure 30 includes a foot ledge 40 (as described further herein) that is movable between a retracted position 32 and an extended position 34 relative to the toilet base 24. In the stored or retracted position 32 (as shown in FIG. 1), at least a portion of the foot ledge 40 is concealed within, hidden within, disposed at least partially within, or retracted into the toilet base 24 (and therefore positioned directly underneath at least a portion of the inner area 23 defined by the toilet base 24) in order to maximize the available space within the bathroom and provide a more streamlined and elegant look when not in use (i.e., when the user is not sitting on the toilet or when the user is not using the foot ledge 40). Since the foot ledge structure 30 is not positioned along the floor in front of the toilet base 24 in the retracted position 32 and is substantially retracted into the toilet base 24, the foot ledge structure 30 is not in the way while a user is using the toilet 20 while standing. In the extended position 34 (as shown in FIG. 2), at least the portion of the foot ledge 40 is extended out of or at least partially from the toilet base 24 (and extended out from underneath the inner area 32 of the toilet base 24) in order to provide ample area for the user to rest their feet on the foot ledge 40 and elevate their feet above the floor when in use (i.e., when the user is sitting on the toilet with their feet on the foot ledge 40).

Figure 3:
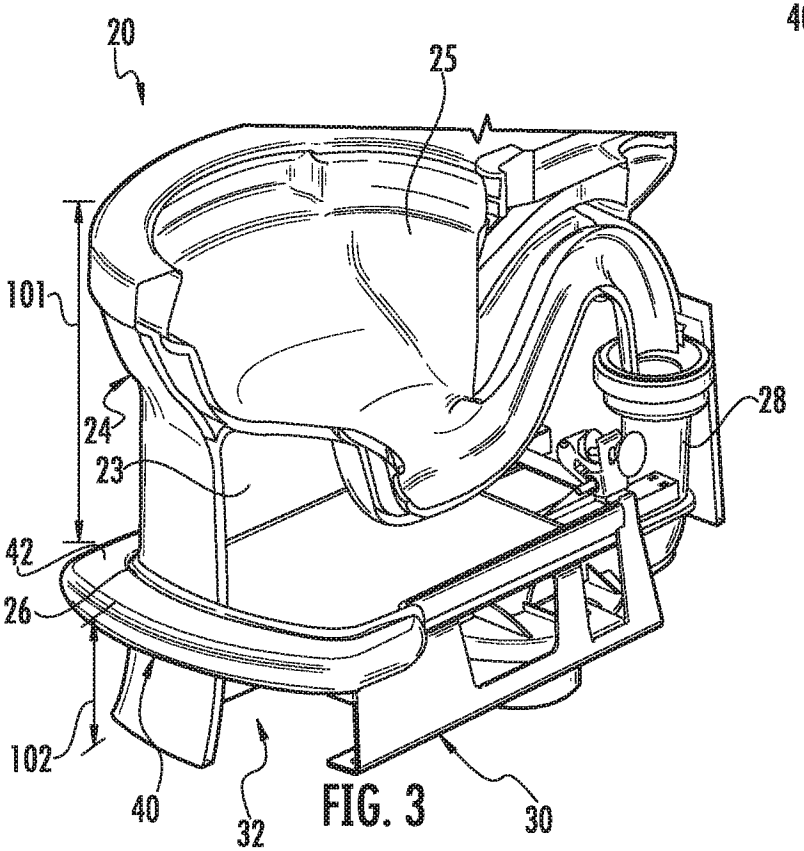
FIG. 3 is a partially cross-sectional view of the toilet of FIG. 1.

The toilet 20 and its components may have a variety of different relative dimensions according to the desired configuration. As shown in FIG. 3, the distance 101 from the top surface of the rim of the toilet bowl 25 (i.e., the top of the toilet base 24) to the top surface of the foot ledge 40 is approximately 11.4 inches. The distance 102 from the floor to the top surface of the foot ledge 40 is approximately 4.75 inches. This configuration generally provides a "comfort height" for the toilet 20.

As described further herein, any front walls, portions, sides, or ends of the toilet 20 and its components refers to wall, portion, side, or end of the toilet 20 that is furthest away from and opposite the toilet tank 22. Any back walls, portions, sides, or ends of the toilet 20 and its components refers to the wall, portion, side, or end of the toilet 20 that the toilet tank 22 is positioned along (or closest to). The side walls or portions of the toilet 20 and its components refer to the walls or portions that extend between the front and back of the toilet 20. The bottom walls, portions, sides, or ends of the toilet 20 refers to the wall, portion, side, or end that is closest to the floor, and the top walls, portions, sides, or ends of the toilet 20 refers to the wall, portion, side, or end that is furthest from the floor.

Toilet Base

The toilet base 24 is a lower portion of the toilet 20 that supports the tank 22 and is configured to attach the rest of the toilet 20 to the floor and any plumbing. The toilet base 24 supports, is disposed at least partially beneath, at least partially contains the toilet bowl 25 (as shown in FIG. 3) and provides an area for the seat and lid to attach to and rest along in the closed position above the toilet bowl 25. The toilet base 24 at least partially surrounds the toilet bowl 25, in particular a lower portion of the toilet bowl 25. The toilet base 24 may be constructed out of a variety of different materials, including but not limited to vitreous china.

Figure 4:
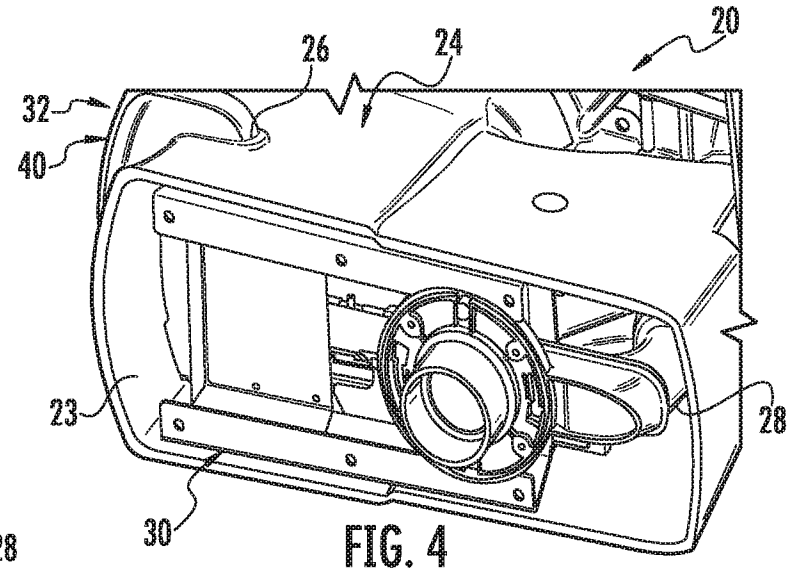
FIG. 4 is a bottom view of the toilet of FIG. 1.

As shown in FIGS. 3-4, the toilet base 24 includes and defines an open, hollow, interior, internal, or inner space or area 23 that at least partially contains at least the lower portion of the toilet bowl 25. The toilet base 24 may include at least one wall that defines and encloses the inner area 23 and extends vertically below the toilet bowl 25. The inner area 23 extends below the toilet bowl 25 and is configured to contain or house an existing trapway 28 (which may optionally be plastic and approximately 12 inches). The trapway 28 may allow the foot ledge structure 30 to properly align with the base 24 of the toilet 20 once the base 24 is positioned over the trapway 28 and at least a portion of the foot ledge structure 30 (i.e., at least the base bracket 50). At least a portion of the inner area 23 is positioned above at least a portion of the entire foot ledge structure 30. Optionally, the inner area 23 may also extend below and contain or house the entire foot ledge structure 30 (aside from an end portion of the foot ledge 40 according to one embodiment). Due to the manufacturing process of the toilet 20 and the configuration of the toilet 20, the toilet 20 does not require internal support structures within the inner area 23 of the toilet base 24 to reinforce the toilet 20 (during, for example, the molding and firing process of the toilet base 24). Accordingly, the inner area 23 of the toilet base 24 has a substantially open space, in particular toward the front of the toilet base 24. This open space within the inner area 23 provides sufficient room to house or accommodate the toilet bowl 25 and optionally also the foot ledge structure 30 along at least a portion of the length of the toilet base 24 and along the front of the toilet base 24. Accordingly, the foot ledge structure 30 (aside from an end portion of the foot ledge 40 according to one embodiment) is positioned beneath the toilet bowl 25 and beneath at least a portion of the inner area 23, and optionally within the inner area 23 of the toilet base 24 according to one embodiment.

Figure 5:
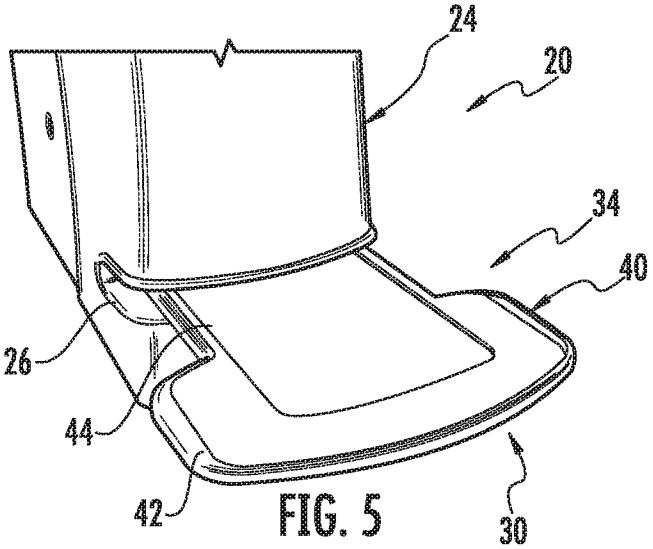
FIG. 5 is a perspective view of a portion of the toilet of FIG. 1 with the foot ledge structure in the extended position.

As shown in FIG. 5, the toilet base 24 includes an aperture, hole, or opening, (referred to herein as a slot 26) that extends completely through at least one wall of the toilet base 24 and allows the foot ledge 40 to move at least partially into and out from the inner area 23 of the toilet base 24 (while the rest of the foot ledge structure 30 remains within the inner area 23 of the toilet base 24). Accordingly, the foot ledge 40 moves at least partially through the slot 26 as the foot ledge 40 moves between the retracted position 32 and the extended position 34. Depending on the shape and size of the foot ledge 40, the slot 26 may extend horizontally along the entire width of the front wall of the toilet base 24 and is positioned in front of the open space of the inner area 23 at the front of the toilet base 24. The slot 26 includes a horizontally-extending upper edge, a horizontally-extending lower edge (that is opposite the upper edge), and vertically-extending side edges that extend vertically between the upper edge and the lower edge. The upper edge and the lower edge may extend along both the front wall and the side walls of the toilet base 24. The side edges may be positioned along opposite side walls of the toilet base 24.

According to one embodiment as shown in FIG. 5, the slot 26 extends completely through and along both the front wall and at least a front portion of the side walls of the toilet base 24. This configuration allows a wide portion 42 of the foot ledge 40 (as described further herein) that is wider than the toilet base 24 to fit at least partially within the inner area 23 of the toilet base 24 in the retracted position 32. In particular, in the retracted position 32, the slot 26 allows the outer edges of the wide portion 42 of the foot ledge 40 to extend outside of the inner area 23 (i.e., beyond the side walls of the toilet base 24) while the middle portion of the wide portion 42 is positioned within the inner area 23 of the toilet base 24 (i.e., between the side walls of the toilet base 24).

The slot 26 can be formed in a variety of ways, including but not limited to cutting a hole in the wall of the toilet base 24 using a variety of different tools (including laser cutting), using a water jet, milling the slot 26, or molding the slot 26 directly into the vitreous china of the toilet base 24.

Foot Ledge Structure

Figure 6:
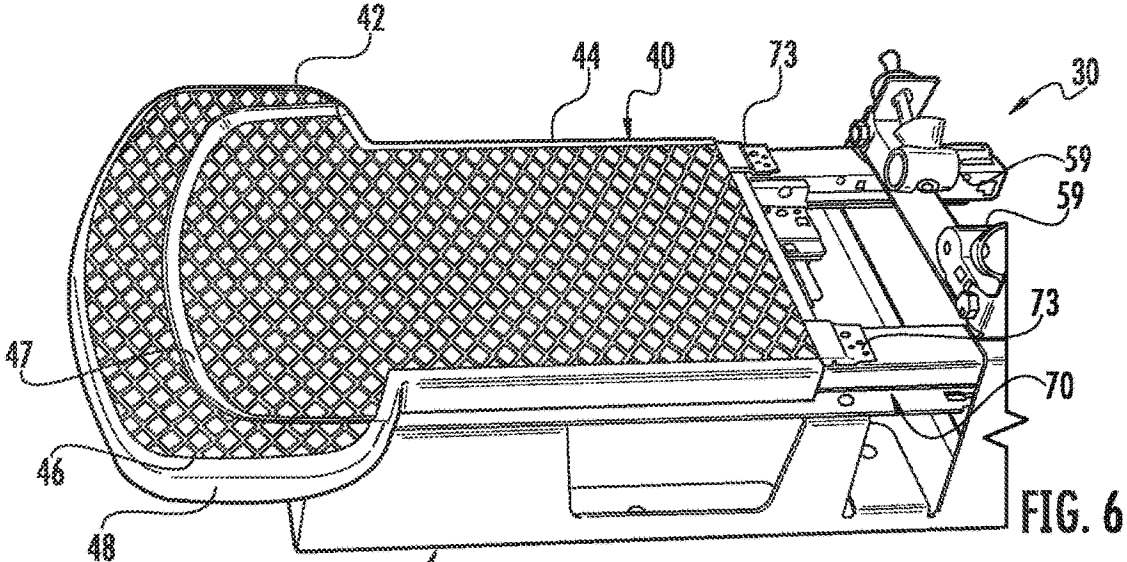
FIG. 6 is a perspective, side view of the foot ledge structure of the toilet of FIG. 1.

As shown in FIG. 6, the foot ledge structure 30 includes the foot ledge 40, a base bracket 50, and a rail mechanism 70, as described further herein. The foot ledge structure 30 is configured to support a variety of different weights such as 450 pounds.

Foot Ledge

The pop-out slide or foot ledge 40 provides an area for the user to directly rest their feet on while seated on the toilet 20 and is movable and extendable out from the front of the toilet base 24 (i.e., the side opposite the toilet tank 22) between the retracted position 32 and the extended position 34 (as shown in FIGS. 1-2 and described further herein) relative to the base bracket 50 and the toilet base 24. Accordingly, the foot ledge 40 is elevated vertically above the floor that the toilet 20 is positioned directly above (and optionally directly on). However, the foot ledge 40 is vertically below the top of the toilet base 24 where the seat and the lid are attached to.

In order to both provide sufficient area to support the user's feet and in order to be substantially retractable into the toilet base 24, the foot ledge 40 includes both a wide portion 42 and a narrow portion 44 along the length of the foot ledge 40, as shown in FIGS. 6-9. The wide portion 42 is positioned along the front end of the narrow portion 44 such that the wide portion 42 extend out from the front end of the toilet base 24, beyond the narrow portion 44. The wide portion 42 is wider than the narrow portion 44 along the width of the foot ledge 40 and provides ample room for the user to place their feet on. The wide portion 42 may be wider than the width of the toilet base 24. Accordingly, at least a portion of the wide portion 42 may extend out from either side of the toilet base 24 (as well as out from the front end of the toilet base 24), and therefore extends out from the inner area 23 of the toilet base 24, in the retracted position 32 (as shown in FIG. 1). By extending out along the sides and front end of the toilet base 24, the foot ledge 40 provides an area for the user to grip in order to move the foot ledge 40 between the retracted position 32 and the extended position 34. The extended width of the wide portion 42 may allow the user to be in a more comfortable position while using the foot ledge structure 30 since the user can place their feet anywhere along the width (and length) of the wide portion 42 according to their desired position.

The narrow portion 44 is more narrow than the wide portion 42 and is more narrow than width of the toilet base 24 such that, in the retracted position 32, the narrow portion 44 can fit completely inside the toilet base 24 (i.e., completely underneath (and optionally within) the hollow inner area 23 of the toilet base 24 and between the side walls of the toilet base 24). The narrow portion 44 allows the foot ledge 40 to be substantially retracted into the toilet base 24 in the retracted position 32. The narrow portion 44 is longer than the wide portion 42 in order to allow the foot ledge 40 to be substantially extended out from the toilet base 24 in the extended position 34. Accordingly, in the extended position 34, the entire wide portion 42 and at least a portion of the narrow portion 44 are extended out from and positioned in front of the toilet base 24 (and not underneath the inner area 23 of the toilet base 24).

The foot ledge 40 is cantilevered and movably attached or fixed to the rail mechanism 70 or the base bracket 50 along only the back end of the foot ledge 40 (i.e., only along the narrow portion 44 of the foot ledge 40). Accordingly, the front end of the foot ledge 40 (i.e., the wide portion 42 of the foot ledge 40, which extends out from the toilet base 24 in both the retracted position 32 and the extended position 34 and along which the user places their feet) is not attached to or supported by any structure and overhangs the bathroom floor along the area in front of the front end of the toilet base 24. When the foot ledge 40 is in the extended position 34, the entire wide portion 42 (i.e., the entire width and length of the wide portion 42) and optionally at least a portion of the narrow portion 44 overhang the bathroom floor without any support or attachments below the foot ledge 40 in front of or beyond the front end of the toilet base 24. In particular, there are no supports or attachments below the wide portion 42 (i.e., between the wide portion 42 and the floor). The front end or portion of the foot ledge 40 refers to the end or portion of the foot ledge 40 that extends out from underneath the inner area 23 of the toilet base 24 in the retracted position 32 according to one embodiment and may refer to the end of the wide portion 42 that is positioned opposite the narrow portion 44.

Figure 7:
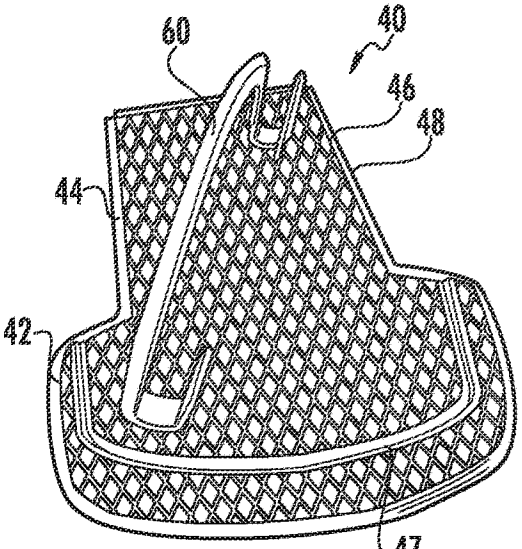
FIG. 7 is a perspective, top view of a foot ledge of the toilet of FIG. 1.

The foot ledge 40 includes a foot plate or pad 46 and a support shelf or platform 48. As shown in FIGS. 6-7, the foot pad 46 is positioned on the top surface of the support platform 48 and provides a comfortable and optionally padded area for the user to rest their feet directly on. The support platform 48 is positioned directly beneath the foot pad 46 and provides support and a solid structure to stably hold the user's feet. The foot pad 46 and the support platform 48 may optionally have approximately the same shape and size along their length and width (however, according to one embodiment, the foot pad 46 may be slightly smaller than the support platform 48 such that the support platform 48 extends beyond the edges of the foot pad 46). Accordingly, both the foot pad 46 and the support platform 48 include the wide portion 42 and the narrow portion 44. The support platform 48 may be thicker than the foot pad 46 in order to provide adequate support, and the foot pad 46 may be thinner than the support platform 48 to minimize the thickness of the entire foot ledge 40. With a thinner profile for the entire foot ledge 40, the slot 26 may also be smaller, and the foot ledge 40 takes up less space within the bathroom.

Figure 8:
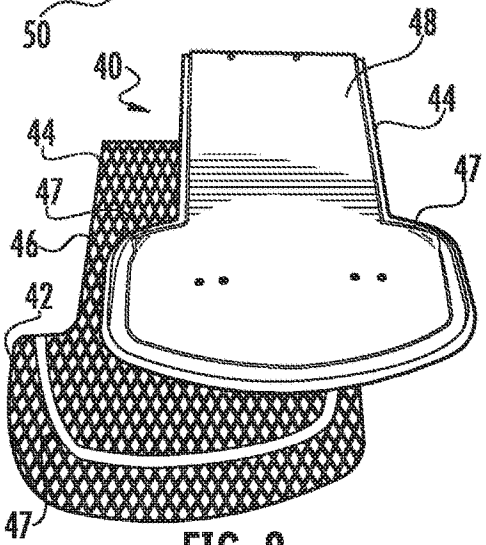
FIG. 8 is perspective, top view of the foot ledge of FIG. 7 partially disassembled.

The support platform 48 may be, for example, a 3D-printed frame or a laser-cut steel plate (with, for example, 10 gauge steel). The foot pad 46 may optionally be epoxied onto the support platform 48. As shown in FIG. 8, the foot pad 46 may be easily removed, attached, or reattached to the support platform 48 in order to easily clean or replace the foot pad 46. The foot pad 46 may optionally include a gripping surface or treads in order to prevent the user's feet from slipping off of the foot ledge 40. The foot pad 46 may be constructed out of a variety of different materials, including but not limited to plastic or rubber.

Figure 12:
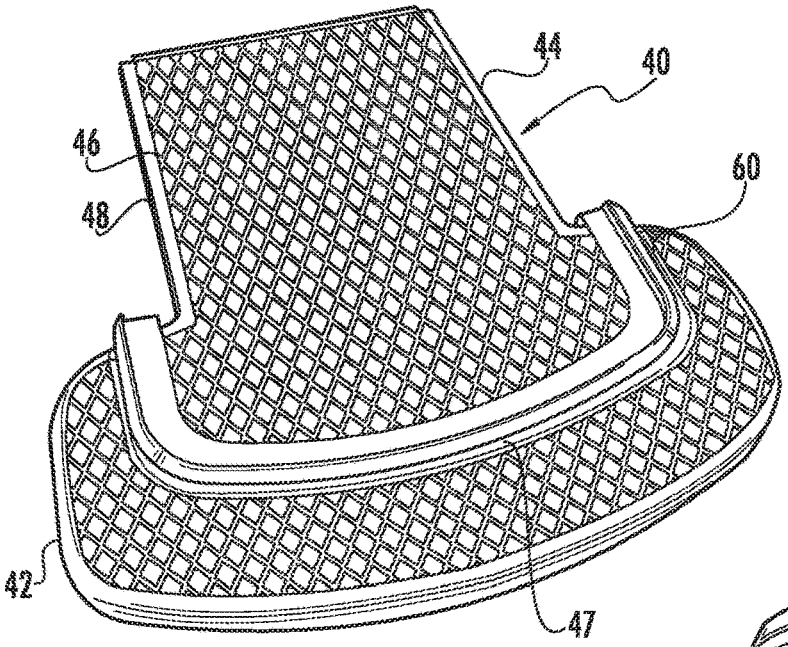
FIG. 12 is a perspective view of the foot ledge of FIG. 7 with the trim piece of FIG. 11.

As shown in FIGS. 6 and 12, the foot ledge 40 may include a cutout guard, divot, channel, or recessed area 47 that extends along a portion of the width of the foot ledge 40 and is relatively thinner (in a vertical direction) than at least the front portion of the foot ledge 40. The recessed area 47 extends along a top surface of the foot ledge 40 (e.g., the top surfaces of the wide portions 42 of the foot pad 46 and the support platform 48) in order to provide an area that securely fits with the slot 26 of the toilet base 24 when in the retracted position 32. The recessed area 47 may be complementary to the shape and size of the upper edge of the slot 26 (or of the trim piece 60, as described further herein), in particular to the bottom surface of the upper edge of the slot 26. The recessed area 47 is positioned along the length of the foot ledge 40 such that the recessed area 47 aligns with and extends along the length of the upper edge of the slot 26 when the foot ledge 40 is in the retracted position 32.

The back portion of the foot ledge 40 (i.e., the portion of the foot ledge 40 that is behind the recessed area 47, including the narrow portion 44 and a portion of the wide portion 42) may be relatively thinner than the front portion of the foot ledge 40 (i.e., the portion of the foot ledge 40 that is in front of the recessed area 47, which is only a portion of the wide portion 42). This configuration allows the back portion of the foot ledge 40 to easily fit within and move through the slot 26. Accordingly, the vertical height (i.e., the thickness) of the recessed area 47 and the back portion of the foot ledge 40 is smaller than the vertical height of the slot 26 (i.e., the distance between the upper edge and the lower edge of the slot 26). Additionally, the thickness or height of the front portion of the foot ledge 40 relative to height of the slot 26 (as well as the width of the wide portion 42 compared to the width of the slot 26) prevents the foot ledge 40 from moving too far into the toilet base 24. However, the foot ledge 40 may be configured such that the entire foot ledge 40 is positioned within the toilet base 24 in the retracted position 32.

Figure 9:
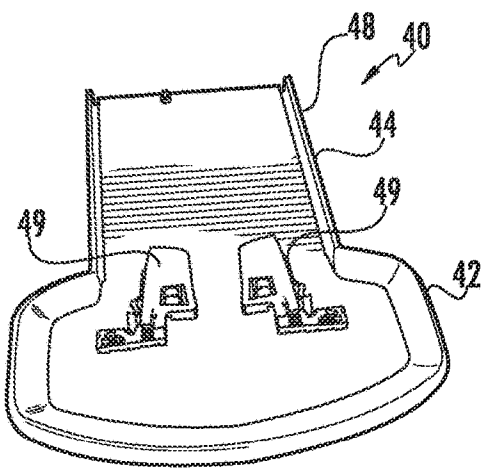
FIG. 9 is a perspective, bottom view of the foot ledge of FIG. 7.
Figure 10:
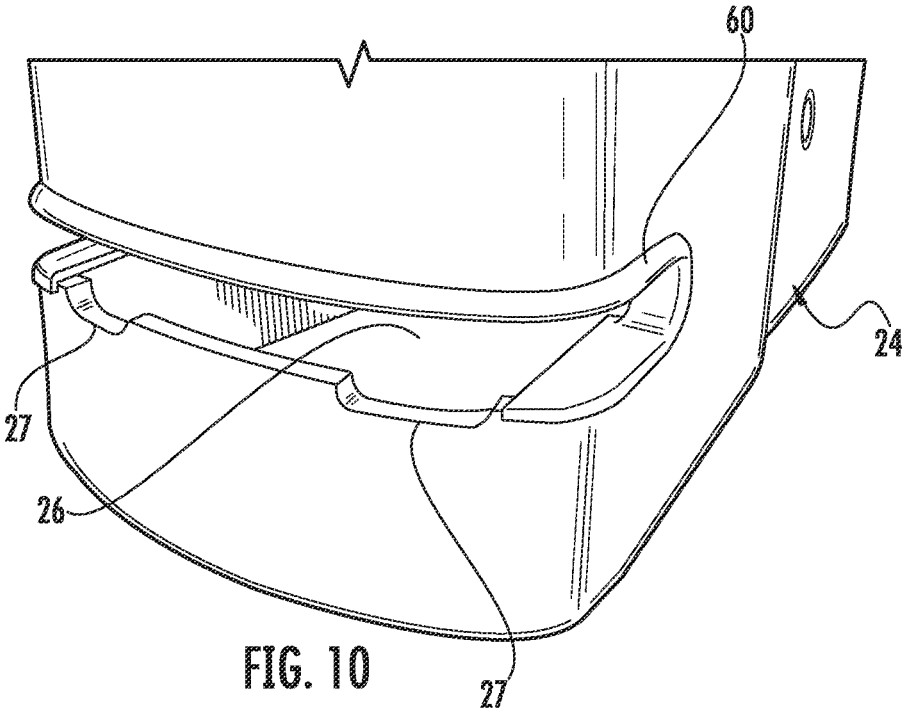
FIG. 10 is a perspective view of the front of a toilet base of the toilet of FIG. 1.

As shown in FIG. 9, the foot ledge 40 includes latches 49 attached to opposite sides of the bottom surface of the support platform 48, opposite to the foot pad 46. The latches 49 may allow the foot ledge 40 to movably lock with a portion of the rail mechanism 70 (such as an upper rail) after or during installation in order to guide the movement of the foot ledge 40 along the rail mechanism 70 (in particular as the foot ledge 40 is moved between the retracted positon 32 and the extended positon 34) and to prevent the foot ledge 40 from inadvertently falling completely out of the toilet base 24 in the extended position 34. Since the latches 49 may extend beyond the bottom surface of the support platform 48 (thereby increasing the overall thickness of the foot ledge 40 along the latches 49), the lower edge of the slot 26 includes notches 27 that provide an area of increased clearance along height of the slot 26 (as shown in FIG. 10) for at least a portion of the latches 49 to be able to fit and move through as the foot ledge 40 is moved between the retracted position 32 and the extended position 34. The notches 27 of the slot 26 are positioned along the front wall of the toilet base 24.

Figure 11:
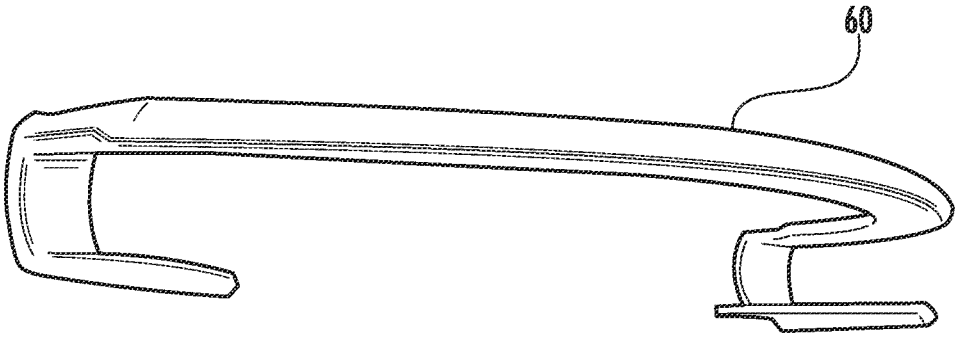
FIG. 11 is a perspective view of a trim piece for the toilet base of FIG. 10.

In order to fit closely with the foot ledge 40, the slot 26 of the toilet base 24 includes a trim piece 60 that extends around at least a portion of the edges of the slot 26, as shown in FIG. 10, in particular the upper edge of the slot 26. As shown in FIG. 11, the trim piece 60 is shaped according to the shape of the inner surfaces of the edges of the slot 26 such that the trim piece 60 and the edges of the slot 26 are complementary, and the trim piece 60 fits within the edges of the slot 26. Accordingly, the trim piece 60 extends along the upper edges of the slot 26, the side edges of the slot 26, and at least a portion of the lower edges of the slot 26 (as shown in FIG. 10). The trim piece 60 may extend along the portions of the lower edges of the slot 26 that are along the side walls of the toilet base 24. The trim piece 60 may optionally not extend along the portion of the lower edge of the slot 26 that is along the front wall of the toilet base 24. The trim piece 60 may be attached to the slot 26 with, for example, an adhesive such as 5-minute epoxy.

Figure 13:
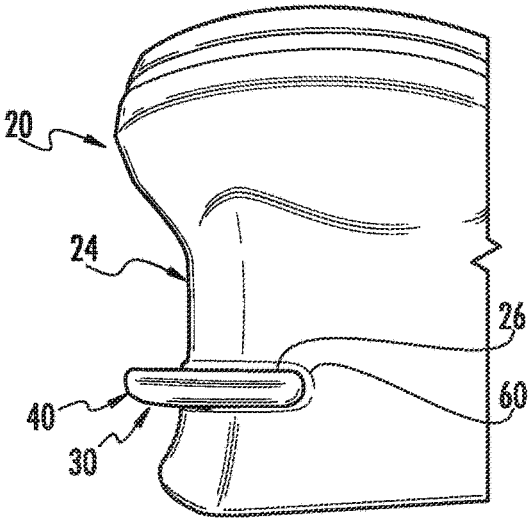
FIG. 13 is a side view of the toilet of FIG. 1.
Figure 14:
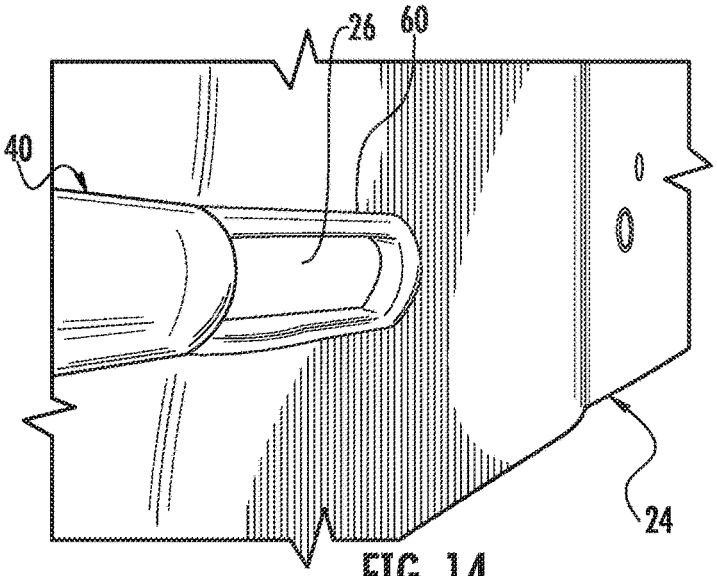
FIG. 14 is a close-up view of a portion of the toilet of FIG. 1 with the foot ledge structure in the extended position.

As shown in FIG. 12, the trim piece 60 is configured to extend along the top surface of the foot ledge 40 (in particular along the recessed area 47 of the foot ledge 40) when the foot ledge 40 is in the retracted position 32. Accordingly, the trim piece 60 may align with and at least partially fit within the recessed area 47 of the foot ledge 40 when the foot ledge 40 is in the retracted position 32. The trim piece 60 may be constructed out of a relatively soft material, which ensures a close and accurate fit between the foot ledge 40 and the slot 26 (as shown in FIGS. 13-14), even with size and shape tolerances of the slot 26 (in particular with a vitreous toilet base). Accordingly, the trim piece 60 closes any gaps between the edges of the slot 26 and the foot ledge 40, in particular while the foot ledge 40 is in the extended position 34.

Base Bracket

Figure 15:
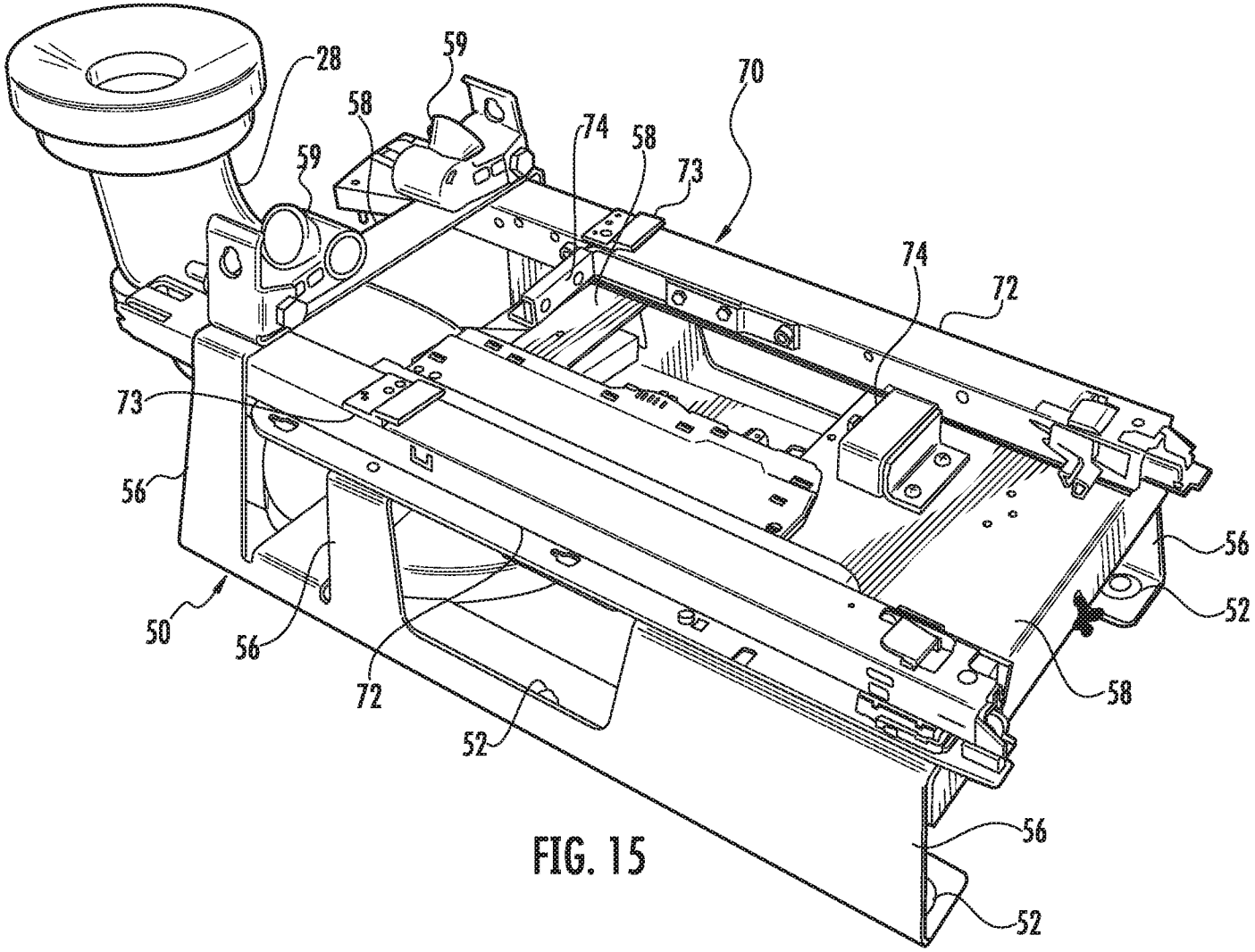
FIG. 15 is a perspective view of a base bracket and a rail mechanism of the foot ledge structure of FIG. 6.

FIG. 15 shows the rail mechanism 70 attached to the base frame, structure, or bracket 50 of the foot ledge structure 30. The base bracket 50 is configured to attach the foot ledge structure 30 to the floor (and/or a bottom portion of the toilet base 24), provides an area for the foot ledge 40 to movably attach to (via the rail mechanism 70), and elevates the foot ledge 40 to a particular height above the floor. Once installed, the base bracket 50 is non-movably or statically attached to the toilet base 24 (or to the floor) and the foot ledge 40 is movably attached to the base bracket 50. The base bracket 50 is positioned within the inner area 23 of the toilet base 24 (as shown in FIG. 3) and beneath the toilet bowl 25.

Figure 16:
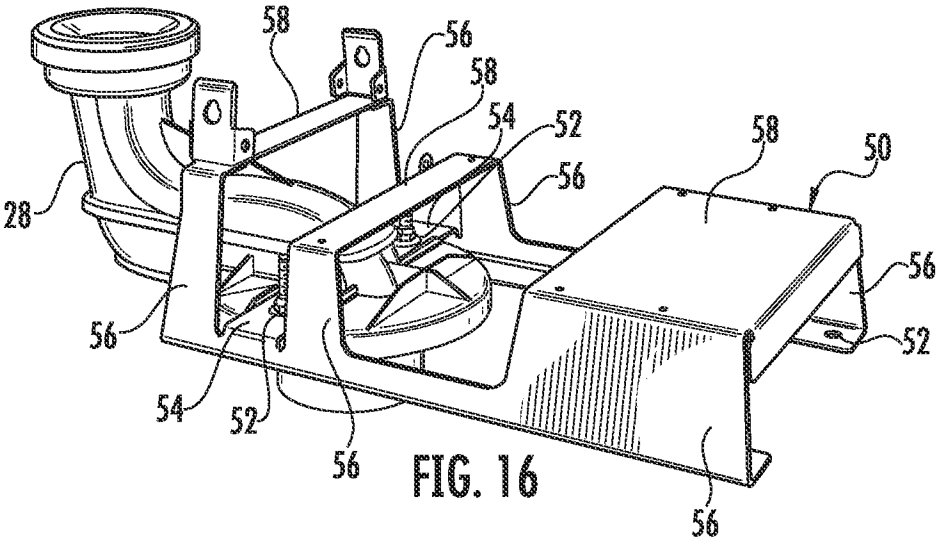
FIG. 16 is a perspective view of the base bracket of FIG. 15.

As shown in FIG. 16, the base bracket 50 includes a variety of different vertical walls, such as at least one vertical wall, supports, protrusions, or extensions 56 and upper horizontal walls, supports, protrusions, or extensions 58. The vertical extensions 56 vertically elevate the upper horizontal extension 58, as well as portions of the rest of the foot ledge structure 30, in particular the foot ledge 40, to a particular height above the floor (and below the top of the toilet base 24). The vertical extensions 56 are positioned along opposite sides of the base bracket 50 (along the width of the base bracket 50). When installed, the vertical extensions 56 are positioned along opposite sides of the trapway 28. The horizontal extensions 58 are positioned along the top of the vertical extensions 56 and horizontally connect two opposite vertical extensions 56 across the width of the base bracket 50 in order to provide various areas for the rail mechanism 70 to attach to. The vertical extensions 56 and the horizontal extensions 58 may be narrow strips of material or wide plates of material, depending on the desired configuration. The horizontal extensions 58 may be at different heights from each other, depending on the desired configuration.

Figure 88:
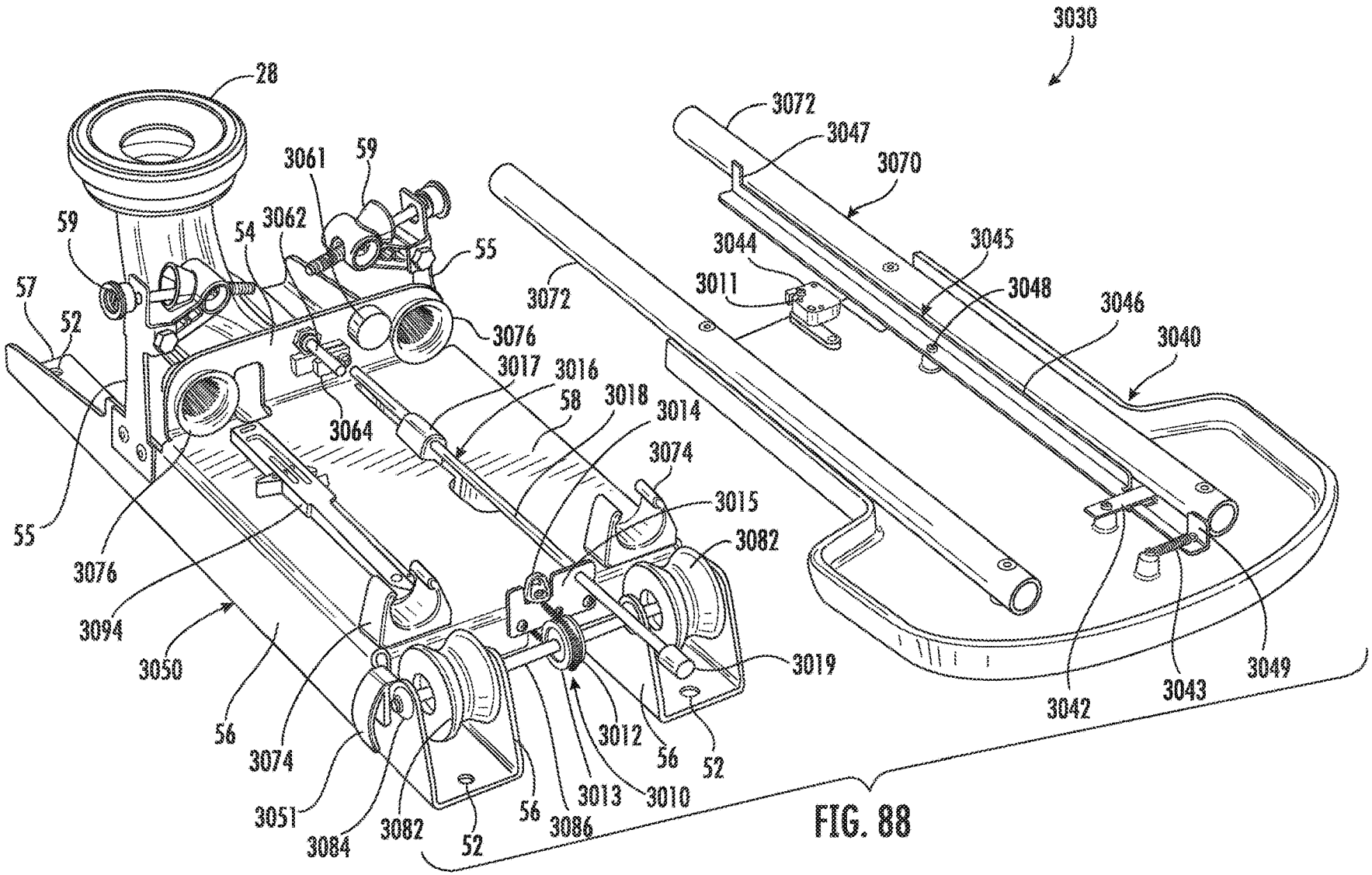
FIG. 88 is a perspective view of a foot ledge structure with a foot ledge removed from a base bracket according to another embodiment.

The base bracket 50 includes fasteners holes, such as bolt holes 52, along protrusions (e.g., lower horizontal extensions 57, as described further herein and labeled in FIG. 88) that extend along a lower portion of the base bracket 50, along at least a portion of the length of the base bracket 50, and along both sides of the base bracket 50. The bolt holes 52 are configured to receive a variety of different fasteners to attach the base bracket 50 to the floor. According to one embodiment, the base bracket 50 may include six bolt holes 52.

Additionally, the base bracket 50 is configured to extend around and statically attach to a portion of the trapway 28 (and/or the toilet base 24), which properly positions the base bracket 50, and thus the rest of the foot ledge structure 30, relative to the trapway 28 and the rest of the toilet 20. Accordingly, the base bracket 50 may include two flanges 54 with additional bolt holes 52 in order to be attached to the trapway 28. The base bracket 50 may include vertical extensions 56 on opposite sides of the trapway 28 and horizontal extensions 58 above and over a portion of the trapway 28. Additional vertical extension 56 and horizontal extensions 58 may be positioned in front of and separate from the trapway 28.

Figure 17:
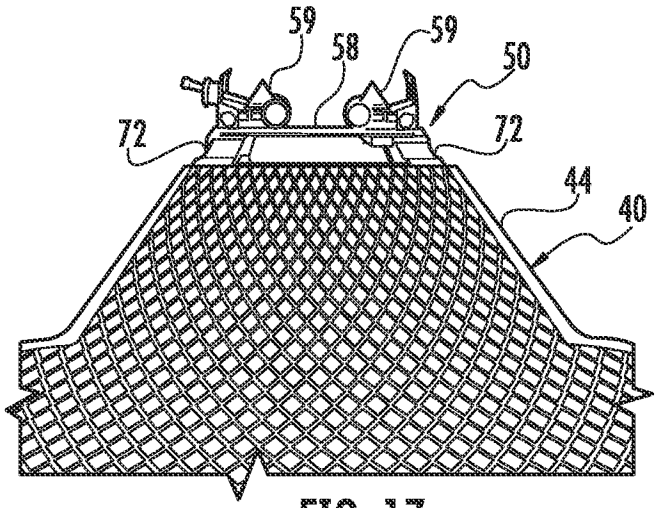
FIG. 17 is a front view of the foot ledge structure of FIG. 6.
Figure 18:
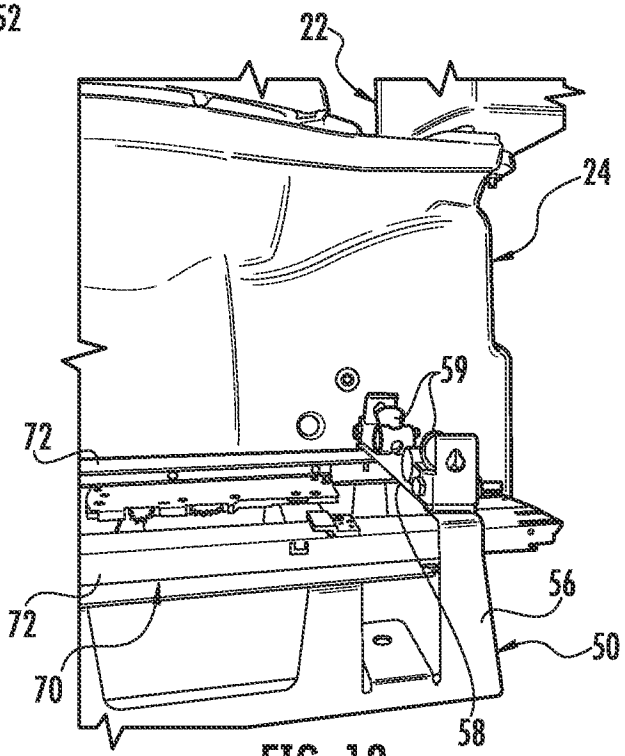
FIG. 18 is a side view of the base bracket and the rail mechanism of FIG. 15 next to the toilet of FIG. 1.

As shown in FIGS. 17-18, at least one mounting cam 59 (e.g., a ready-lock cam bracket with the associated ready-lock parts) is attached to the base bracket 50 in order to allow the base bracket 50 to attach or secure to the toilet base 24. The mounting cams 59 are positioned at the back end and top of the base bracket 50 (i.e., above the back horizontal extension 58) and on opposite sides of the base bracket 50. As shown in FIG. 18, the mounting cams 59 are configured to be positioned toward the back end of the toilet base 24 in order to align with holes (e.g., toilet anchor points) extending through the side walls of the toilet base 24. The holes in the side walls of the toilet base 24 and the mounting cams 59 are configured to receive a fastener (e.g., a ready-lock bolt) in order to secure the toilet base 24 and the base bracket 50 together during installation.

The mounting cams 59 are positioned above the rail mechanism 70 (in particular above the rails 72) in order to allow the rails 72 to move below the mounting cams 59 without interference. Accordingly, the back horizontal extension 58 may be positioned vertically above the rails 72 and above the other horizontal extensions 58 (that are closer to the front of the base bracket 50 and that the rails 72 are positioned on top of).

Rail Mechanism

Figure 19:
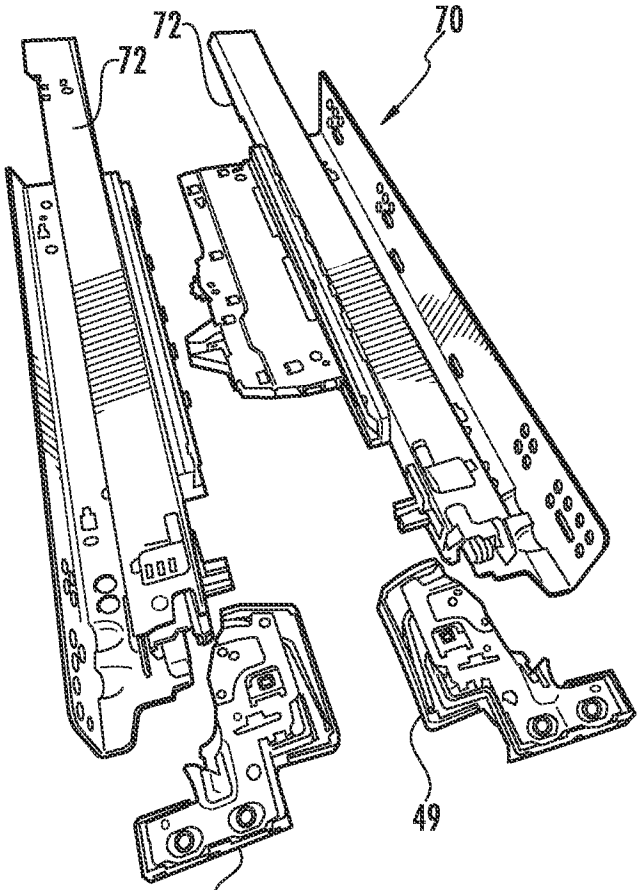
FIG. 19 is a perspective view of a portion of the rail mechanism of FIG. 15.

The rail mechanism 70 allows the foot ledge 40 to move or slide between the retracted position 32 and the extended position 34 relative to the base bracket 50 and the rest of the toilet 20 (in particular the toilet base 24). Accordingly, as shown in FIG. 19, the rail mechanism 70 has at least one slide or rail 72 that is configured to attach to the base bracket 50 (as shown in FIG. 15).

According to one embodiment, the rail mechanism 70 has two rails 72 positioned on opposite sides of the foot ledge structure 30. Each of the two rails 72 has a lower rail member. The lower rail members are positioned on opposite sides of the base bracket 50 from each other (along the width of the base bracket 50). The lower rail members of the rails 72 may be attached to a top portion of the base bracket 50 along at least one of the horizontal extensions 58. The two rails 72 extend lengthwise along the length of the base bracket 50 (and optionally the foot ledge 40) and allow and guide the movement of the foot ledge 40 along at least a portion of the length of the base bracket 50. According to one embodiment, the foot ledge 40 includes latches 49 (as described further herein) that movably attach to the lower rail members of the rails 72. In particular, each of the latches 49 on the bottom surface of the foot ledge 40 (as shown in FIG. 9) may attach to and move along a portion of each of the upper rail members of the rails 72. The rails 72 may be spring-loaded (and accordingly the rail mechanism 70 may include springs) such that, when the foot ledge 40 is released from the retracted position 32, the foot ledge 40 may automatically move out into the extended position 34.

Figure 20:
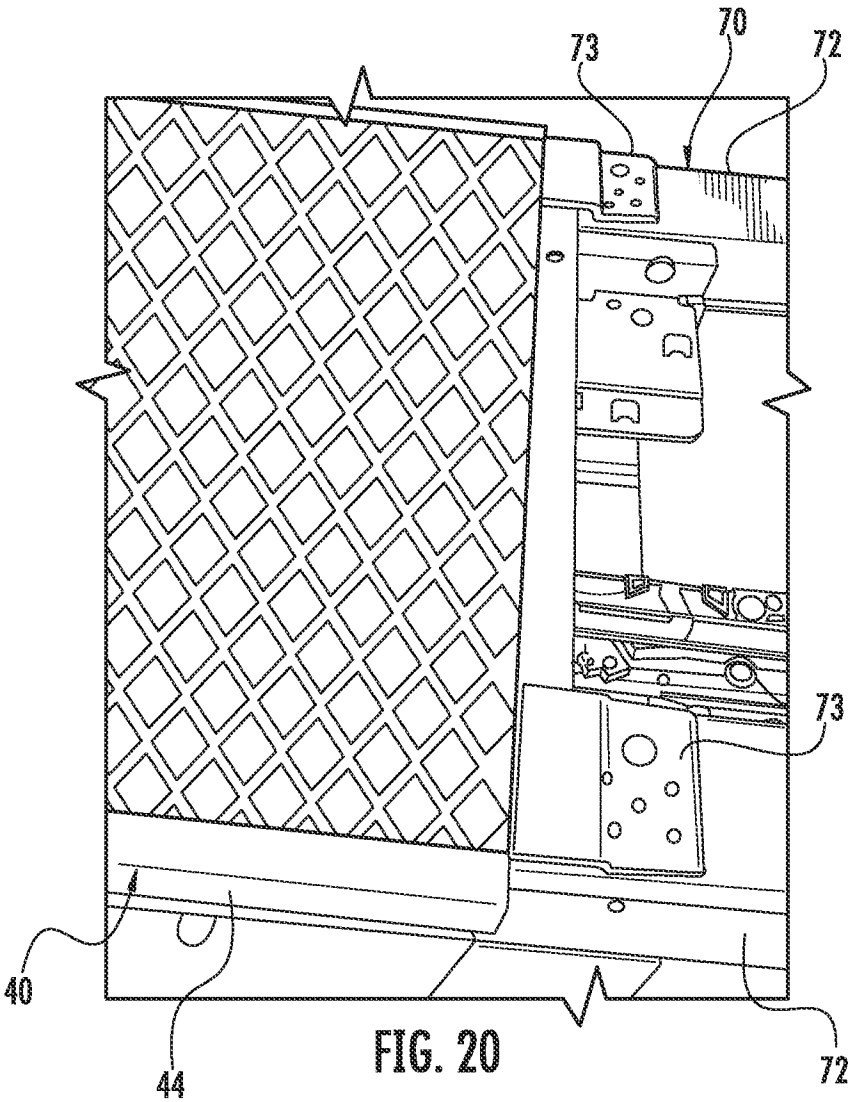
FIG. 20 is a top view of a portion of the foot ledge structure of FIG. 6.

The rail mechanism 70 may be configured such that the latches 49 of the foot ledge 40 move directly along the length of and relative to the rails 72. Alternatively, the rail mechanism 70 may be configured such that the foot ledge 40 moves with a portion of each of the rails 72. In particular, each of rails 72 includes an upper rail member (statically attached to the foot ledge 40 (via, for example, the laches 49)) and the lower rail member (statically attached to the base bracket 50) that are movably attached to each other to allow the foot ledge 40 to move between the retracted position 32 and the extended position 34. The upper rail members are positioned on opposite sides of the foot ledge 40 from each other (along the width of the foot ledge 40). Accordingly, as shown in FIG. 20, each of the upper rail members of the rails 72 may include an extension or blind tab 73 that is positioned on top of each of the upper rail members. The blind tabs 73 are configured to receive, attach to, and secure to a portion of the back end of the foot ledge 40 (i.e., the back end of the narrow portion 44 of the foot ledge 40) once the foot ledge 40 is installed onto the rail mechanism 70. Accordingly, the blind tabs 73 statically attach the foot ledge 40 to the upper rail members of each of the rails 72 such that the foot ledge 40 and the upper rail members move congruently relative to the lower rail members (and the rest of the toilet 20).

Figure 21:
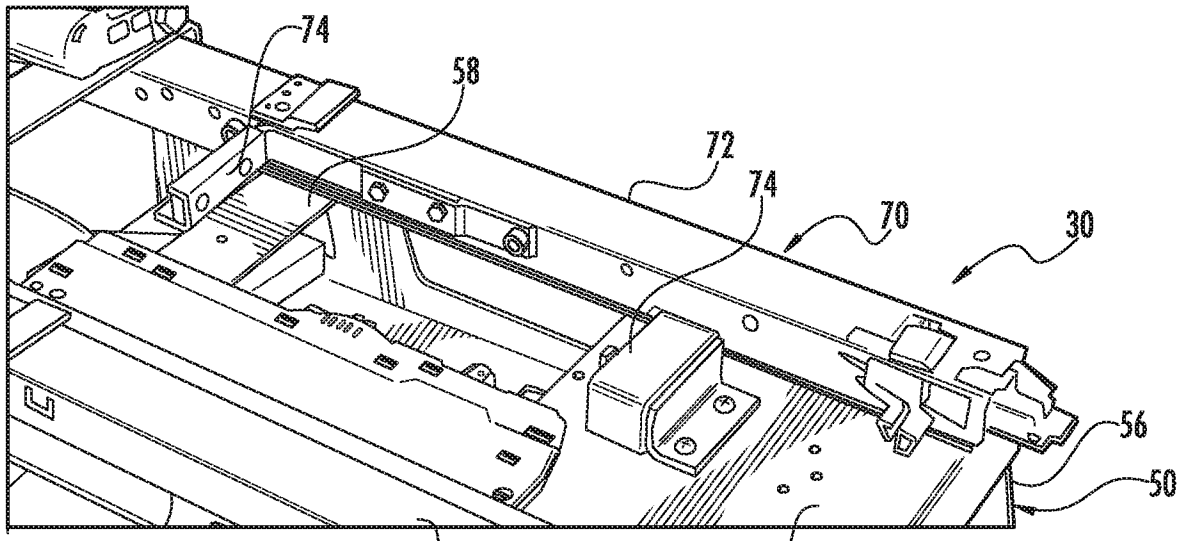
FIG. 21 is a close-up view of a portion of the base bracket and the rail mechanism of FIG. 15.
Figure 22:
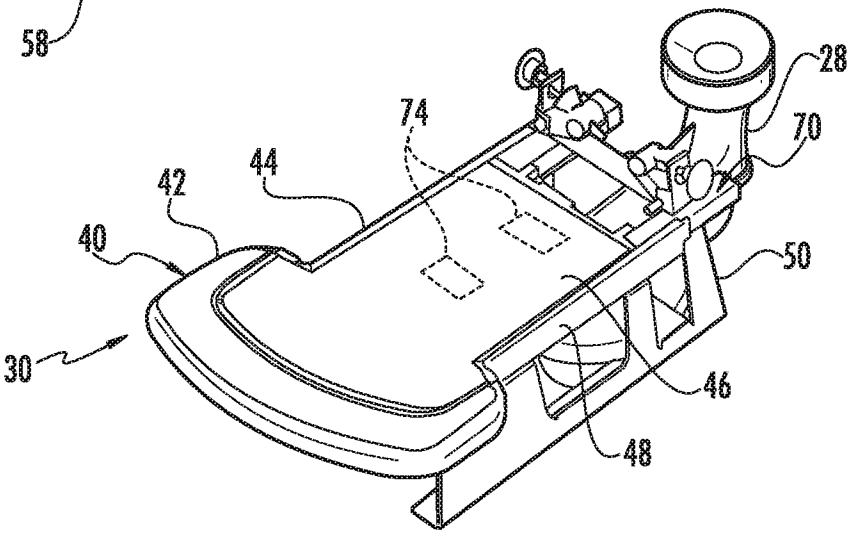
FIG. 22 is a perspective view of the foot ledge structure of FIG. 6.

The rail mechanism 70 may include a variety of different components that lock or secure the foot ledge 40 in the retracted position 32 and in the extended position 34. According to one embodiment as shown in FIGS. 21-22, the rail mechanism 70 includes at least one magnet 74 and at least one corresponding magnetic component in order to secure the foot ledge 40 in the retracted position 32 and in the extended position 34 and to provide stops in the retracted position 32 and in the extended position 34. The magnets 74 allow the rail mechanism 70 to quickly and easily move the foot ledge 40 between the retracted position 32 and the extended position 34. Furthermore, by securing the foot ledge 40 in the extended position 34, the foot ledge 40 is more stable and less likely to move during use.

For example, the rail mechanism 70 may include two magnetic components 74 (referred to herein as the "magnets 74") and a corresponding magnetic component that is removably attachable (and reattachable) to the magnets 74. In particular, the rail mechanism has a front magnetic component (referred to herein as the "front magnet 74") corresponding to the extended position 34 and a back magnetic component (referred to herein as the "back magnet 74") corresponding to the retracted position 32. The corresponding magnetic component is removably, magnetically attached to the back magnet 74 when the foot ledge 40 is in the retracted position 32 and to the front magnet 74 when the foot ledge 40 is in the extended position 34, thereby securing the foot ledge 40 in either the retracted position 32 or the extended position 34, depending on the position of the foot ledge 40. At least one of the corresponding magnetic component or both of the two magnetic components 74 is a magnet.

As shown in FIGS. 21-22, the two magnets 74 are separated from each other along the length of the foot ledge structure 30 (i.e., the front magnet 74 is positioned closer to the front of the toilet base 24 and the back magnet 74 is positioned closed to the back of the toilet base 24). The front magnet 74 and the back magnet 74 may optionally be aligned with each other along the width of the toilet base 24. With such positioning, the corresponding magnetic component can be moved along the length of the foot ledge structure 30 between the two magnets 74 (in order to move the foot ledge 40 in the direction of the length of the foot ledge structure 30).

The two magnets 74 are statically attached to and positioned on one of the base bracket 50 or the bottom surface of the support platform 48 of the foot ledge 40 and the corresponding magnet component is statically attached to and positioned on the other of the base bracket 50 or the bottom surface of the support platform 48 of the foot ledge 40. Any magnetic component(s) that are statically attached to the foot ledge 40 move with the foot ledge 40 as the foot ledge moves between the retraced position 32 and the extended position. According to one embodiment as shown in FIG. 21, the two magnets 74 are statically attached to and positioned along a top portion of the base bracket 50 (and accordingly are separated from each other along the length of the base bracket 50). Accordingly, the corresponding magnetic component extends from and is statically attached to the bottom surface of the support platform 48 of the foot ledge 40. The corresponding magnetic component moves with the foot ledge 40 between the front magnet 74 and the back magnet 74 (as the foot ledge 40 moves between the retracted position 32 and the extended position 34).

The one front magnet 74 (that is positioned toward the front of the foot ledge structure 30 and therefore is further away from the trapway 28 relative to the back magnet 74) secures the foot ledge 40 in the extended position 34 by attaching to the corresponding magnetic component when the corresponding magnetic component (and thus the entire foot ledge 40) is moved forward into the extended position 34. The other back magnet 74 (that is positioned toward the back of the foot ledge structure 30 and therefore is closer to the trapway 28 relative to the front magnet 74) secures the foot ledge 40 in the retracted position 32 by attaching to the corresponding magnetic component when the corresponding magnetic component (and thus the entire foot ledge 40) is moved backward into the retracted position 32. Alternatively, as shown in FIG. 22, the two magnets 74 are positioned along and attached to the bottom surface of the support platform 48 of the foot ledge 40 (and accordingly are separated from each other along the length of the foot ledge 40), and the corresponding magnetic component is attached to a top portion of the base bracket 50. This configuration may function in a similar manner.

Figure 24:
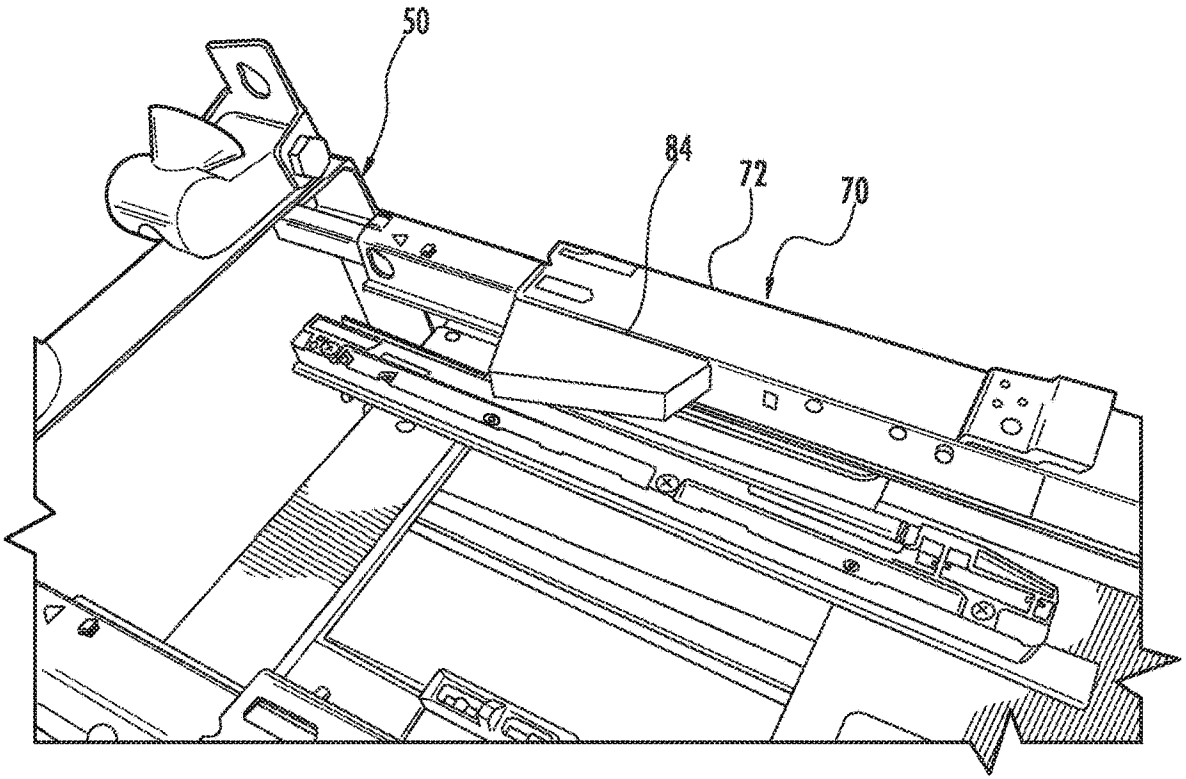
FIG. 24 is a perspective view of a portion of the base bracket and the rail mechanism of FIG. 23.
Figure 23:
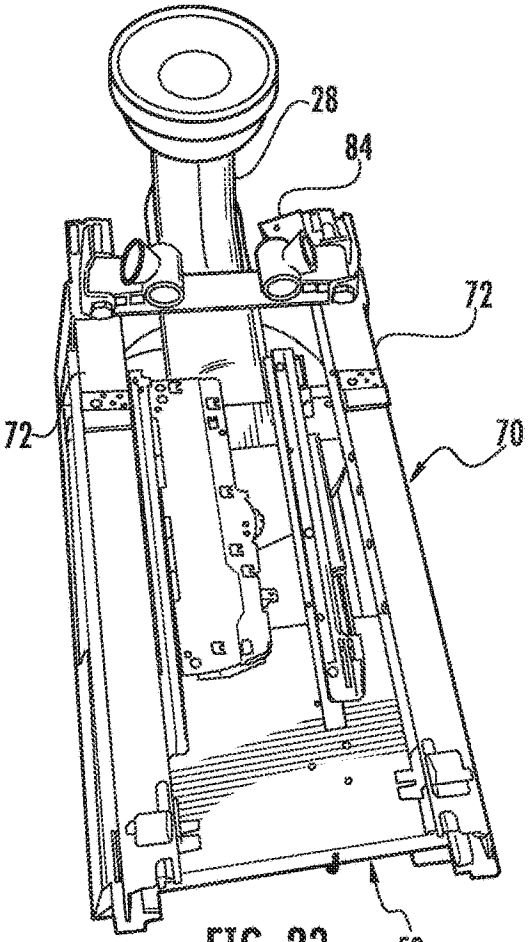
FIG. 23 is a top view of a base bracket and a rail mechanism according to another embodiment.

According to another embodiment as shown in FIGS. 23-24, the rail mechanism 70 includes a slow-close or slow-open component 84 that controls or slows the movement of the foot ledge 40 between the retracted position 32 and the extended position 34 and helps secure the foot ledge 40 in each of the retracted position 32 and the extended position 34. The slow-open component 84 may be positioned on and extend inward from an inner side of one of the rails 72 (such as along the upper rail member). The slow-open component 84 may include an angled side wall that is angled relative to the length (and movement) direction of the rail 72 such that the width of the slow-open component 84 changes along the length of the rail 72. Accordingly, a back end of the slow-open component 84 is wider than the front end of the slow-open component 84, which reduces or controls the speed of the foot ledge 40 moving relative to the base bracket 50.

According to one embodiment, the rail mechanism 70 may be actuated by a motor or comprise an electrically-powered actuator in order to power the rail mechanism 70 and move the foot ledge 40 between the retracted position 32 and the extended position 34 (with or without assistance from the user).

Figure 25:
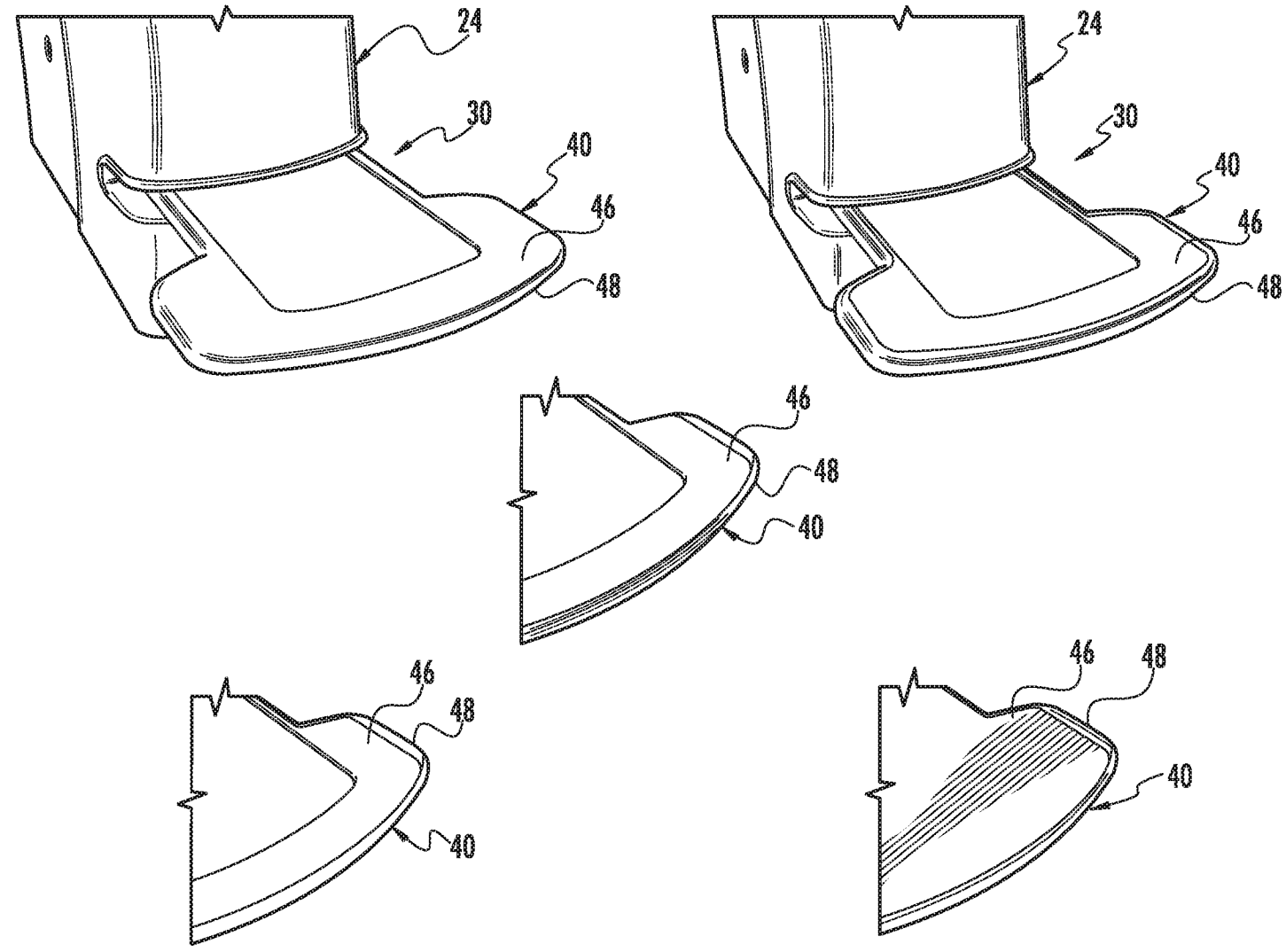
FIG. 25 are perspective view of various configurations of the foot ledge of FIG. 7.

As shown in FIG. 25, the color, material, and/or any surface patterns of the foot ledge structure 30, in particular the portions of the foot ledge structure 30 that are visible outside of the toilet base 24 such as the foot ledge 40, may be altered according to the desired configuration. For example, the foot pad 46 and the support platform 48 may have the same or different color and/or material and/or may be integral to or separate from (and attachable to) each other.

According to one embodiment, the foot rest structure 30 may be configured to calculate the weight of the user's legs on the foot ledge 40 (while being used as a footrest). Accordingly, the foot rest structure 30 may include at least one weight sensor configured to detect and measure the weight of the user's feet on the foot ledge 40. The toilet 20 may also be configured to calculate the weight of the user on the toilet seat (while the user is sitting on the toilet seat) and accordingly may also include at least one weight sensor configured to detect and measure the weight of the user on the toilet seat. Accordingly, the footrest weight data (regarding the weight of the user's legs) and the toilet seat weight data (regarding the weight of the user on the toilet seat) may be used in combination with each other (i.e., added together) to calculate the user's total weight (for diagnostic purposes, for example).

Alternative Embodiment of the Toilet

FIGS. 26-40 show an alternative embodiment of a toilet 120 with a foot ledge structure 130. The various features and components of the toilet 120 are similar to the toilet 20 shown in FIGS. 1-25 and like numbers are used where applicable. However, some aspects of the configuration of the toilet 120 of FIG. 26-40 differ from the toilet 20 in FIGS. 1-25, as described further herein. The various features, components, and configurations of the toilet 120 can be used and included within the toilet 20 (and vice versa) unless otherwise specified.

Figure 27:
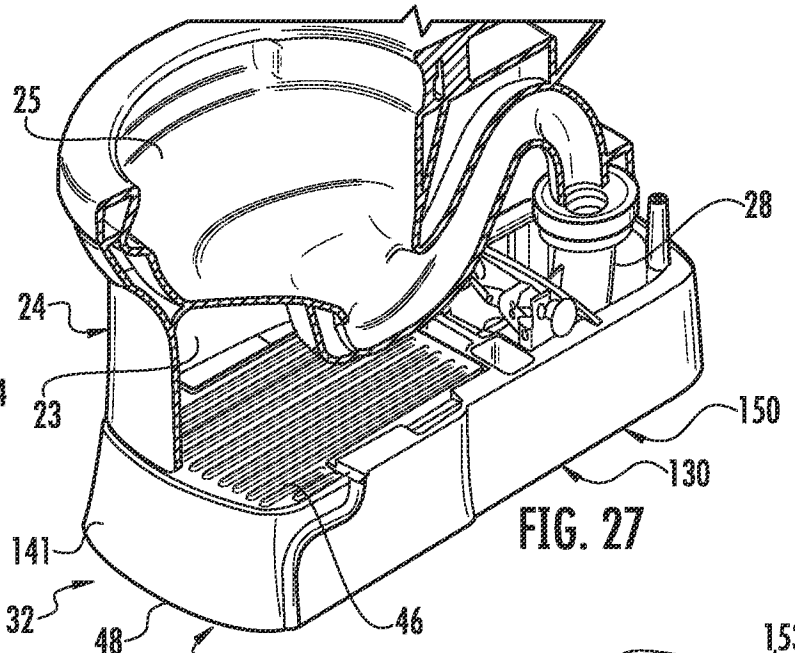
FIG. 27 is partially cross-sectional view of the toilet of FIG. 27 with the foot ledge structure in the retracted position.
Figure 26:
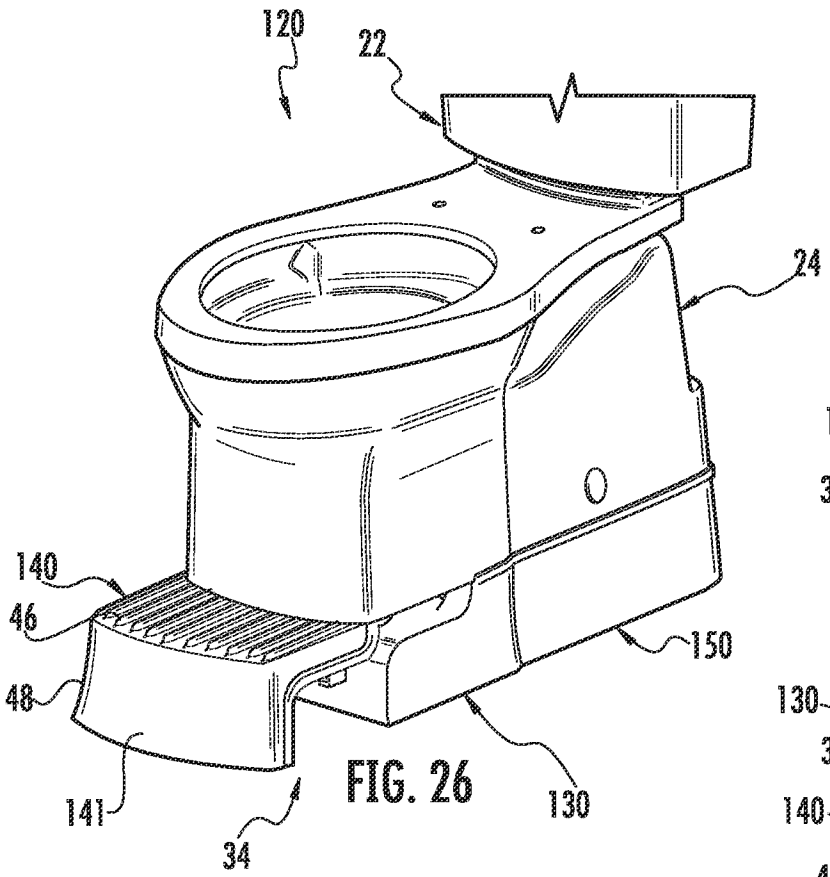
FIG. 26 is a perspective view of a toilet with a foot ledge structure in an extended position according to another embodiment.

The foot ledge structure 130 includes a base unit or structure 150 that is similar in some respects to the base bracket 50. For example, the base structure 150 elevates the foot ledge 140 above the floor and provides an area for the foot ledge 140 to movably attach to (via the rail mechanism 70). However, as shown in FIGS. 26-27, the base structure 150 is positioned between the bottom of the toilet base 24 and the floor such that the base structure 150 elevates the entire toilet base 24 above the floor. Accordingly, the entire toilet base 24 is positioned on top of the foot ledge structure 130.

The foot ledge structure 140 extends beneath the entire bottom of the toilet base 24. The base structure 150 in particular may extend beneath the entire bottom of the toilet base 24 except for the front end of the toilet base 24 in order to allow sufficient room for the front vertical wall 141 of the foot ledge 140 (as described further herein) to move into (beneath the front end of the toilet base 24) when the foot ledge 140 is moved into the retracted position 32. Accordingly, the entire foot ledge 140 can be retracted completely underneath the toilet base 24 (and completely underneath the entire inner area 23 defined by the toilet base 24) in the retracted position 32 such that the entire top surface of the foot ledge 140 is obscured in the retracted position 32, as shown in FIG. 27.

Figure 28:
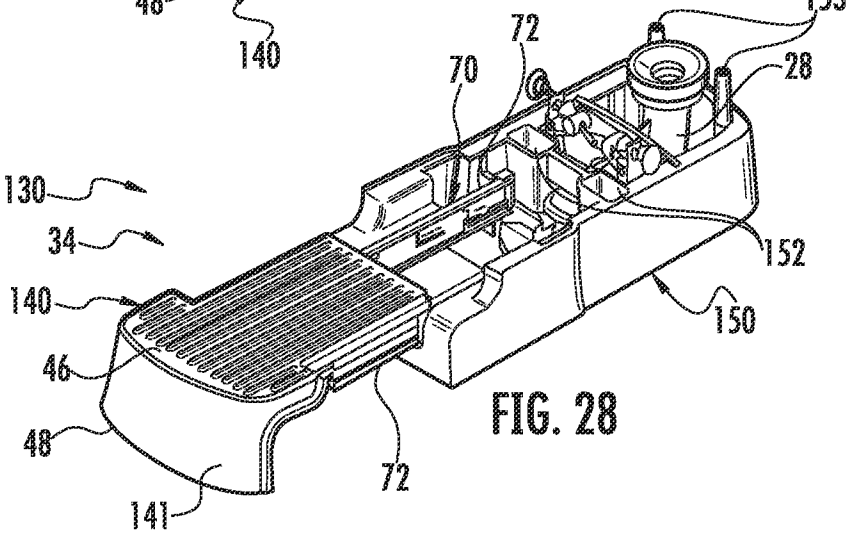
FIG. 28 is a perspective view of the foot ledge structure of the toilet of FIG. 26.
Figure 30:
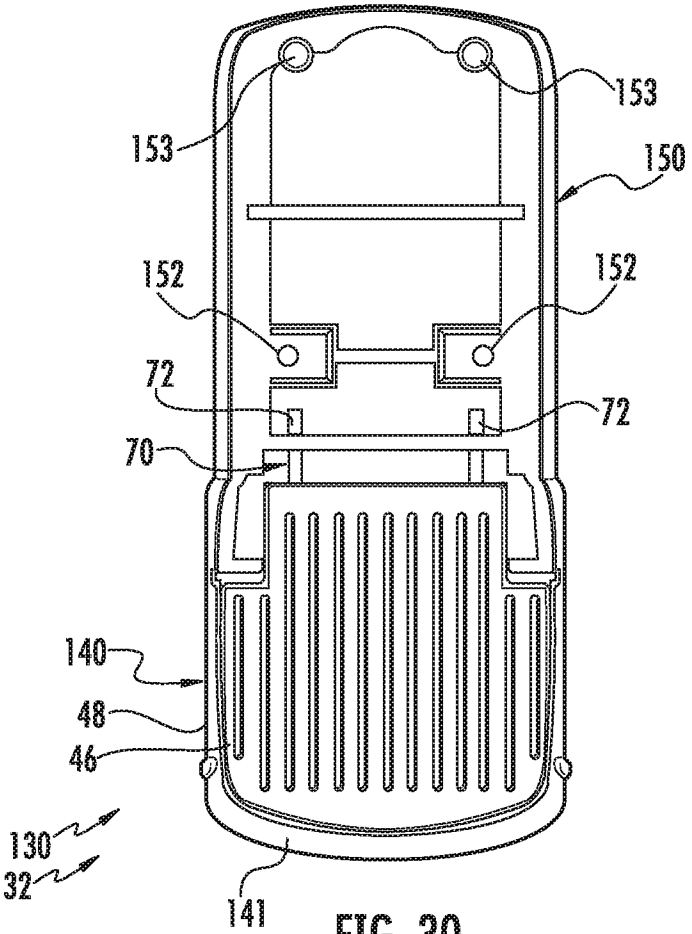
FIG. 30 is a top view of the foot ledge and the base structure of the foot ledge structure of FIG. 28.
Figure 29:
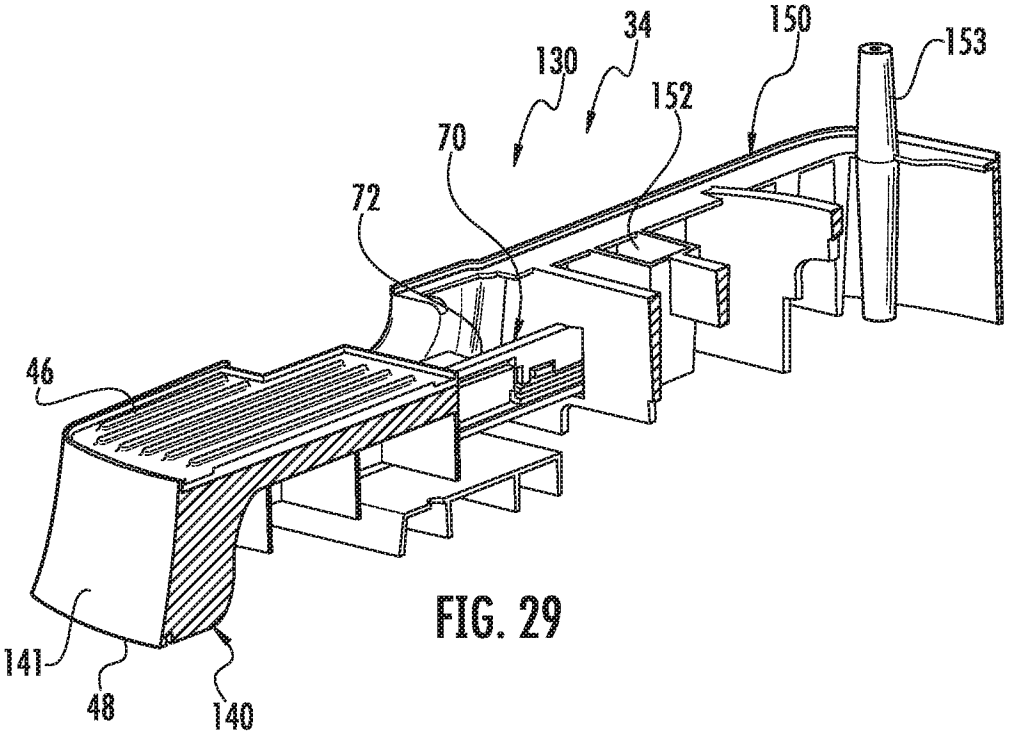
FIG. 29 is a cross-sectional, perspective view of a foot ledge and a base structure of the foot ledge structure of FIG. 28.

As shown in FIGS. 28-30, the base structure 150 may include fastener holes, such as bolt holes 152, and low profile fastener extensions 153 (e.g., bolt towers) that allow the base structure 150 to securely attach to the bottom of the toilet base 24.

Since the base structure 150 elevates the toilet base 24 completely off of the floor, the height of the base structure 150 can be changed in order to affect the overall height of the toilet 120 without changing the distance 101 (see FIG. 3) between the top surface of the rim of the toilet bowl 25 (i.e., the top of the toilet base 24) to the top surface of the foot ledge 140. The toilet base 24 may be relatively shorter (for example, 4.25 inches shorter) than a standard toilet base in order to ensure the proper distance 101. According to one embodiment, the height of the base structure 150 may be approximately 2.25 inches in order to provide a standard height for the toilet 120. According to another embodiment, the height of the base structure 150 may be approximately 4.25 inches in order to provide a "comfort height" for the toilet 120. According to yet another embodiment, the height of the base structure 150 may be approximately 6.25 inches (or more) in order to provide a "super comfort height" for the toilet 120.

As shown in FIGS. 28-29, the rails 72 of the rail mechanism 70 that guide the movement of the foot ledge 140 between the retracted position 32 and the extended position 34 may be, for example only, standard 12-inch drawer guides. The rail mechanism 70 may further include bump open and slow close features. The bump open features cause the foot ledge 40 to be automatically unlocked and moved from the retracted position 32 to the extended position 34 when the user moves (or kicks) the foot ledge 40 backward slightly (i.e., toward the base structure 150 and toward the back side of the toilet 120) when in the retracted position 32. The slow close features cause the foot ledge 40 to be automatically moved from the extended position 34 to the retracted position 32 when the user moves (or kicks) the foot ledge backward slightly (i.e., toward the base structure 150 and toward the back side of the toilet 120) when in the extended position 34. The rail mechanism 70 may further include a stop to prevent the foot ledge 140 from moving too far out from base structure 150 when in the extended position 34.

The foot ledge structure 130 also includes a foot ledge 140 that is similar in some respects to the foot ledge 40. For example, as shown in FIGS. 26-27, the foot ledge 140 is movable between the retracted position 32 and the extended position 34. However, unlike the foot ledge 40, the foot ledge 140 is not cantilevered. Instead, as shown in FIGS. 26-29, the support platform 48 of the foot ledge 140 includes a front vertical wall 141 that extends vertically along and from the front end of the foot ledge 140, extending vertically between the front end of the foot ledge 140 and the floor. The vertical wall 141 is configured to rest along and be supported by the floor in order to support the rest of the foot ledge 140 (in particular the support platform 48). Accordingly, the foot ledge 140 (in particular the support platform 48) is supported along both the front end (via the front vertical wall 141) and the back end (via the base structure 150).

Figure 31:
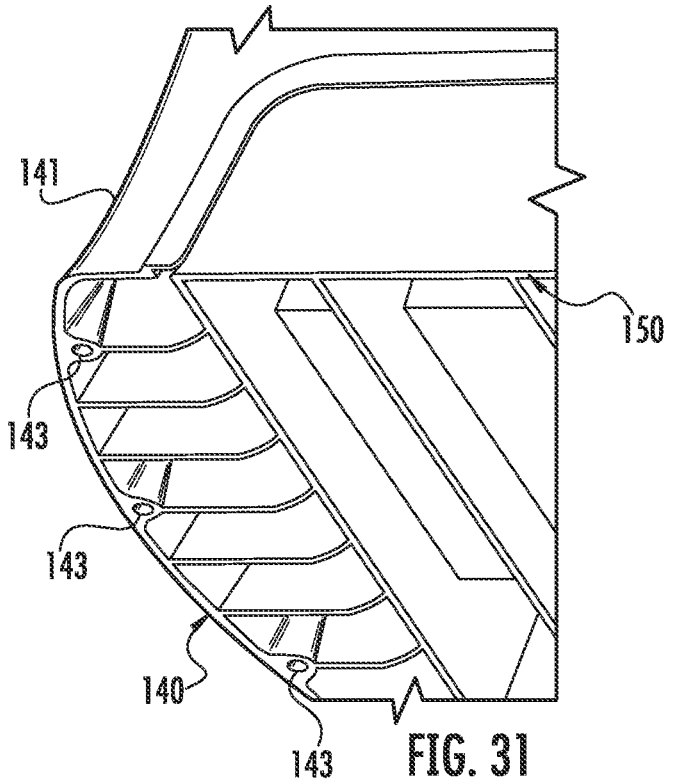
FIG. 31 is a bottom, perspective view of the foot ledge and the base structure of the foot ledge structure of FIG. 28.

As shown in FIG. 31, the bottom edge of the front vertical wall 141 includes recessed holes 143 that are configured to secure rubber bumper(s) that extend beneath the front vertical wall 141. Due to the configuration of the foot ledge 140, the foot ledge 140 is configured to be moved between the retracted position 32 and the extended position 34 without any of the front vertical wall 141 (i.e., the front end) of the foot ledge 140 (including any bumpers) resting on or touching the floor. Accordingly, the foot ledge 140 is only supported and being held by the back end of the foot ledge 140 and is not supported at all by the front end of the foot ledge 140 during movement. However, once a force or weight is applied to the top of the foot ledge 140 (e.g., the user places their feet on top of the foot ledge 140), the bottom portion of the front vertical wall 141 (i.e., the front end) of the foot ledge 140 (or the bumpers) contacts and is supported by the floor. Accordingly, the front end of the foot ledge 140 (i.e., the front vertical wall 141) only contacts and is supported by the floor when weight is applied on top of the foot ledge 140. This configuration allows the foot ledge 140 to be moved between the retracted position 32 and the extended position 34 more easily while still providing extra support to securely support the feet of the user.

Figure 32:
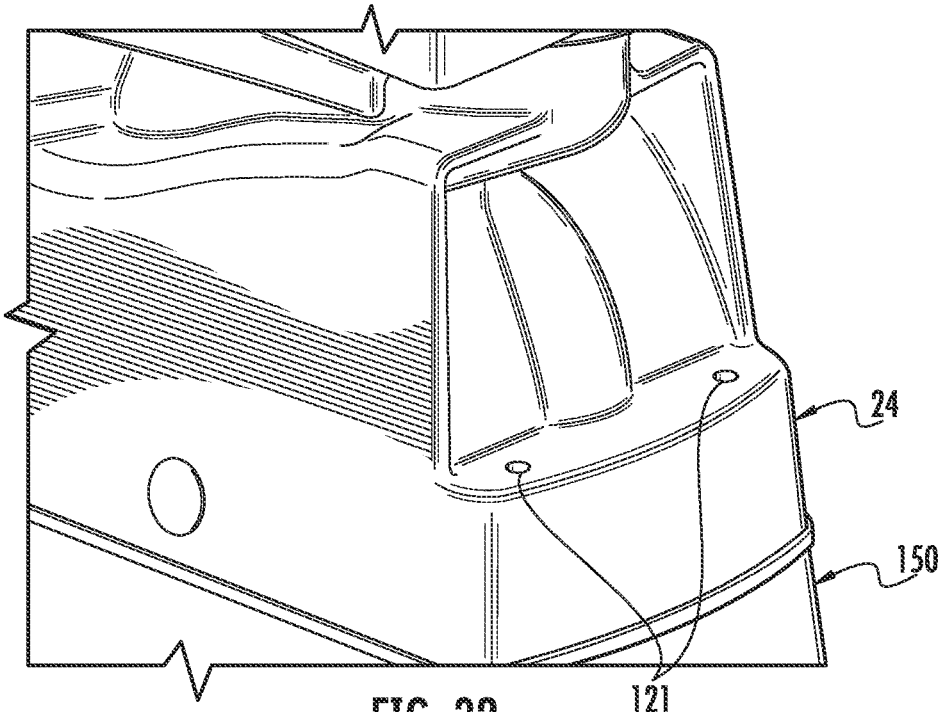
FIG. 32 is a rear, perspective view of a toilet base of the toilet of FIG. 26.

As shown in FIG. 32, the rear deck or back end of the toilet base 24 may include mounting holes 121 that are configured to receive a fastener (e.g., a low-profile bolt cap screw) in order to attach and secure the toilet base 24 to the base structure 150. The mounting holes 121 also help prevent torque from being applied to the fasteners extending through the mounting cams 59.

The various components of the toilet 120, such as the base structure 150 and the foot ledge 140, can be manufactured and created in a variety of different ways, including but not limited to injection molding.

Figure 34:
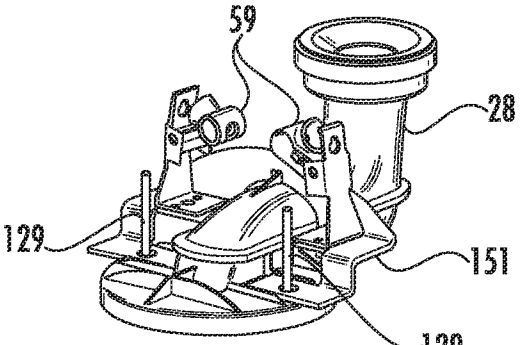
FIGS. 33-40 are perspective views of the toilet of FIG. 26 being assembled.
Figure 33:
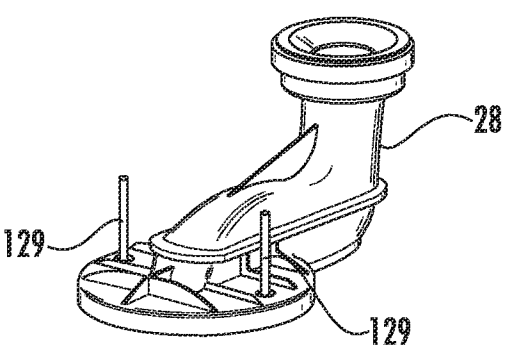

FIGS. 33-40 show how the toilet 120 can be installed within a bathroom. First, as shown in FIG. 33, the trapway 28 is positioned in place (i.e., aligned with the drain in the floor) with a wax seal member sandwiched between the bottom of the trapway 28 and the floor (and around the drain). The trapway 28 is secured to the floor with fasteners 129 (e.g., a standard set of Tee bolts). Then, as shown in FIG. 34, a bracket 151 that includes the mounting cams 59 is positioned over a portion of the trapway 28 and attached to the trapway with the fasteners 129.

Figure 35:
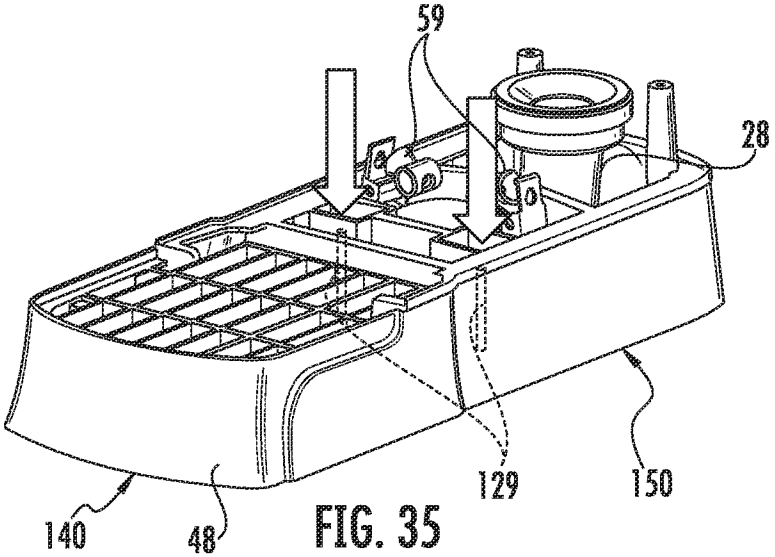

Subsequently, as shown in FIG. 35, the base structure 150 (which the foot ledge 140 is attached to) is placed over the entire trapway 28 and the entire bracket 151, such that the top of the trapway 28 extends through a portion of the base structure 150, and the mounting cams 59 also extend through a portion of the base structure 150. The entire base structure 150 is secured and bolted to the floor with additional fasteners 129 and washers, which further compresses the wax seal member between the trapway 28 and the floor.

Figure 36:
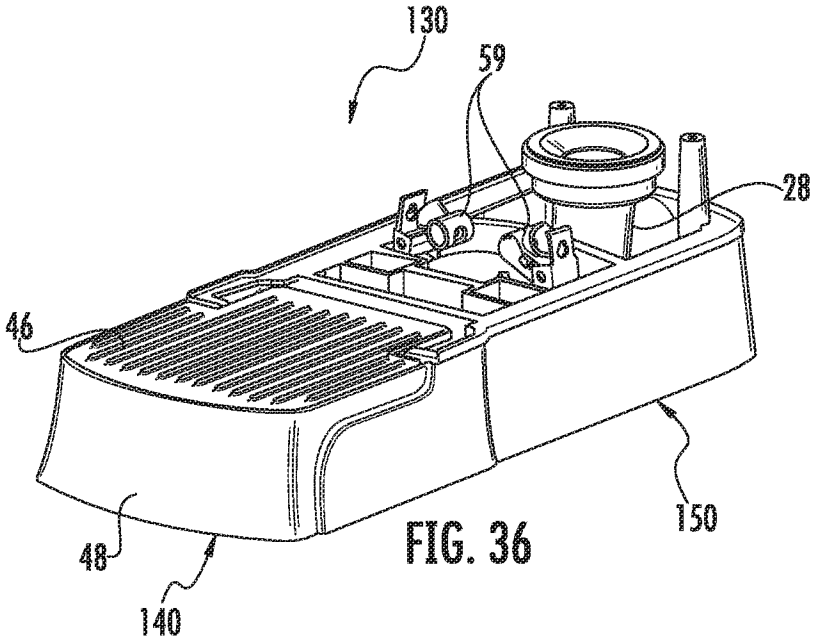
Figure 38:
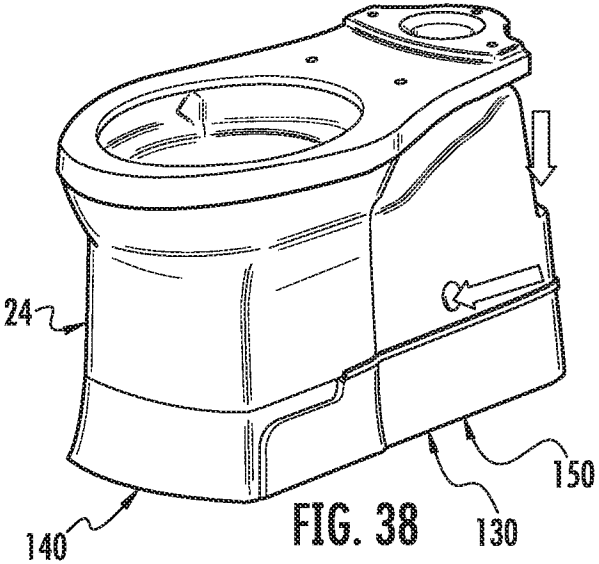
Figure 37:
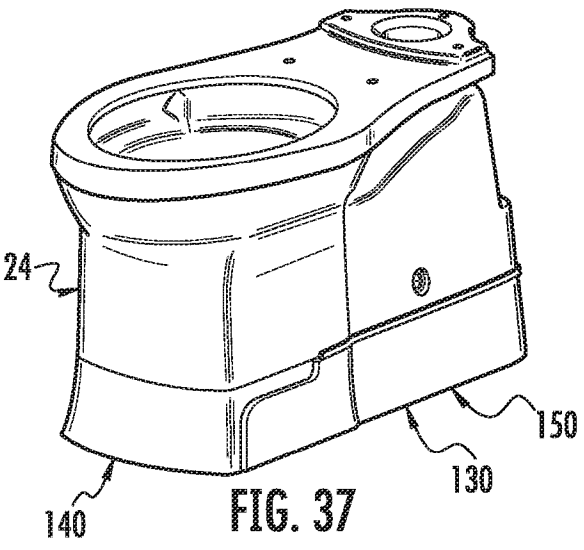
Figure 39:
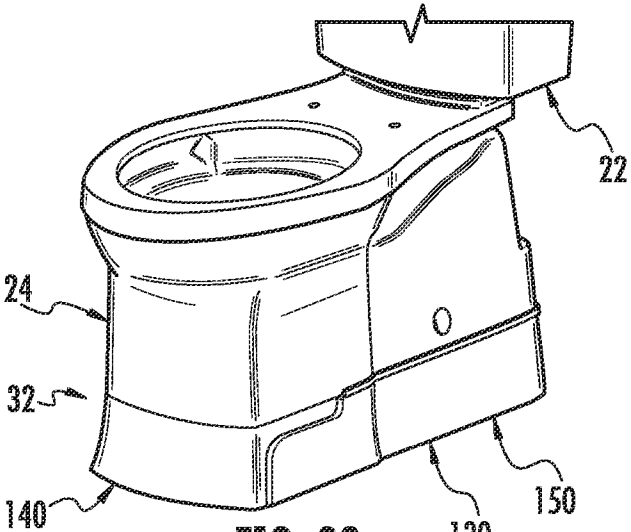

As shown in FIG. 36, the foot pad 46 can then be attached to the support platform 48 of the foot ledge 140. A variety of different attachment mechanisms can be used, including but not limited to, a snap-in feature. As shown in FIG. 37, the toilet base 24 is then positioned on top of the base structure 150 and the foot ledge 140, which allows the toilet base 24 to engage with and fluidly connect to the trapway 28. As shown in FIG. 38, the toilet base 24 is secured and attached to the base structure 150 by inserting additional fasteners through holes in the side walls of the toilet base 24 that attach to the mounting cams 59 and through the mounting holes 121 (as shown in FIG. 32) along the back end of the toilet base 24. The fasteners may be, for example only, bolts (e.g., ready-lock bolts) or low-profile bolt cap screws. As shown in FIG. 39, the tank 22 is then attached to the toilet base 24 through a conventional method. A sealant, such as caulk, may optionally be added along the joint between the base structure 150 and the toilet base 24.

Figure 40:
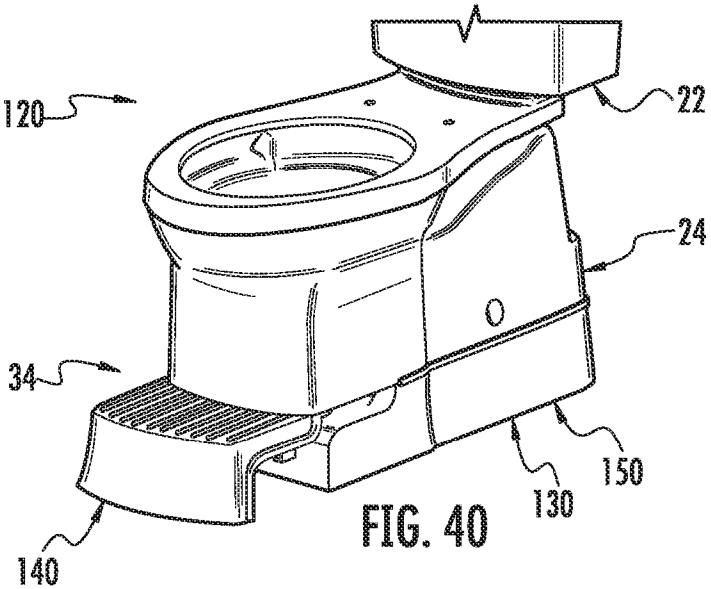

In order to use the foot ledge 140, the user can kick or move the foot ledge 140 backward slightly (e.g., by approximately 0.25 inches) toward the back side of the toilet 120 in order to unlock the foot ledge 140 and activate a pushing mechanism that moves the foot ledge 140 forward along the rail mechanism 70, from the retracted position 32 to the extended position 34 relative to the toilet base 24 and the base structure 150. Once the foot ledge 140 is in the extended position 34 (as shown in FIG. 40), the user can rest their feet on top of the foot ledge 140.

When the user is finished using the foot ledge 140 and would like to store the foot ledge 40, the user can kick or move the foot ledge 140 backward slightly toward the back side of the toilet 120, which activates a slow-close mechanism that automatically moves the foot ledge 140 backward along the rail mechanism 70, from the extended position 34 to the retracted position 32 relative to the toilet base 24 and the base structure 150, until the entire foot ledge 140 is positioned underneath the toilet base 24 and underneath the inner area 23 of the toilet base 24.

Once the foot ledge 140 is in the retracted position 32, the top of the foot ledge 140 is substantially concealed and positioned underneath the toilet base 24.

Various Alternative Embodiments of the Toilet

FIGS. 41-81 show a variety of alternative embodiments of a toilet with a foot ledge structure. The various features and components of the various toilets are similar to the toilet 20 shown in FIGS. 1-25 and the toilet 120 shown in FIGS. 26-40 and like numbers are used where applicable. However, some aspects of the configuration of the various toilets of FIGS. 41-81 differ from the toilet 20 shown in FIGS. 1-25 and the toilet 120 shown in FIGS. 26-40, as described further herein. The various features, components, and configurations of the various embodiments of FIGS. 41-81 can be used within the toilet 20 and/or the toilet 120 (and vice versa) and within the other embodiments shown in FIGS. 41-81.

Figure 41:
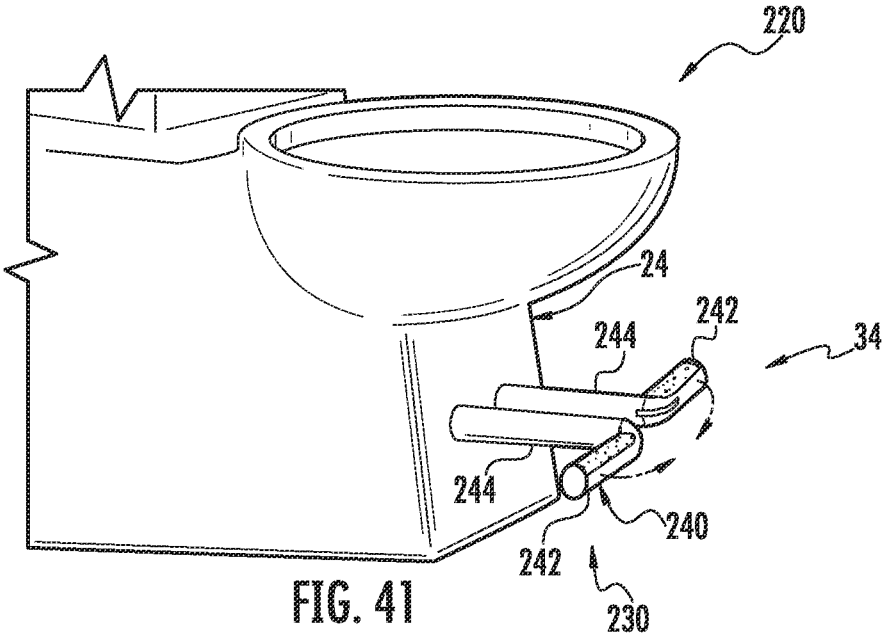
FIGS. 41-42 are perspective and partially transparent views of a toilet with a foot ledge structure according to another embodiment.
Figure 42:
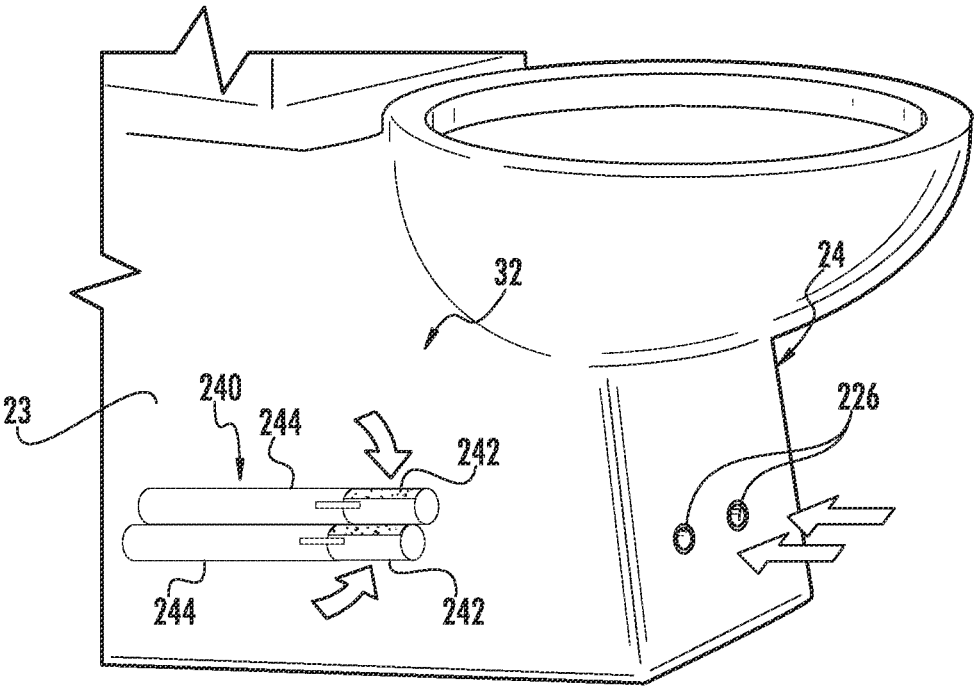

According to one embodiment as shown in FIGS. 41-42, a toilet 220 includes a foot ledge structure 230 with at least one foot ledge 240 that is completely retractable into the toilet base 24. For example, the foot ledge structure 230 may include two foot ledges 240 that each include a supporting extension 244 and a pivotable extension 242. The supporting extension 244 and the pivotable extension 242 are movably attached to each other and are congruently movable at least partially in and out of the toilet base 24, in particular the inner area 23 of the toilet base 24. The top surface of the pivotable extension 242 (and optionally at least a portion of the top surface of the supporting extension 244) may include a gripping material in order to prevent the user's feet from sliding off of the foot ledge 240.

When the foot ledge 240 is in a retracted position 32 (as shown in FIG. 42), the supporting extension 244 and the pivotable extension 242 are aligned with each other along their longitudinal axes in a straight line and are positioned completely within the inner area 23 of the toilet base 24. In order to move from the retracted position 32 into the extended position 34 (as shown in FIG. 41), the entire pivotable extension 242 and at least a portion of the supporting extension 244 within each of the respective foot ledges 240 are moved straight through a respective opening 226 of the toilet base 24 (where the openings 226 extend completely through the front wall of the toilet base 24). Since the supporting extension 244 and the pivotable extension 242 are aligned with each other in a straight line, each of the foot ledges 240 can move easily straight through each of the openings 226, and the openings 226 only have to be large enough to fit the cross-sectional areas (along the height and width) of each of the supporting extension 244 and the pivotable extension 242. Once the foot ledge 240 is in the extended position 34 (as shown in FIG. 41) or once the entire pivotable extension 242 is moved through the opening 226, the pivotable extensions 242 in each of the foot ledges 240 pivots outward horizontally (i.e., away from the other foot ledge 240) by approximately 90° about a substantially vertical axis relative to the supporting extension 244 in order to provide an area for the user to rest their feet on. In order to move back into the retracted position 32, each of the pivotable extensions 242 pivots back inward horizontally (toward a horizontal center line of the toilet 220) such that the supporting extension 244 and the pivotable extension 242 are aligned again with each other along their longitudinal axes in a straight line in order to move backward back through the openings 226.

Figure 43:
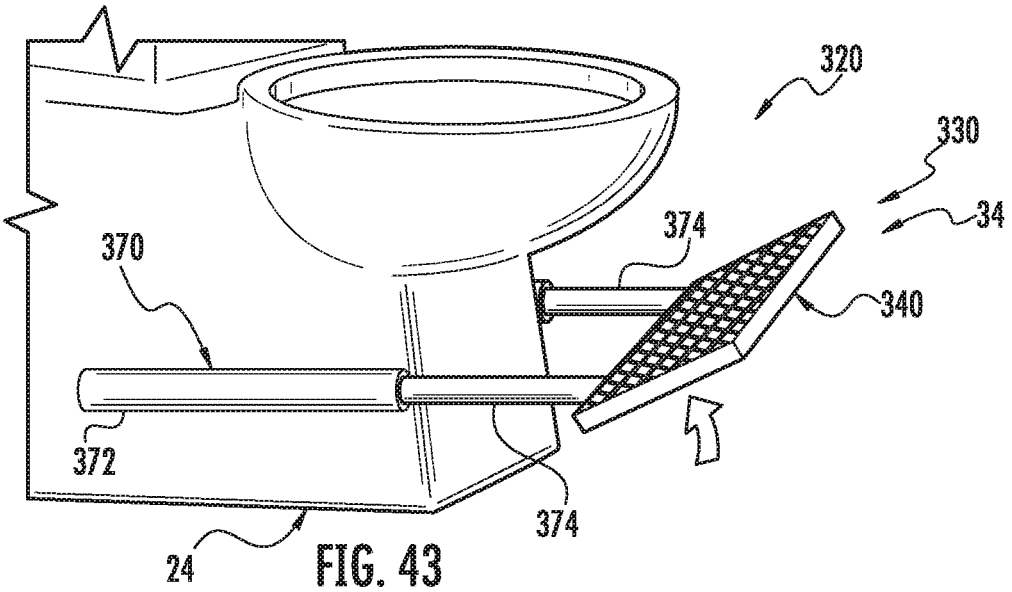
FIGS. 43-44 are perspective views of a toilet with a foot ledge structure according to another embodiment.
Figure 44:
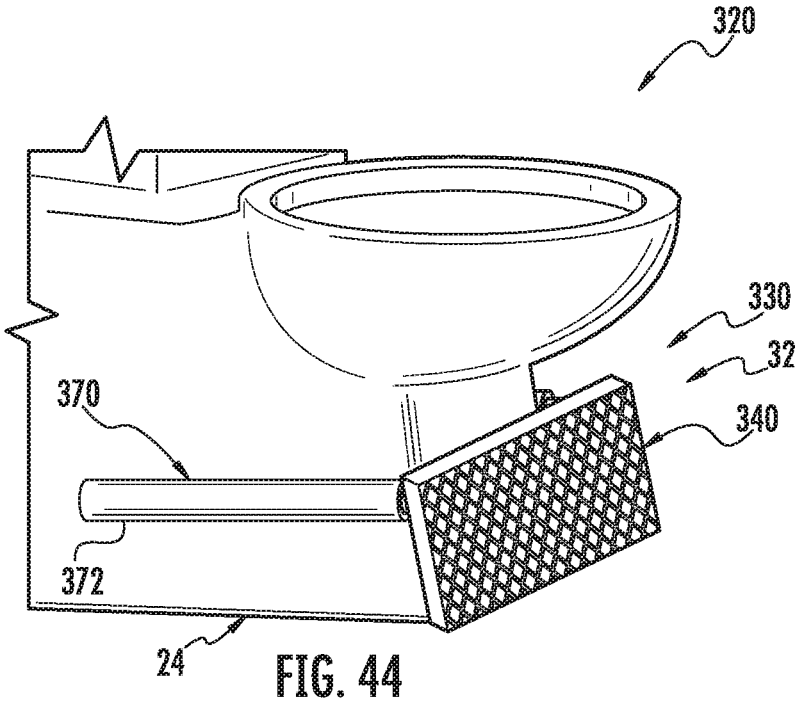

According to another embodiment as shown in FIGS. 43-44, a toilet 320 includes a foot ledge structure 330 with a foot ledge 340 and a rail mechanism 370. The rail mechanism 370 includes two sets of rail structures (positioned along opposite sides of the toilet base 24) that each include a supporting rail 372 and an extendable rail 374. The supporting rail 372 is statically attached to the toilet base 24 and extends along the side walls of the toilet base 24. According to one embodiment, the supporting rail 372 extends along the outer surfaces of the side walls. However, it is understood that the supporting rail 372 may extend along the inner surfaces of the side walls of the toilet base 24, within the inner area 23 of the toilet base 24. A back end of the extendable rail 374 is movably attached to the supporting rail 372 and allows the extendable rail 374 to extend from or retract into (and/or over) the supporting rail 372 in order to move the foot ledge 340 between the retracted position 32 and the extended position 34. A back edge of the foot ledge 340 is pivotally attached to the front end of the extendable rail 374. The foot ledge structure 330 can be retrofitted to a variety of different types and sizes of toilets, according to the desired configuration.

In the retracted position 32 (as shown in FIG. 44), the extendable rail 374 is retracted into (and/or over) the supporting rail 372 in order to bring the back edge of the foot ledge 340 as close to the front of the toilet base 24 as possible. Additionally, the foot ledge 340 is pivoted downward relative to the extendable rail 374 such that the front edge of the foot ledge 340 is closest to the floor (relative to the back edge of the foot ledge 340), which minimizes how much room the foot ledge 340 takes up within the bathroom.

In order to move from the retracted position 32 into the extended position 34 (as shown in FIG. 43), the extendable rail 374 is moved forward away or partially out from the supporting rail 372 and away from the toilet base 24, and the foot ledge 340 is pivoted upward about a horizontal axis relative to (and about its connection to) the extendable rail 374, thereby conveniently positioning the foot ledge 340 in front of the toilet base 24 for the user to rest their feet on. In the extended position 34, the front edge of the foot ledge 340 may be positioned above the back edge of the foot ledge 340 in order to provide a comfortable, upward angled surface (relative to the extendable rail 374 and the floor) for the user to rest their feet on. In order to move the foot ledge 340 back to the retracted position 32, the opposite movements are followed.

Figure 45:
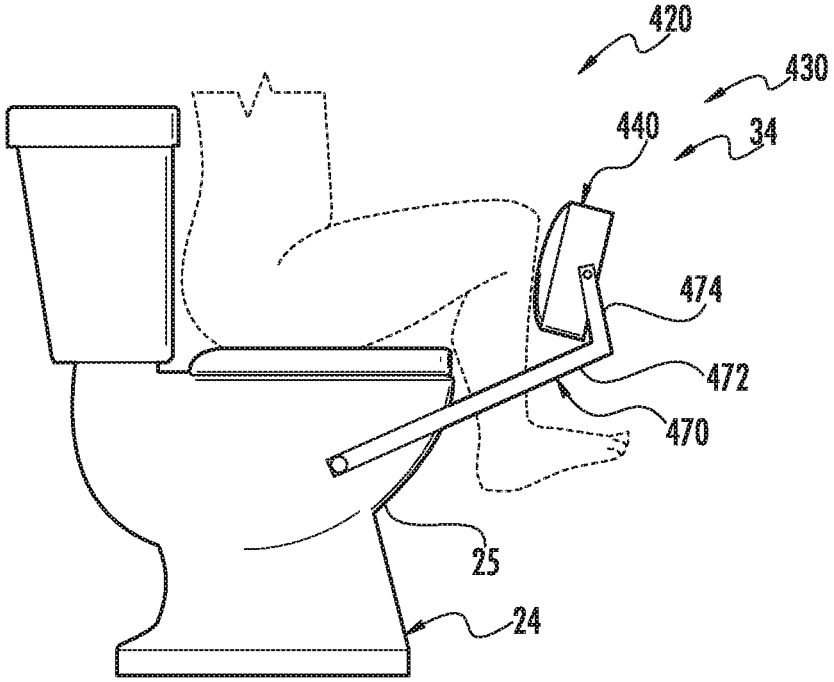
FIGS. 45-46 are side views of a toilet with a knee rest structure according to another embodiment.
Figure 46:
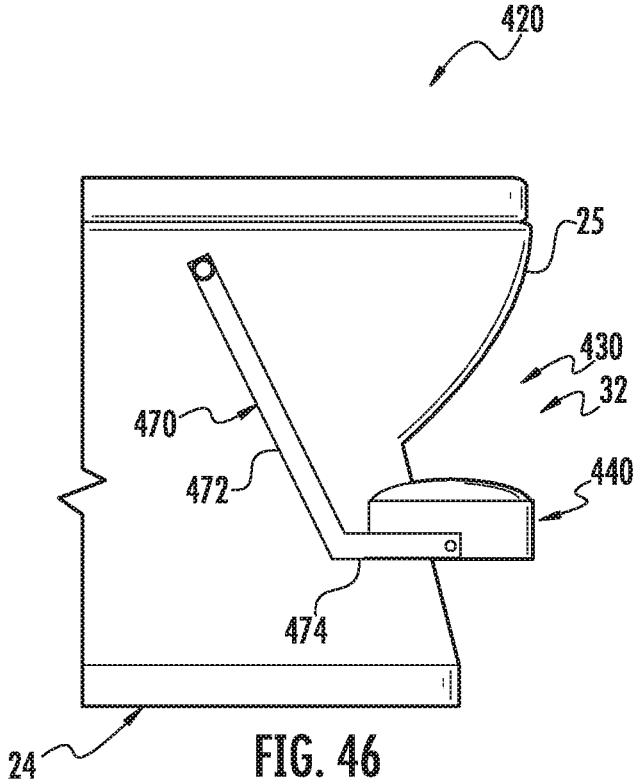

According to another embodiment as shown in FIGS. 45-46, a toilet 420 includes a knee rest structure 430 with a knee rest 440 and a rail mechanism 470. The rail mechanism 470 includes two sets of rails structures (positioned along opposite sides of the toilet base 24 and opposite sides of the knee rest 440) that each include a supporting rail 472 and an angled rail 474. A back end of the supporting rail 472 is pivotably attached to opposite sides of the toilet base 24 along an upper region of the toilet base 24, such as along the outside of the toilet bowl 25. A back end of angled rail 474 extends from and is statically attached to the front end of the supporting rail 472. The angled rail 474 is angled at approximately 90° (or optionally more) relative to the supporting rail 472. A front end of each of the angled rails 474 is pivotably attached to opposite sides of the knee rest 440 such that the knee rest 440 can rotate about a horizontal axis relative to the rail mechanism 470. A top surface of the knee rest 440 may optionally include a cushion (that directly contacts the user's knees or legs when in use, as shown in FIG. 45) in order to increase the comfort of the knee rest 440.

In the retracted (or lowered) position 32 (as shown in FIG. 46), the supporting rails 472 are rotated downward relative to the toilet base 24 such that the angled rails 474 and the knee rest 440 are positioned relatively close to the floor and below the toilet bowl 25. In order to move the knee rest 440 into the extended (or raised) position 34 (as shown in FIG. 45), the supporting rails 472 are rotated upward about a horizontal axis relative to the toilet base 24 and over a portion of the user's feet and legs such that at least a portion of the angled rail 474 and the knee rest 440 are above the top of the toilet base 24 (and above the top of the toilet seat), and the knee rest 440 is in line with the user's knees. The knee rest 440 is rotated such that the top surface of the knee rest 440 is positioned along or just below the user's knees, which provides an area for the user to rest their knees or legs along while in a relatively raised position. Due to the tension between the user's knees moving downward (and therefore outward) and the attachment of the supporting rail 472 to the toilet base 24, the user's knees are kept in the raised position due to the knee rest structure 430 (i.e., the user's thighs are at least partially elevated off of the toilet seat and the user's knees are above the user's hips). In order to move the knee rest 440 back to the retracted position 32, the opposite movements are followed.

Figure 47:
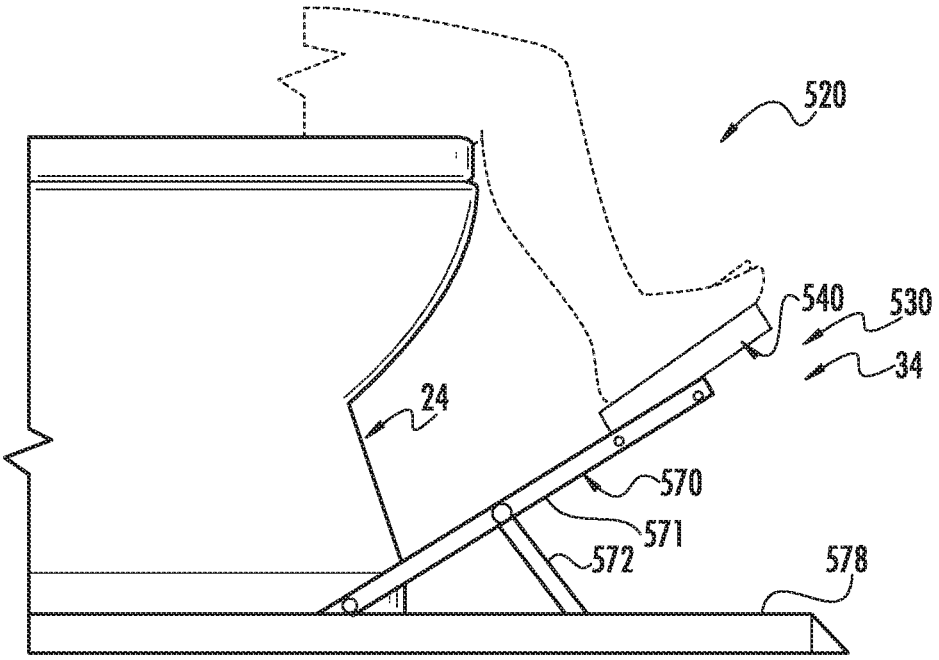
FIG. 47 and FIGS. 48-49 are side and perspective views, respectively, of a toilet with a foot ledge structure according to another embodiment.
Figure 48:
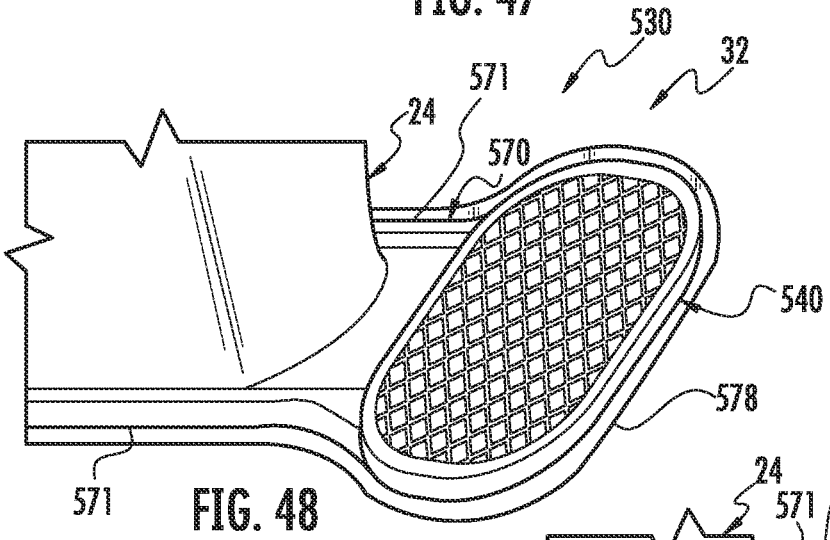
Figure 49:
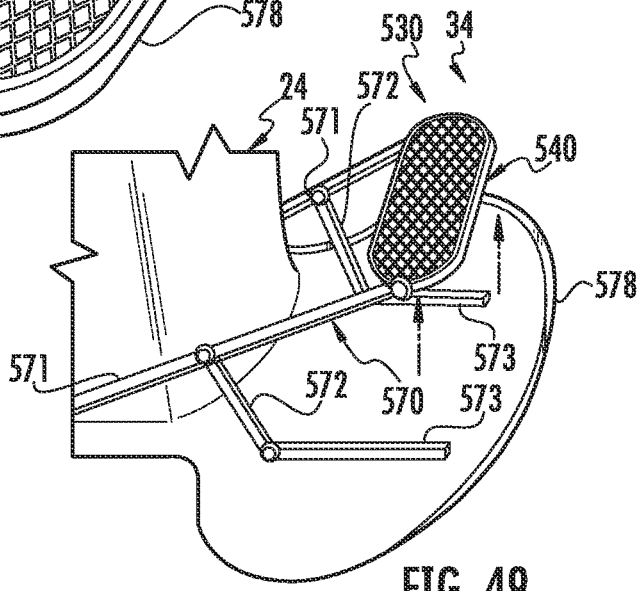

According to another embodiment as shown in FIGS. 47-49, a toilet 520 includes a foot ledge structure 530 with a foot ledge 540 and a rail mechanism 570. The rail mechanism 570 includes two sets of rail structures (positioned along opposite sides of the toilet base 24) that each include a first rail 571 and a second rail 572. The rail mechanism 570 may also include a third rail 573 that extends horizontally from the end of the second rail 572 along the floor for additional support (as shown in FIG. 49). Additionally, the foot ledge structure 530 may include a recessed area 578 (that may be defined by a bar, for example) positioned at least partially in front of the toilet base 24 for the foot ledge 540 and the rail mechanism 570 to be positioned within in the retracted position 32.

A back end of the first rail 571 is rotatably attached to the floor at a position behind the front end of the toilet base 24 (i.e., between the front end and the back end of the toilet base 24). A front end of each of the first rails 571 is rotatably attached to opposite sides of the foot ledge 540 such that the foot ledge 540 can rotate relative to the first rail 571. A back end of the second rail 572 is rotatably attached to a middle section of the first rail 571, and a front end of the second rail 572 is movably or slidably attached to a portion of the floor in front of the front end of the toilet base 24 (however, the configuration of the second rail 572 may be reversed such that the back end of the second rail 572 is movable or slidable along the length of the first rail 571, and the front end of the second rail 572 is rotatably attached to a portion of the floor).

In the retracted (or lowered) position 32 (as shown in FIG. 48), the foot ledge 540 and the rail mechanism 570 are substantially flat along and parallel to the floor, and the foot ledge 540 is positioned in front of the front end of the toilet base 24. In order to move the foot ledge 540 into the extended (or raised) position 34 (as shown in FIGS. 47 and 49), the foot ledge 540 is moved upward, which raises the front end of the first rail 571 above the floor and angles the first rail 571 relative to the floor. In turn, the back end of the second rail 572 is also raised above the floor (beneath the first rail 571), which angles the second rail 572 in an opposite direction from the first rail 571, beneath the first rail 571. Accordingly, the first rail 571 can be propped up (and held up) by the second rail 572, and the second rail 572 provides a support for the first rail 571, thereby keeping the foot ledge 540 propped up above the floor in order to support the user's feet. The angle of the foot ledge 540 may be adjusted relative to the first rail 571 (and the rest of the toilet 520) according to the user's preference. In order to move the foot ledge 540 back to the retracted position 32, the opposite movements are followed.

Figure 51:
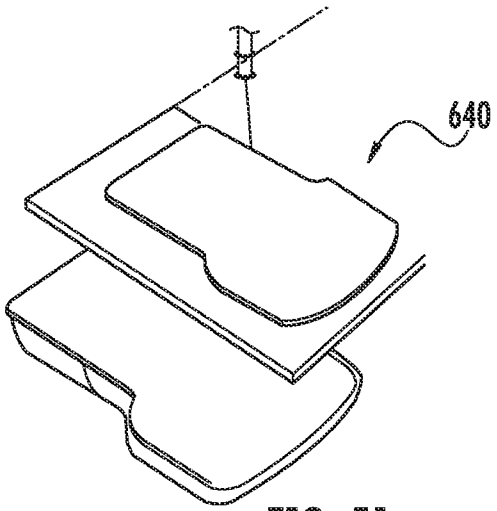
FIGS. 51-52 are perspective views of a foot ledge of the foot ledge structure of FIG. 50.
Figure 52:
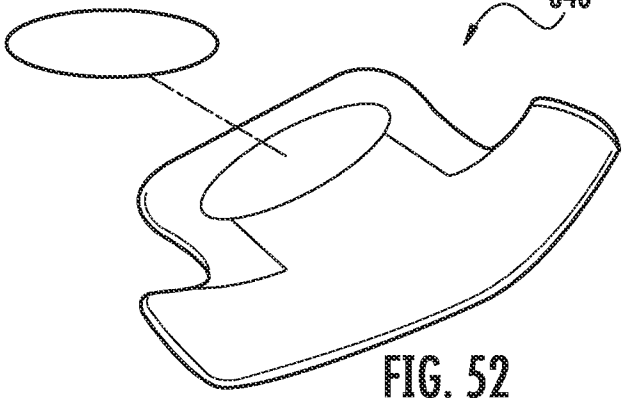
Figure 50:
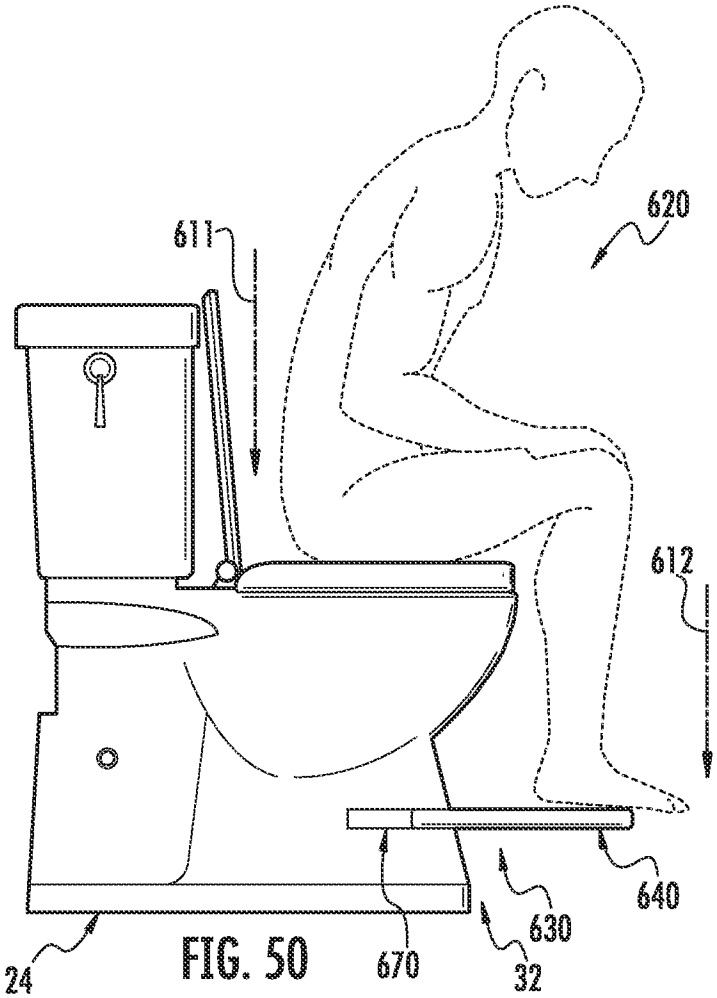
FIG. 50 is a side view of a toilet with a foot ledge structure according to another embodiment.
Figure 54:
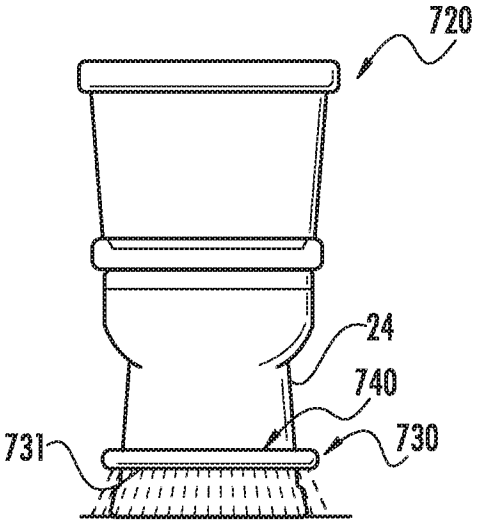
FIG. 53 and FIGS. 54-56 are perspective and front views, respectively, of a toilet with a foot ledge structure according to another embodiment.

According to another embodiment as shown in FIGS. 50-52, a toilet 620 includes a foot ledge structure 630 with a foot ledge 640 and a rail mechanism 670. As shown in FIG. 50, the weight of the user is distributed to two different areas of the toilet 620. In particular, the weight of the user directly from the user's torso is exerted onto the toilet base 24 as a downward force 611. The weight of the user directly from the user's legs and feet is exerted onto the foot ledge structure 630 as a downward force 612. The foot ledge structure 630 is configured to be able to support a wide range of different forces from the user in order to properly and fully support the user's feet and legs. As shown in FIGS. 51-52, the foot ledge 640 may have a variety of different configurations and may be reinforced in particular areas in order to withstand the various force, in particular from the weight of the user's feet and legs.

According to another embodiment as shown in FIGS. 53-56, a toilet 720 includes a foot ledge structure 730 with a foot ledge 740. The foot ledge 740 may include lights 731 (e.g., LEDs) positioned along the bottom surface and/or edges of the foot ledge 740 in order to illuminate the floor. The foot ledge 740 may optionally be statically attached to the front end of the toilet base 24.

Figure 56:
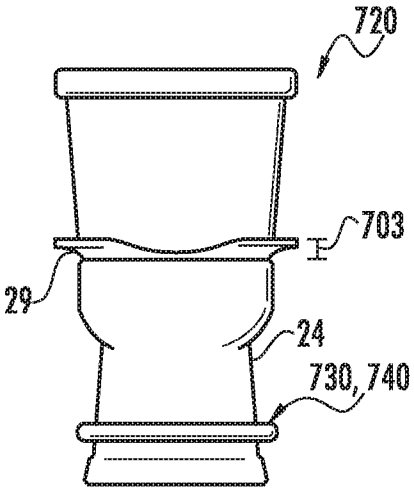
Figure 55:
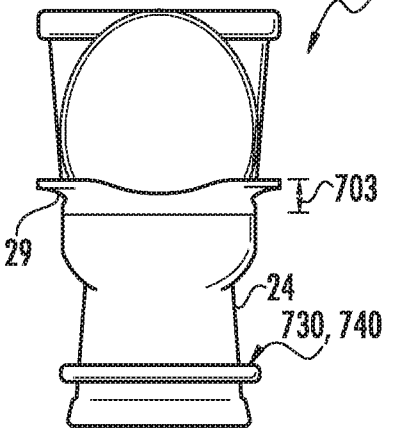
Figure 53:
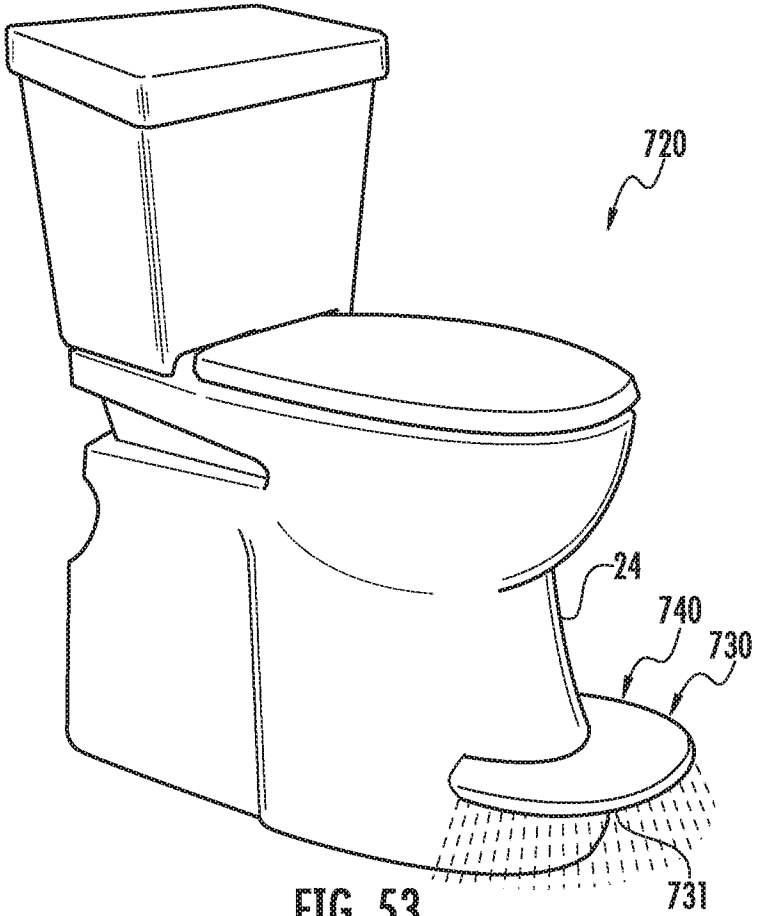

As shown in FIGS. 55-56, the foot ledge structure 730 can be used with toilets 720 with a variety of different heights according to the user's needs. For example, as shown in FIG. 55, the height 703 of the seat 29 of the toilet 720 is approximately two inches. As shown in FIG. 56, the height 703 of the seat 29 of the toilet 720 is approximately one inch. The foot ledge structure 730 can be configured to work with a variety of different heights 703.

Figure 57:
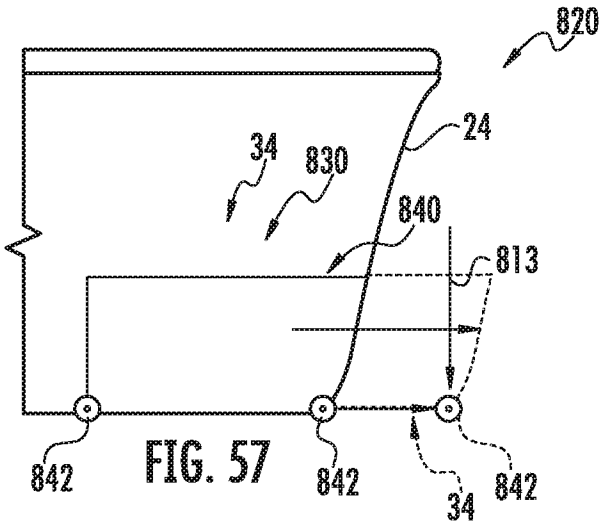
FIG. 57 is a side view of a toilet with a foot ledge structure according to another embodiment.

According to another embodiment as shown in FIG. 57, a toilet 820 includes a foot ledge structure 830 with a foot ledge 840 and wheels 842. The wheels 842 are positioned beneath the foot ledge 840 and allow the foot ledge 840 to move from within (and under) the toilet base 24 in the retracted position 32 to at least partially outside and in front of the toilet base 24 in the extended position 34. When the user exerts an additional downward force 813 on top of the foot ledge 840 while the foot ledge 840 is in the extended position 34, the force 813 is then transferred onto the front wheel 842. This force 813 may cause the wheel 842 to stop moving along the floor and maintain its position.

Figure 59:
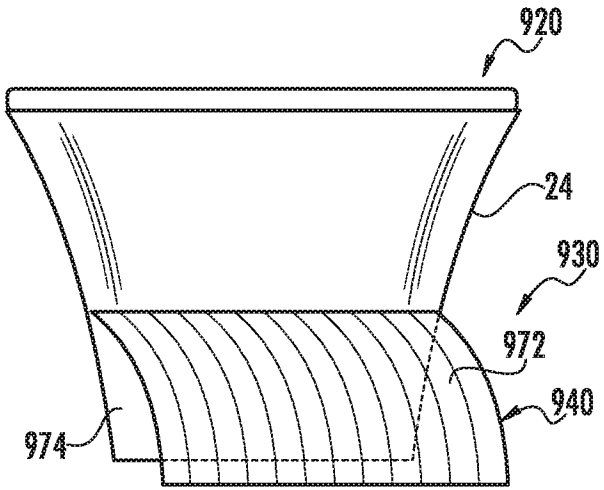
FIG. 58 and FIG. 59 are side and front, partially transparent views, respectively, of a toilet with a foot ledge structure according to another embodiment.
Figure 58:
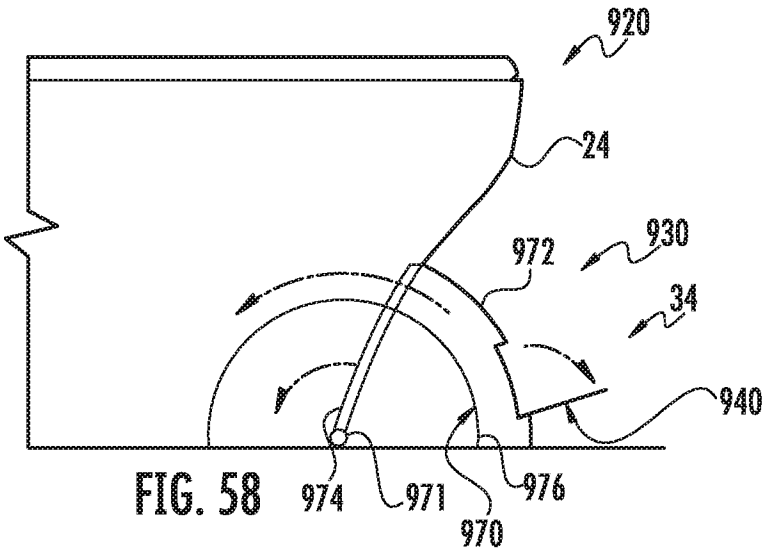

According to another embodiment as shown in FIGS. 58-59, a toilet 920 includes a foot ledge structure 930 with a foot ledge 940 and a rail mechanism 970. The rail mechanism 970 is pivotable about a horizontal pivot axis 971 in order to move the foot ledge 940 between the extended position 34 and the retracted position 32. The rail mechanism 970 has an arced or curved wall 972, a flat wall 974, and optionally a rail 976. A first end of the flat wall 974 is pivotably attached to the floor, and a second end of the flat wall 974 is statically attached to the curved wall 972. The lower, front region of the toilet base 24 has an opening that is complementary to the rail mechanism 970 (including a curved wall) such that the rail mechanism 970 can rotate in (or underneath) and out of the toilet base 24. The foot ledge 940 is pivotably attached to a middle or lower portion of the outer surface of the curved wall 972.

In the retracted position 32, the foot ledge 940 is substantially flush against and parallel to the curved wall 972, the curved wall 972 is positioned within and underneath the toilet base 24, and the flat wall 974 is positioned along the floor, within and underneath the toilet base 24. In order to move the foot ledge 940 from the retracted position 32 to the extended position 34, the flat wall 974 (with the curved wall 972) is pivoted about the horizontal pivot axis 971 (at the first end of the flat wall 974) to move the curved wall 972 from substantially within and under the toilet base 24 to substantially outside and in front of the toilet base 24. The front edge of the curved wall 972 can then rest on the floor for support. Once the rail mechanism 970 has been pivoted out from within the toilet base 24 (as shown in FIG. 59), the foot ledge 940 can then be pivoted downward from the curved wall 972 of the rail mechanism 70 into the extended position 34, such that the foot ledge 940 is approximately perpendicular to the curved wall 972 (as shown in FIG. 58). In order to move the foot ledge 940 back to the retracted position 32, the opposite movements are followed.

Figures 60, 61, 62, 63:
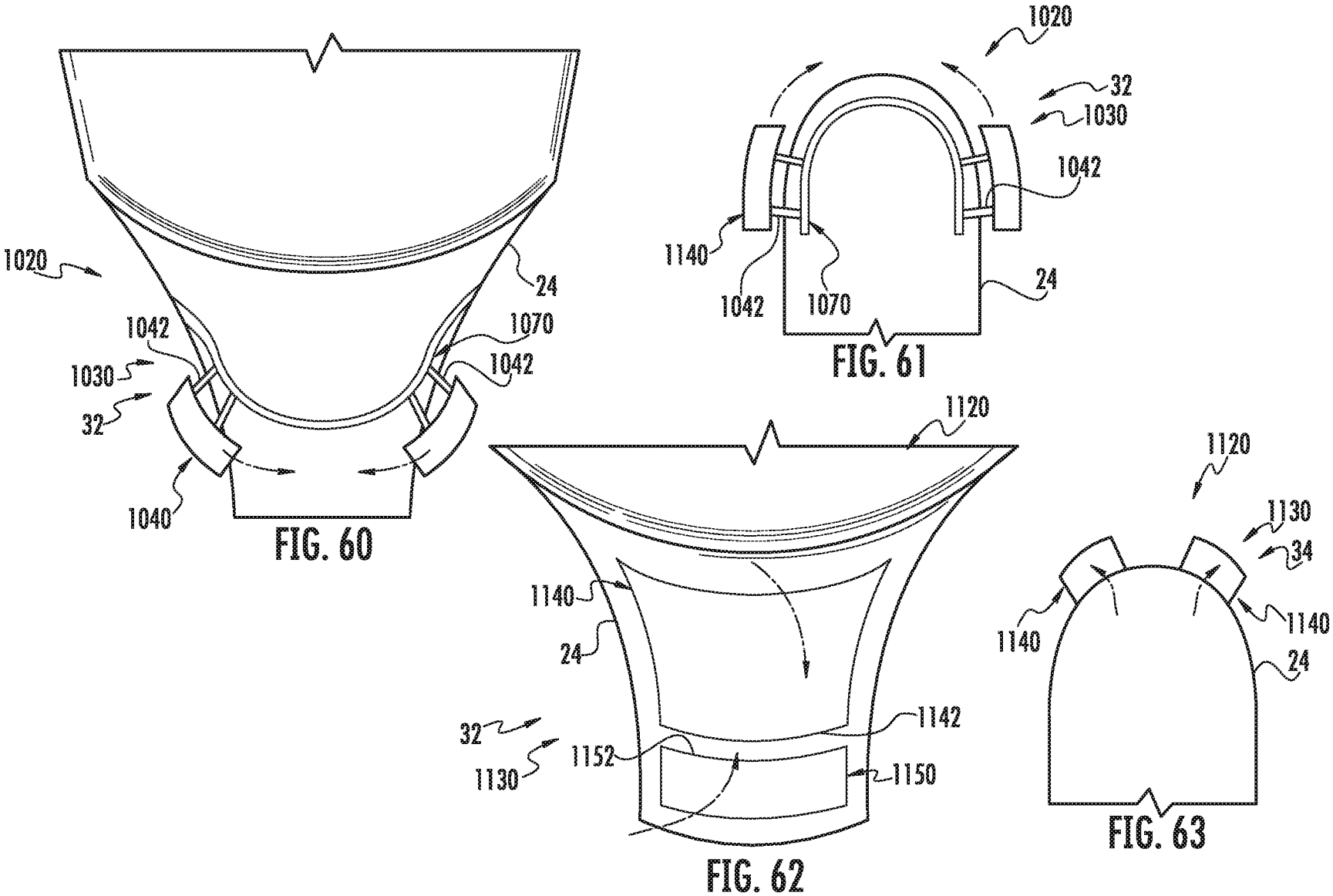
FIG. 60 and FIG. 61 are front, top perspective and top views, respectively, of a toilet with a foot ledge structure according to another embodiment.
FIG. 62 and FIG. 63 are front, top perspective and top views, respectively, of a toilet with a foot ledge structure according to another embodiment.

According to another embodiment as shown in FIGS. 60-61, a toilet 1020 includes a foot ledge structure 1030 with two foot ledges 1040 (for each foot) and a rail mechanism 1070. The rail mechanism 1070 extends substantially horizontally along the outer surface of the toilet base 24 around at least a portion of the side walls and the front wall of the toilet base 24 such that the foot ledges 1040 can be moved horizontally along the length of the rail mechanism 1070 along a portion of the outside of the toilet base 24. Each of the foot ledges 1040 are movably attached to the rail mechanism 1070 with at least one support or extension 1042 that extends between a back end of the foot ledges 1040 and a front side of the rail mechanism 1070, substantially perpendicular to the outer wall of the toilet base 24. The extensions 1042 are movable along the length of the rail mechanism 1070.

In the retracted position 32, the foot ledges 1040 are positioned along opposite side walls of the toilet base 24 in order to be positioned out of the way when not in use (as shown in FIGS. 60-61). In order to move from the retracted position 32 to the extended position 34, the foot ledges 1040 are each moved or slide along at least a portion of the length of the rail mechanism 1070 from the side walls of the toilet base 24 (relatively closer to the back of the toilet base 24) toward the front wall of the toilet base 24 (relatively closer to the front of the toilet base 24) in order to be accessible to the user sitting on the toilet 1020. In order to move the foot ledges 1040 back to the retracted position 32, the opposite movements are followed.

According to another embodiment as shown in FIGS. 62-63, a toilet 1120 includes a foot ledge structure 1130 with a foot ledge 1140 and a base structure 1150. A bottom edge of the foot ledge 1140 is movably or hingeably attached to the front wall of the toilet base 24 along a horizontal hinge 1142, and a top edge of the base structure 1150 is movably or hingeably attached to the front wall of the toilet base 24 along a horizontal hinge 1152. As shown in FIG. 62, the base structure 1150 is positioned beneath (and vertically spaced apart from) the foot ledge 1140 (i.e., closer to the floor) along the front wall of the toilet base 24. The foot ledge structure 1130 may optionally have one foot ledge 1140 (to support both of the user's feet) with one corresponding base structure 1150 (as shown in FIG. 62). Alternatively, the foot ledge structure 1130 may have two foot ledges 1140 (each to support one of the user's feet) that are spaced apart from each other along the front wall of the toilet base 24 (as shown in FIG. 63), where each of the two foot ledges 1140 has a corresponding base structure 1150.

In the retracted position 32 (as shown in FIG. 62), the foot ledge 1140 folded upwards along the outer surface of the front wall of the toilet base 24, and the base structure 1150 is folded downwards along the outer surface of the front wall of the toilet base 24 such that the foot ledge 1140 and the base structure 1150 are substantially parallel to the front wall of the toilet base 24. In order to move from the retracted position 32 to the extended position 34, the foot ledge 1140 is folded downwards about the hinge 1142 (as shown in FIG. 63) such that the foot ledge 1140 is approximately perpendicular to the outer surface of the front wall, and the base structure 1150 is folded upwards about the hinge 1152 such that the base structure 1150 is at an angle to the front wall of the toilet base 24 and to the foot ledge 1140) attaches to and supports the bottom surface of the foot ledge 1140, which props the foot ledge 1140 up and keeps the foot ledge 1140 extended out from the outer surface of the front wall of the toilet base 24. In order to move the foot ledge 1140 back to the retracted position 32, the opposite movements are followed.

Figure 64:
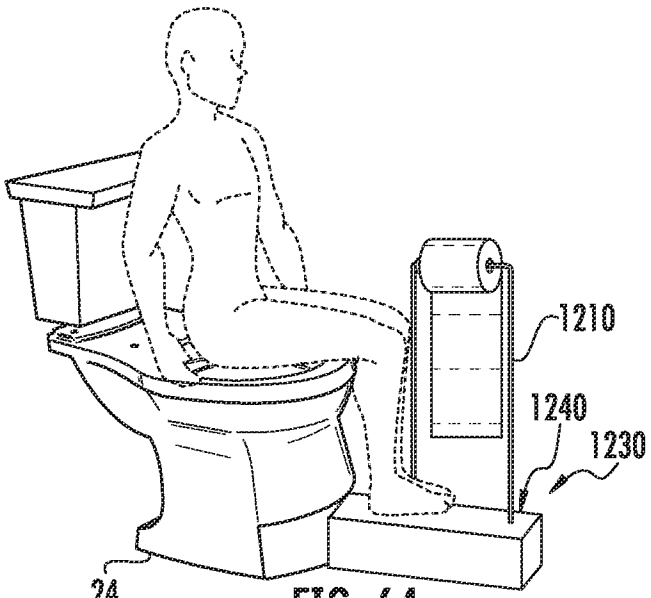
FIG. 64 is a side view of a toilet with a foot ledge structure according to another embodiment.

According to another embodiment as shown in FIG. 64, a toilet paper holder 1210 may include a foot ledge structure 1230 such that a foot ledge 1240 extends horizontally out from a lower portion of the toilet paper holder 1210. The toilet paper holder 1210 may be positioned directly next to or near the front of the toilet base 24 in order to conveniently position the foot ledge 1240 directly in front of the toilet base 24 for the user to rest their feet on.

In the retracted position 32, the foot ledge 1240 is retracted within the base of the toilet paper holder 1210. In order to move into the extended position 34, the foot ledge 1240 is moved out from within the toilet paper holder 1210 into a position vertically above the floor. In order to move the foot ledge 1240 back to the retracted position 32, the opposite movements are followed.

Figure 65:
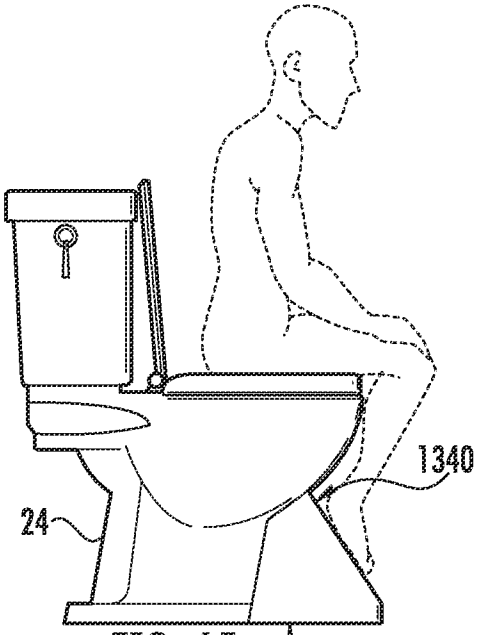
FIG. 65 is a side view of a toilet with a foot ledge structure according to another embodiment.

According to another embodiment as shown in FIG. 65, a foot ledge structure 1330 is integrated into the front wall of the toilet base 24. Accordingly, a foot ledge 1340 is an angled wall that is built into, integrated with, or attached to the front wall of the toilet base 24, which provides an area for the user to rest their feet on while seated on the toilet base 24. The base of the foot ledge structure 1330 is wider than and extends further to the front of the toilet than the top of the foot ledge structure 1330, thereby providing the angled wall of the foot ledge 1340.

Figure 68:
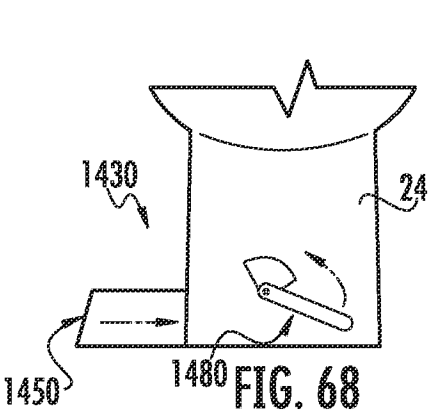
FIGS. 66-68 are side views of a toilet with a foot ledge structure according to another embodiment.
Figure 67:
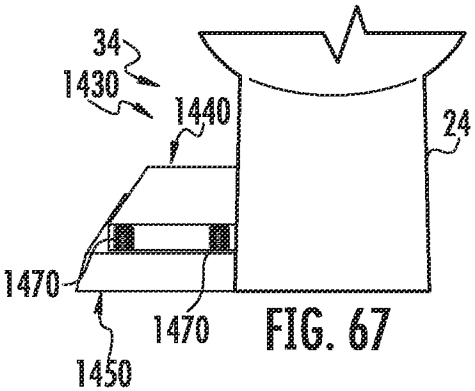
Figure 66:
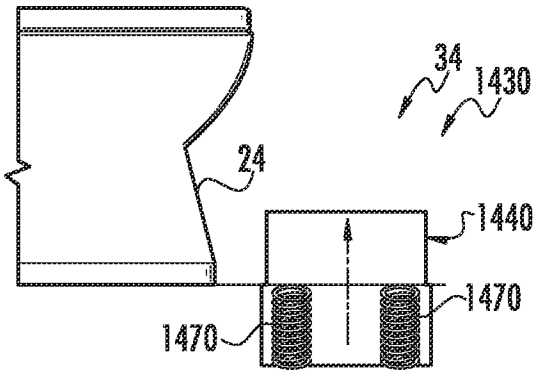

According to another embodiment as shown in FIGS. 66-68, a foot ledge structure 1430 is integrated into a portion of the floor that is directly in front of the toilet base 24 (as shown in FIG. 66) or integrated into a base structure 1450 (as shown in FIGS. 67-68). The base structure 1450 may be a component that is already elevated above the floor (and resting or positioned on top of the floor). The floor or the base structure 1450 includes a recessed area that is configured to house the foot ledge structure 1430 when in the retracted position 32. The foot ledge structure 1430 includes a foot ledge 1440 that is at least partially movable into and out from the floor or the base structure 1450. The foot ledge structure 1430 may include springs 1470 beneath the top wall of the foot ledge 1440 (and within the recessed area) that help move the foot ledge 1440 between the retracted position 32 and the extended position 34. For example, the springs 1470 may apply a force to the bottom surface of the top wall of the foot ledge 1440 in order to bias the foot ledge 1440 upward into the extended position 34.

In the retracted position 32, the foot ledge 1440 is substantially recessed within the floor or the base structure 1450 such that the top surface of the foot ledge 1440 is approximately level to the top surface of the floor or the base structure 1450, and the side walls of the foot ledge 1440 are recessed beneath the top surface of the floor or the base structure 1450. In order to move into the extended position 34, the foot ledge 1440 is unlocked (with, for example, an activating mechanism, such as latch 1480 as shown in FIG. 68), which allows the springs 1470 to expand, which moves the top wall of the foot ledge 1440 vertically upward relative to the floor or the base structure 1450 and above the top surface of the floor or the base structure 1450 into the extended position 34. The exact height of the foot ledge 1440 (above the floor or the base structure 1450) may be adjusted according to the user's preference. In order to move the foot ledge 1440 back to the retracted position 32, the opposite movements are followed (e.g., the foot ledge 1440 is pressed back into the recessed area of the floor or the base structure 1450, which compresses the springs 1470).

As shown in FIG. 68, the base structure 1450 may further be retracted into the toilet base 24 (by moving the latch 1480) once the foot ledge 1440 has been retracted into the base structure 1450. Alternatively, the foot ledge 1440 may not be movable relative to the base structure 1450, and the base structure 1450 may simply be move in and out of the toilet base 24 in order to move the foot ledge 1440 between the retracted position 32 and the extended position 34 relative to the toilet base 24.

Figure 69:
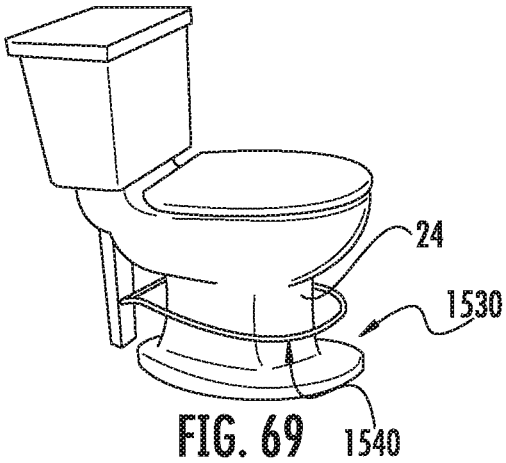
FIG. 69 is a view of a toilet with a foot ledge structure according to another embodiment.

According to another embodiment as shown in FIG. 69, a foot ledge structure 1530 includes a foot ledge 1540 that is a bar that extends horizontally around at least a portion of the outer perimeter of a lower region of the toilet base 24 in order to provide a variety of different areas for the user to rest and elevate their feet.

Figure 70:
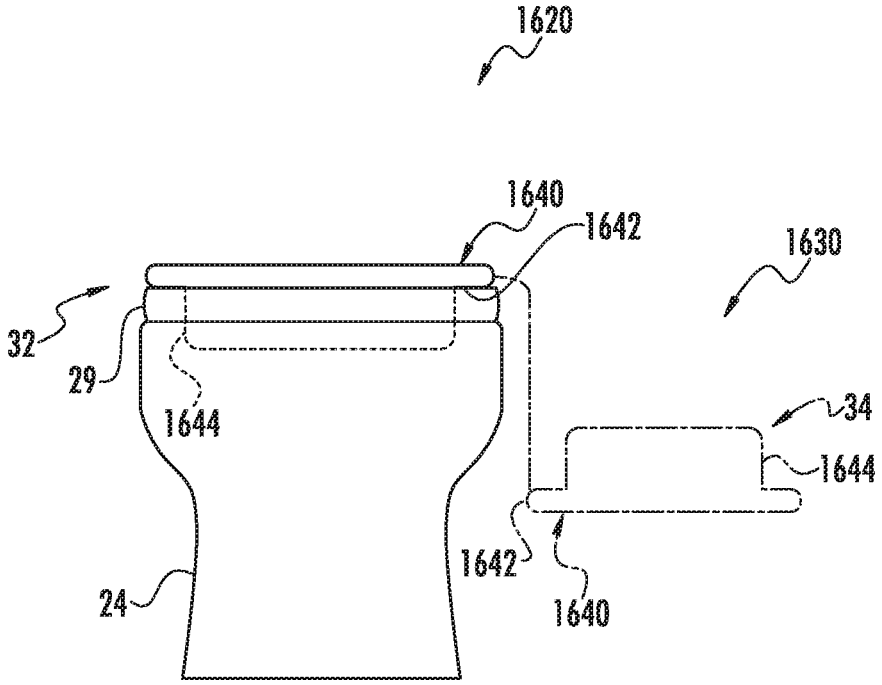
FIG. 70 is a side view of a toilet with a foot ledge structure according to another embodiment.

According to another embodiment as shown in FIG. 70, a toilet 1620 includes a foot ledge structure 1630 with a foot ledge 1640 that is a toilet lid or cover when in the retracted position 32 and a foot ledge when in the extended position 34. The foot ledge 1640 includes an outer lip 1642 and an inner extension 1644. The outer lip 1642 at least partially surrounds the inner extension 1644 and is thinner and wider than the inner extension 1644 in order to prevent the foot ledge 1640 from falling through the opening in the toilet seat 29 while in the retracted position 32. The inner extension 1644 is thicker and less wide than the outer lip 1642 in order to provide an elevated area for the user to place their feet on in the extended position 34 and in order to fit within the opening through the toilet seat 29 while in the retracted position 32.

In the retracted position 32 (i.e., when the foot ledge 1640 is being used as a toilet lid), the foot ledge 1640 is positioned on top of the seat 29 (which is on top of the toilet base 24) such that the outer lip 1642 extends along at least a portion of the top surface of the seat 29 and the inner extension 1644 extends at least partially through the opening in the seat 29, into or toward the bowl of the toilet base 24. In this position, the inner extension 1644 extends below the outer lip 1642. In order to move into the extended position 34 (i.e., when the foot ledge 1640 is positioned to support the user's feet), the foot ledge 1640 is rotated or flipped over and positioned next to the toilet base 24 (such that the inner extension 1644 extends above the outer lip 1642) at a height that is below the seat 29 and is supported by a hinge or rope, for example. Accordingly, the user can rest their feet along the top surface of the inner extension 1644. In order to move the foot ledge 1640 back to the retracted position 32, the opposite movements are followed.

According to another embodiment as shown in FIGS. 71-74, a toilet 1720 includes a foot ledge structure 1730 with a foot ledge 1740. The foot ledge 1740 includes a bar structure 1742 that extends around a portion of each of the side walls of the toilet base 24 and along the front wall of the toilet base 24. The bar structure 1742 pivotably attaches to opposite sides walls of the toilet base 24.

Figure 71:
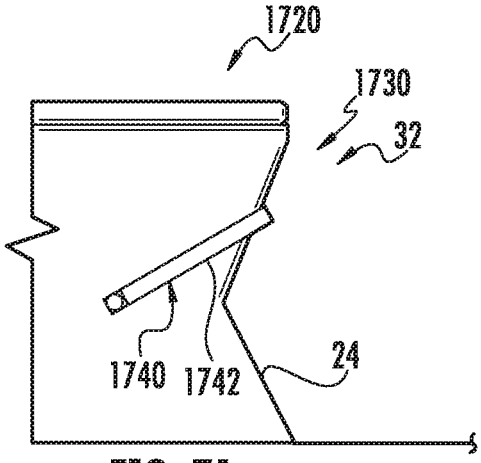
FIGS. 71-74 are side views of a toilet with a foot ledge structure according to another embodiment.
Figure 72:
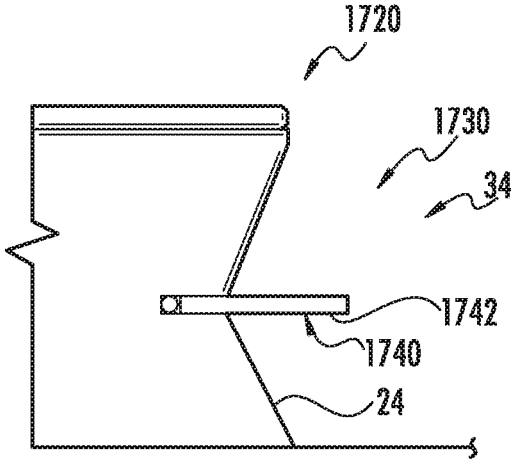

In the retracted position 32 (as shown in FIG. 71), the bar structure 1742 may be pivoted upward such that a front edge of the bar structure 1742 (that extends between the two side walls of the toilet base 24) is substantially flush against or near the front wall of the toilet base 24. In order to move the foot ledge 1740 to the extended position 34 (as shown in FIG. 72), the bar structure 1742 may be pivoted downward (about its attachment points to the toilet base 24) such that the front edge of the bar structure 1742 is moved away from the front wall of the toilet base 24. In the extended position 34, the bar structure 1742 may be approximately horizontal and parallel to the floor (and therefore substantially perpendicular to the toilet base 24). In order to move the foot ledge 1740 back to the retracted position 32, the opposite movements are followed.

Figure 73:
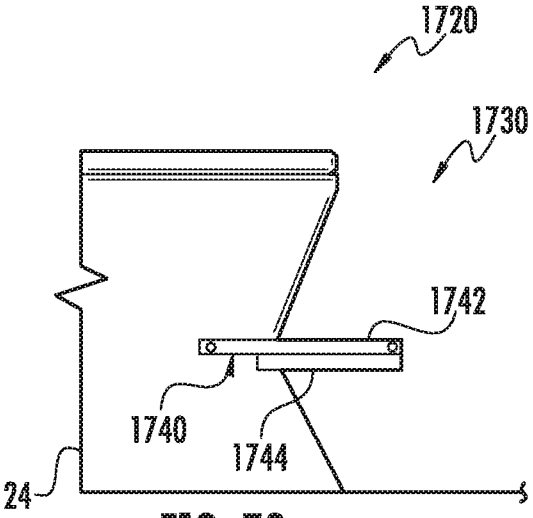
Figure 74:
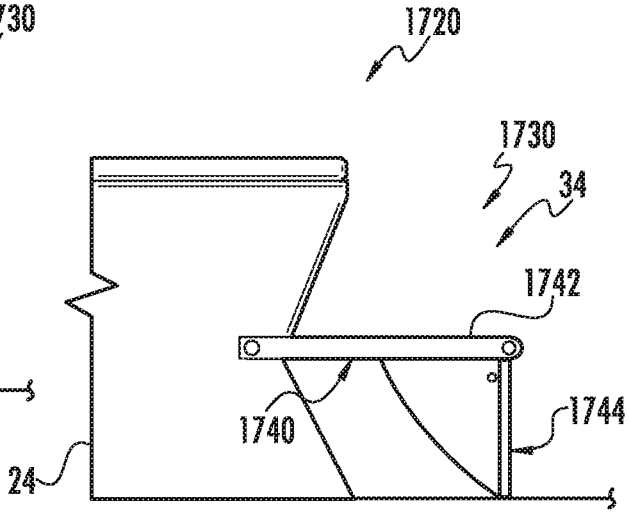

As shown in FIGS. 73-74, the foot ledge 1740 may optionally further include a lower support 1744 that helps support the foot ledge 1740 while in the extended position 34. A first end of the lower support 1744 is pivotably attached to the front edge of the bar structure 1742. When not in use or needed, the lower support 1744 may be folded up next to (and beneath) and substantially parallel to the bar structure 1742 (regardless of the position of the bar structure 1742). When extra support is needed in the extended position 34, the lower support 1744 is pivoted about its first end, relative to the bar structure 1742, such that the lower support 1744 is substantially perpendicular to the bar structure 1742 and a second end of the lower support 1744 can rest directly on the floor, thereby supporting the bar structure 1742 (and the foot ledge 1740).

Figure 75:
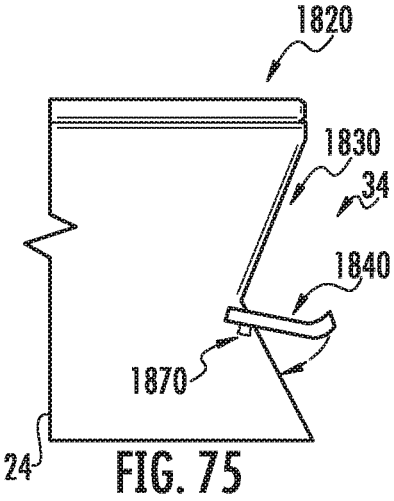
FIGS. 75-76 are side views of a toilet with a foot ledge structure according to another embodiment.
Figure 76:
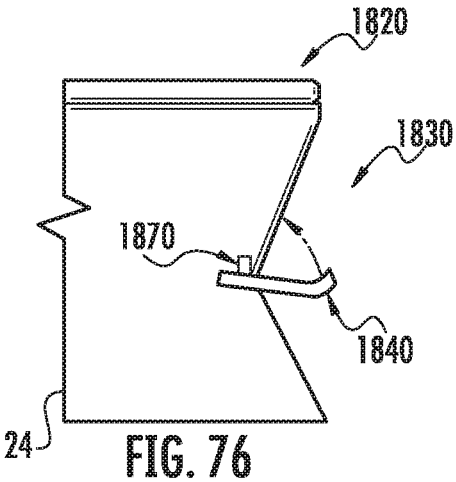

According to another embodiment as shown in FIGS. 75-76, a toilet 1820 includes a foot ledge structure 1830 with a foot ledge 1840 and a locking mechanism 1870. The foot ledge 1840 is rotatably attached to a middle portion of opposite sides of the toilet base 24. In the extended position 34, the foot ledge 1840 extends out in front of the front wall of the toilet base 24 in order to provide an area for the user to rest their feet. Depending on which directly the foot ledge 1840 is movable (e.g., pivotable upward or downward relative to the toilet base 24), the locking mechanism 1870 is positioned above and/or below the attachment point of the foot ledge 1840 to the toilet base 24 and is configured to lock the foot ledge 1840 into the extended position 34 in order to prevent the foot ledge 1840 from moving (back to the retracted position 32, for example) during use. The locking mechanism 1870 can be unlocked in order to move or rotate the foot ledge 1840 from the extended position 34 back to the retracted position 32.

Figure 77:
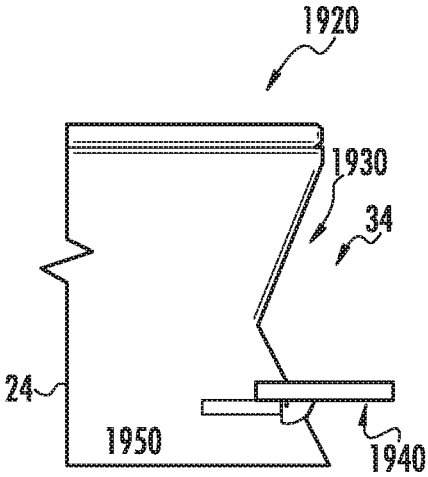
FIGS. 77-78 are side views of a toilet with a foot ledge structure according to another embodiment.
Figure 78:
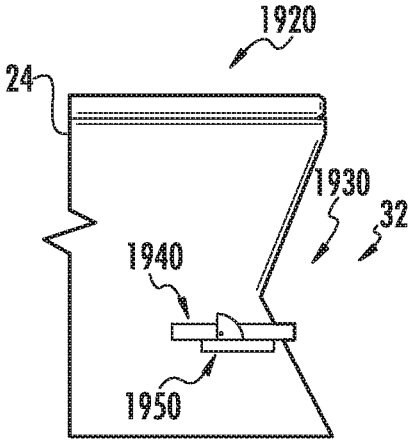

According to another embodiment as shown in FIGS. 77-78, a toilet 1920 includes a foot ledge structure 1930 with a foot ledge 1940 and a base structure 1950. The base structure 1950 is statically attached to a middle portion of opposite sides of the toilet base 24. A first end of the foot ledge 1940 is rotatably attached to either the base structure 1950 or directly to a middle portion of the opposite sides of the toilet base 24 and is positioned directly above the base structure 1950.

In the extended position 34 (as shown in FIG. 77), the foot ledge 1940 extends out in front of the front wall of the toilet base 24 (substantially parallel to the floor and perpendicular to the toilet base 24) such that the user can rest their feet on the top surface of the foot ledge 1940. The base structure 1950 is positioned directly beneath the first end of the foot ledge 1940 in the extended position 34. In order to move the foot ledge 1940 to the retracted position (as shown in FIG. 78), the foot ledge 1940 is rotated upward and back toward the front wall of the toilet base 24 (approximately 180°) until the top surface of the foot ledge 1940 is resting on and being supported by the top surface of the base structure 1950 (also substantially parallel to the floor and perpendicular to the toilet base 24). In order to move the foot ledge 1940 back to the extended position 34, the opposite movements are followed.

Figure 79:
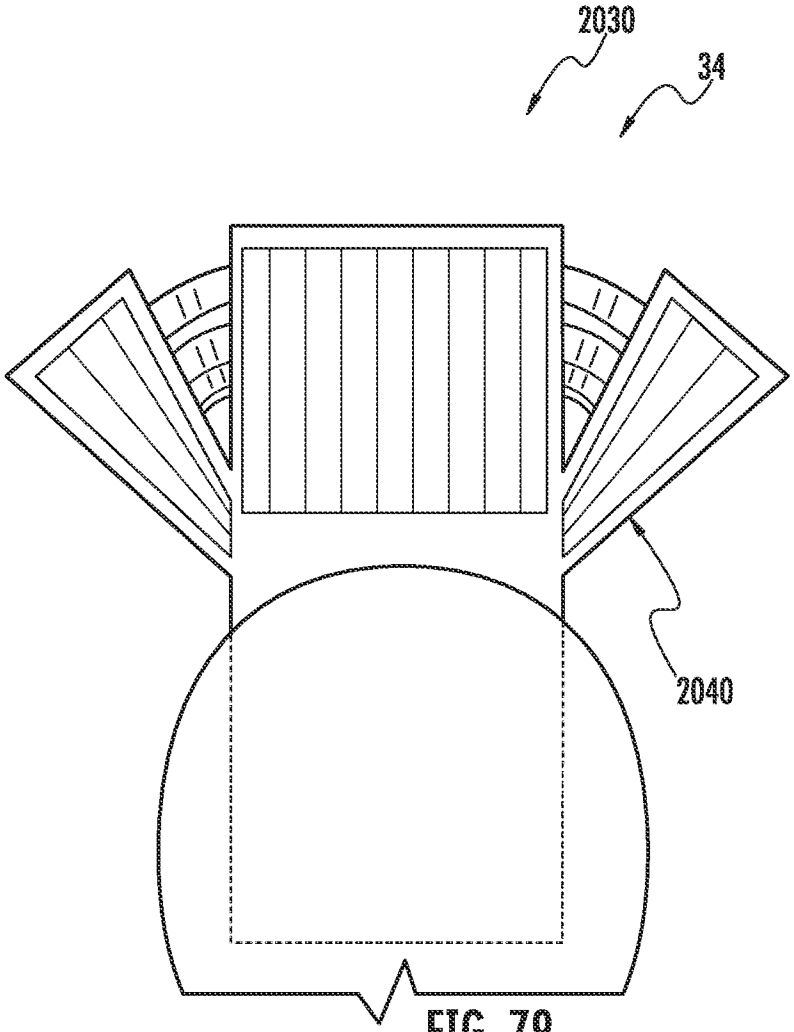
FIG. 79 is a top view of a foot ledge structure according to another embodiment.

According to another embodiment as shown in FIG. 79, a foot ledge structure 2030 has a foot ledge 2040 that is configured to splay or expand outward along its width when in the extended position 34 in order to provide a relatively wider foot rest while that still fits within the toilet base 24. In order to move into the retracted position 32, the foot ledge 2040 contracts along its width in order to fit within the toilet base 24.

Figure 80:
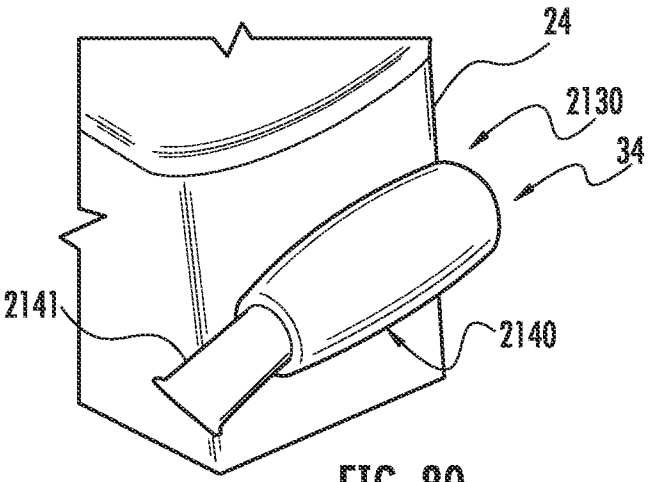
FIG. 80 is a perspective view of a foot ledge structure according to another embodiment.

According to another embodiment as shown in FIG. 80, a foot ledge structure 2130 includes a foot ledge 2140 that includes at least one retractable extension 2141 (e.g., an "I lip"). The extension 2141 may extend out from a side of the foot ledge 2140 (in the extended position 34) in order to provide additional area for the user to rest their feet on, but is retractable into an inner area of (or directly under a bottom surface of) the foot ledge 2140 (in the retracted position 32) in order to minimize how much space the foot ledge structure 2130 takes up when not in use.

Figure 81:
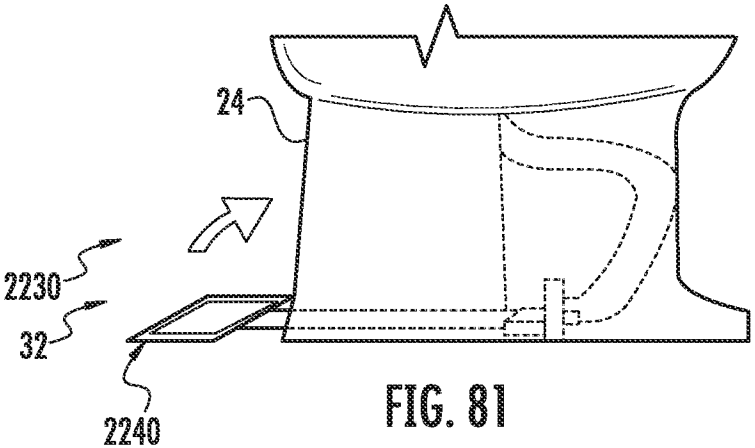
FIG. 81 is a side view of a toilet with a foot ledge structure according to another embodiment.

According to another embodiment as shown in FIG. 81, a foot ledge structure 2230 includes a foot ledge 2240 that is positioned in front of the toilet base 24. In the retracted position 32, the foot ledge 2240 is substantially flat against the floor. In order to move into the extended position 34, the front edge of the foot ledge 2240 is rotated upward about the back edge of the foot ledge 2240 in order to provide an elevated area for the user to rest their feet on. The foot ledge 2240 may be ratcheted in order to be secured at multiple different angles according to the user's preference.

Figures 82, 83, 84, 85:
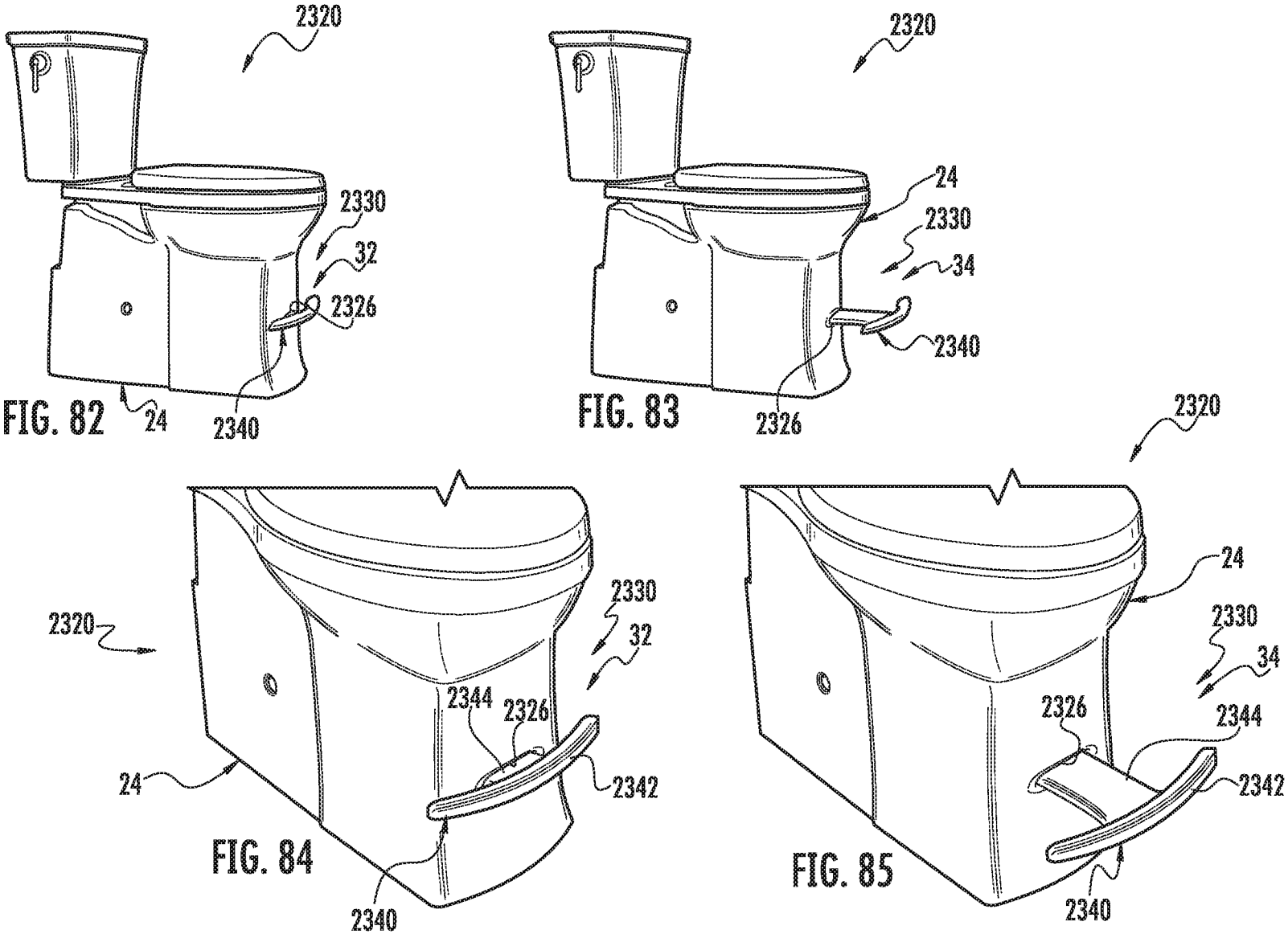
FIG. 82 is a side view of a toilet with a foot ledge structure in a retracted position according to another embodiment.
FIG. 83 is a side view of the toilet of FIG. 81 with the foot ledge structure in an extended position.
FIG. 84 is a perspective view of the toilet of FIG. 81 with the foot ledge structure in the retracted position.
FIG. 85 is a perspective view of the toilet of FIG. 81 with the foot ledge structure in the extended position.
Figure 86:
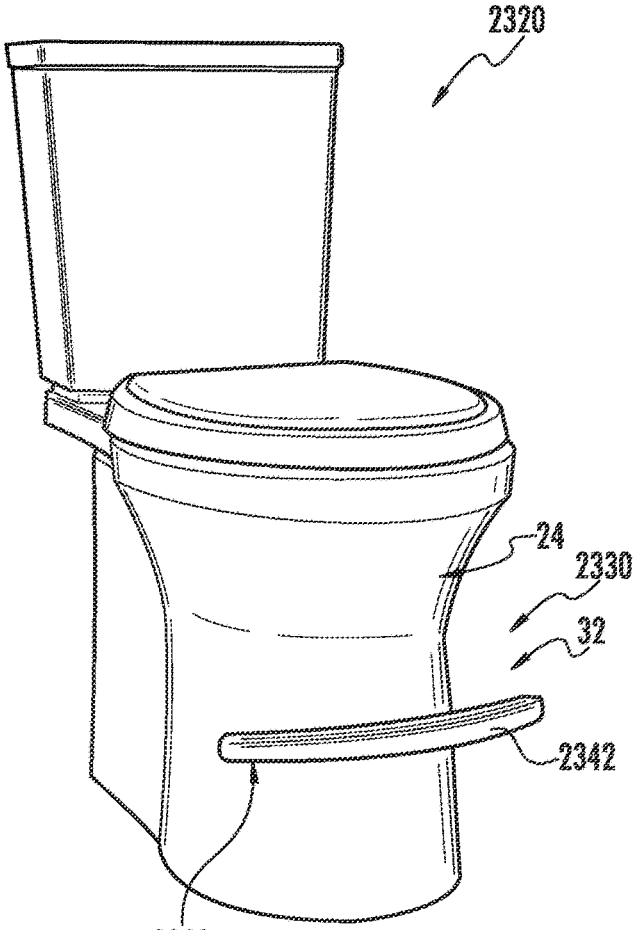
FIG. 86 is a front view of a toilet according to another embodiment of the foot ledge structure of FIG. 81.
Figure 87:
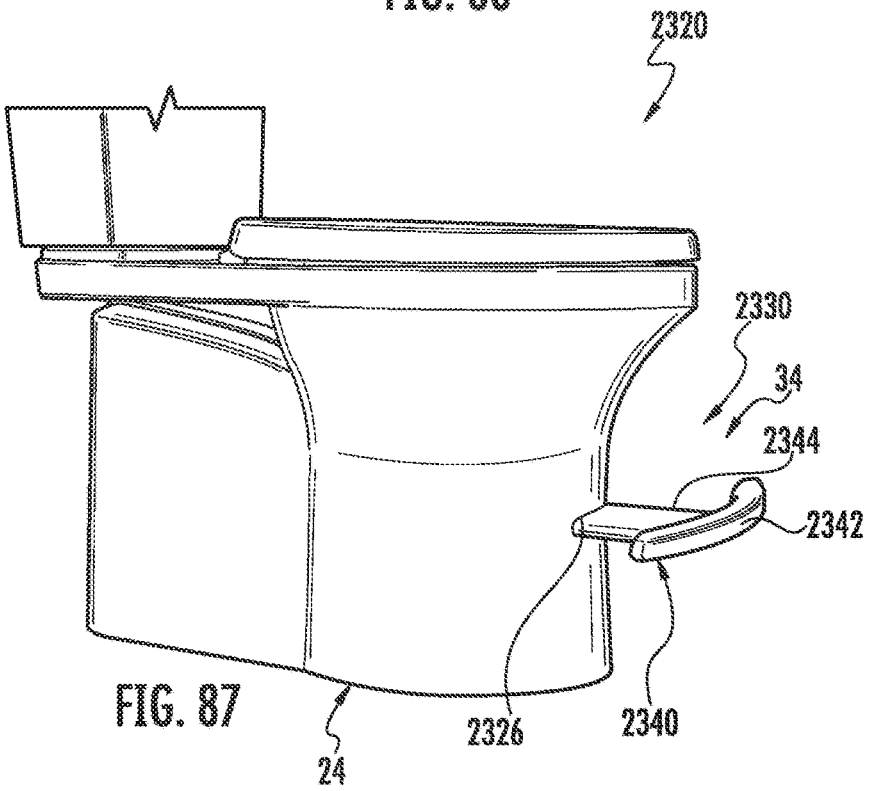
FIG. 87 is a side view of the toilet of FIG. 86 with the foot ledge structure in the extended position.

According to another embodiment as shown in FIGS. 82-87, a toilet 2320 includes a foot ledge structure 2330 with a foot ledge 2340 that is movable between the retracted position 32 and the extended position 34. As shown in FIGS. 82-85 and FIGS. 86-87, the foot ledge structure 2330 can be integrated and used with a variety of different types and shapes of toilets. As shown in FIGS. 84-85, the foot ledge 2340 includes a wide portion 2342 and a narrow portion 2344 that are similar in nature to the wide portion 42 and the narrow portion 44, respectively (as described further herein), where the wide portion 2342 is wider than the narrow portion 2344. The foot ledge structure 2330 (in particular the foot ledge 2340) allows the toilet 2320 to have a minimalistic design. Additionally, the finish on the foot ledge 2340 may match the finish on the trip lever.

The narrow portion 2344 of the foot ledge 2340 is movable at least partially into and out from the hollow inner area 23 (see FIG. 3) of the toilet base 24 through a slot 2326 (similar to the slot 26, as described further herein) as the foot ledge 2340 moves between the retracted position 32 and the extended position 34. A back end of the narrow portion 2344 is attached to a rail mechanism (within the hollow inner area 23 of the toilet base 24) in order to allow the foot ledge structure 2330 to move relative to the toilet base 24. The narrow portion 2344 may include aluminum die casting bolts that are positioned within the hollow inner area 23 of the toilet base 24 and are movable with a sliding carriage (e.g., an upper rail) of the rail mechanism within the hollow inner area 23 of the toilet base 24. A front end of the narrow portion 2344 is statically attached to a middle portion of a back end of the wide portion 2342.

The top surface of the wide portion 2342 of the foot ledge 2340 provides an area for the user to rest and elevate their feet on and accordingly may include a gripping material, such as a soft silicone grip or tread. The wide portion 2342 may optionally be wider than the toilet base 23 in order to provide the user with more area to rest their feet on for greater comfort according to the user's preference. Accordingly, the wide portion 2342 may be a curved or arced bar such that the ends of the wide portion 2342 are curved back toward the back of the toilet base 24 (where the middle of the wide portion 2342 is attached to the narrow portion 2344), which prevents the wide portion 2342 from being in the way within the bathroom, while still maximizing the area that the user can rest and elevate their feet along.

As shown in FIGS. 84-85, the wide portion 2342 is positioned completely outside of the hollow inner area 23 of the toilet base 24 in both the retracted position 32 and the extended position 34. Accordingly, the slot 2326 of the toilet base 24 only has to be large enough to fit the cross-sectional area (along the height and width) of the narrow portion 2344 and extends only along a portion of the front wall of the toilet base 24 (and does not extend along the side walls of the toilet base 24).

FIGS. 88-121 show another embodiment of a foot ledge structure 3030 that can be used with any of the toilets disclosed herein. For example, although the toilet 20 is referenced herein, the foot ledge structure 3030 may be used with any of the other toilets (such as toilets 120, 220, 320, 420, 520, 620, 720, 820, 920, 1020, 1120, 1620, 1720, 1820, 1920, and 2320), unless otherwise specified herein. The foot ledge structure 3030 may include any of the aspects, features, configurations, benefits, or components of any of the other foot ledge structures disclosed herein, unless otherwise specified. For the sake of conciseness, each of the reference numbers for the other various foot ledge structures and their various components disclosed herein that can be used within the foot ledge structure 3030 are not explicitly listed, but still can be used within the foot ledge structure 3030 (and vice versa).

As shown in FIG. 88, the foot ledge structure 3030 comprises a foot ledge 3040, a base bracket 3050, and a rail mechanism 3070, as described further herein. The foot ledge 3040, the base bracket 3050, and the rail mechanism 3070 may include any of the aspects, features, configurations, benefits, or components of any of the other foot ledges, base brackets, and rail mechanisms (respectively) disclosed herein, unless otherwise specified.

The foot ledge 3040 (e.g., the footrest or a foot ledge platform) is movable between the retracted position 32 and the extended position 34 (where the retracted position 32 and the extended position 34 are described further herein) relative to the toilet base 24 and the base bracket 3050. The foot ledge 3040 is movably attached to the base bracket 3050 through the rail mechanism 3070. The foot ledge 3040 may optionally be constructed at least partially or completely out of an enameled die-cast aluminum.

The base bracket 3050 provides a static and stable area for the foot ledge 3040 to movably attach to (via the rail mechanism 3070). The base bracket 3050 is configured to elevate the foot ledge 3040 to a particular height above the floor. The base bracket 3050 may optionally be laser-cut and constructed out of brake-formed and folded steel. The base bracket 3050 is configured to attach the rest of the foot ledge structure 3030 to the floor. Accordingly, the base bracket 3050 is independently attachable or fastenable to the floor separate from the rest of the toilet 20 (including the toilet base 24), as described further herein. Once installed, the base bracket 3050 is non-movably or statically attached to the floor (and optionally also to toilet base 24), and the foot ledge 3040 is movably attached to the base bracket 3050. The base bracket 3050 is positioned within the inner area 23 of the toilet base 24 (as shown in FIG. 3) and beneath the toilet bowl 25.

Figure 96:
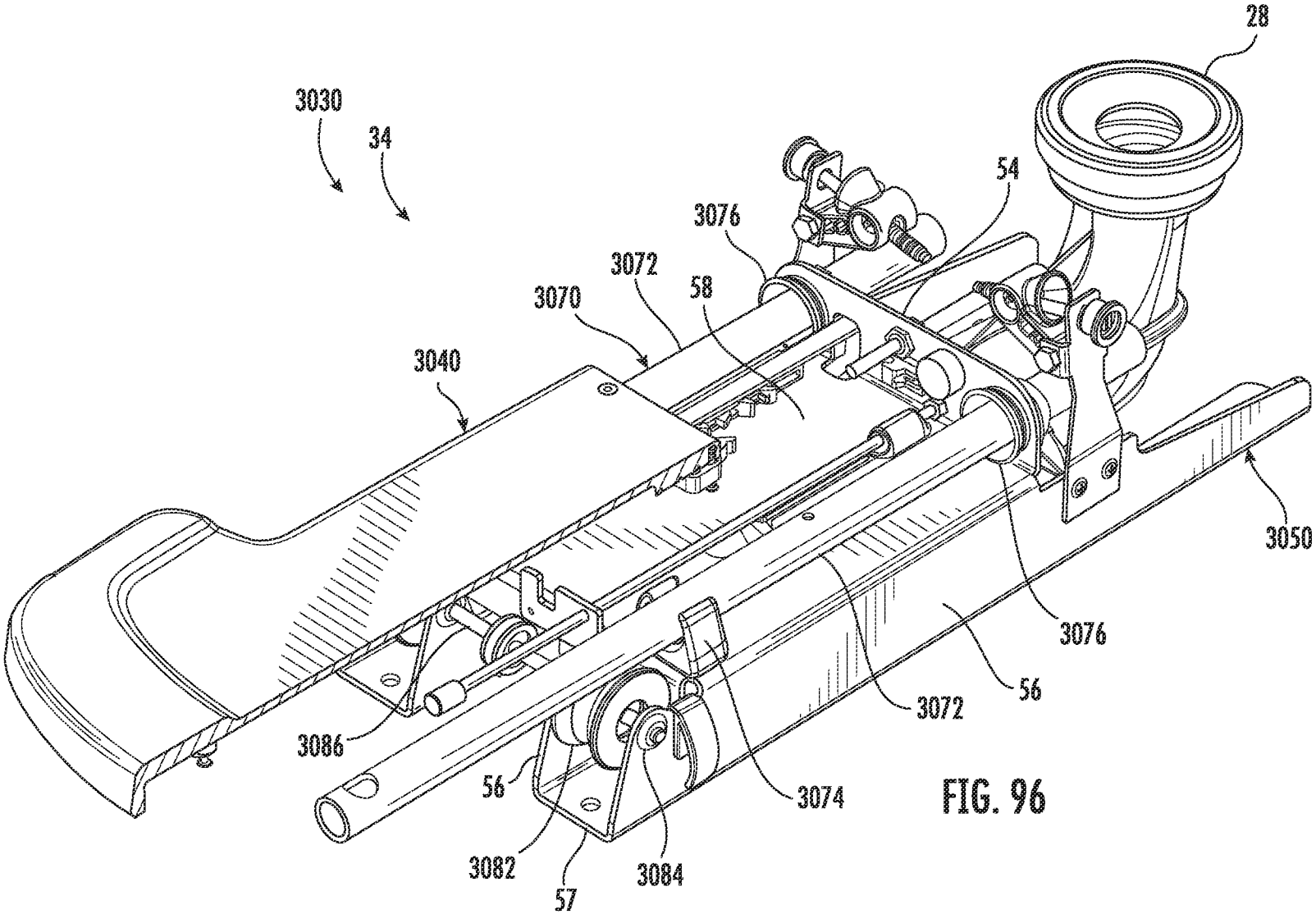
FIG. 96 is a perspective, partially cross-sectional view of the foot ledge structure of FIG. 88.
Figures 97, 98:
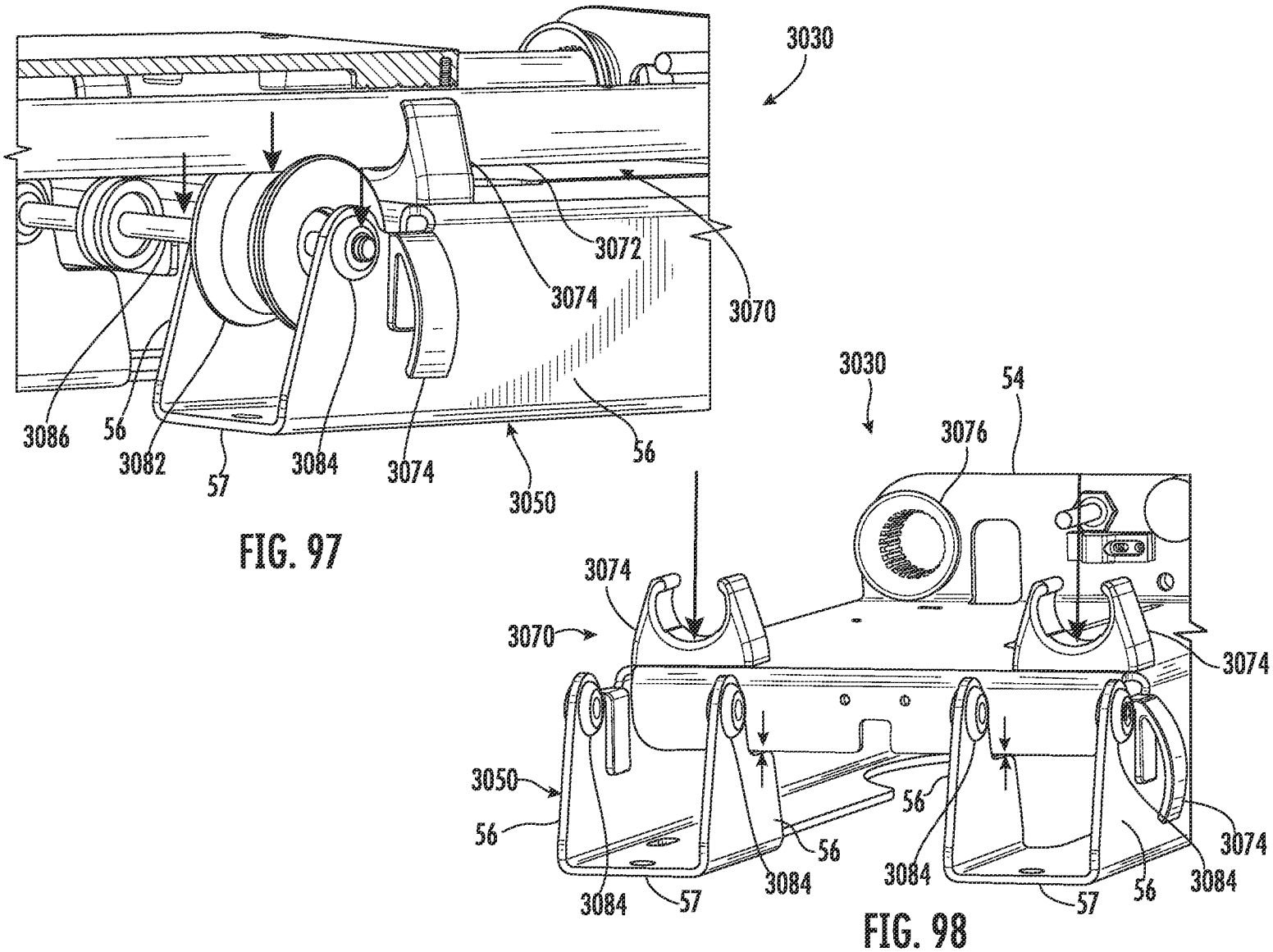
FIG. 97 is a perspective, side, partially cross-sectional view of the foot ledge structure of FIG. 88.
FIG. 98 is a perspective, front view of the foot ledge structure of FIG. 88 with the foot ledge removed.

The base bracket 3050 includes the vertical extensions 56 and the upper horizontal extensions 58 (as described further herein). The base bracket 3050 also includes lower horizontal walls, supports, protrusions, or extensions 57, a vertical wall, support protrusion, extension, or endplate 54, and upper vertical walls, supports, protrusions, or extensions 55 (each of which can include any of the features and materials of the extensions 56 and 58 (such as being laser cut and constructed out of blended aluminum) and can also be included within the any of the other base brackets disclosed herein, unless otherwise specified). The lower horizontal extension 57, the vertical endplate 54, and the upper vertical extensions 55 can include any of the features and materials of the extensions 56, 58. Furthermore, as shown in FIGS. 96-98 the lower vertical extensions 56 may include both outer lower vertical extensions and inner lower vertical extensions that are parallel and aligned with each other along the width of the base bracket 3050. The inner and outer lower vertical extensions 56 are spaced apart by and connected to each other through the lower horizontal extension 57.

The lower horizontal extensions 57 provide an area for the base bracket 3050 to directly and independently attach to the floor (separately and independently from the toilet base 24 of the toilet 20). The lower horizontal extensions 57 are positioned along and statically attached to the bottom of the vertical extensions 56 (along both sides of the base bracket 3050) and extend along at least a portion of the length of the base bracket 3050. The lower horizontal extensions 57 are substantially parallel to the upper horizontal extensions 58. The bolt holes 52 (as described further herein) extend completely through the lower horizontal extensions 57. According to one embodiment, the lower horizontal extensions 57 extend inwardly from the bottom of the vertical extensions 56 (i.e., toward the opposite vertical extension 56), along a portion of the width of the base bracket 3050. However, according to other various embodiments, the lower horizontal extensions 57 may extend outwardly.

The vertical endplate 54 supports the back end of the slides 3072 (via the back guides 3076, as described further herein) and provides an attachment areas for various other components (also described further herein). The vertical endplate 54 extends vertically above and is statically attached to the horizontal extension 57. The vertical endplate 54 is positioned along the back end of the horizontal extension 57, in front of the trapway 28.

The upper vertical extensions 55 (e.g., cam brackets) that extend vertically above the extensions 56, 57, 58 (where the vertical extension 56 is a lower vertical extension) and are substantially parallel to (and optionally extend vertically from) the lower vertical extensions 56. The upper vertical extensions 55 are positioned near a back portion of the base bracket 3050 and along opposite sides of the base bracket 3050 to align with holes along the side walls of the toilet base 24. The mounting cams 59 (as described further herein) are attached to the top portions of the upper vertical extensions 55 of the base bracket 3050. By elevating the mounting cams 59 and the associated holes (e.g., the toilet anchor points) of the toilet base 24, additional room is provided for the rest of the foot ledge structure 3030.

Figure 90:
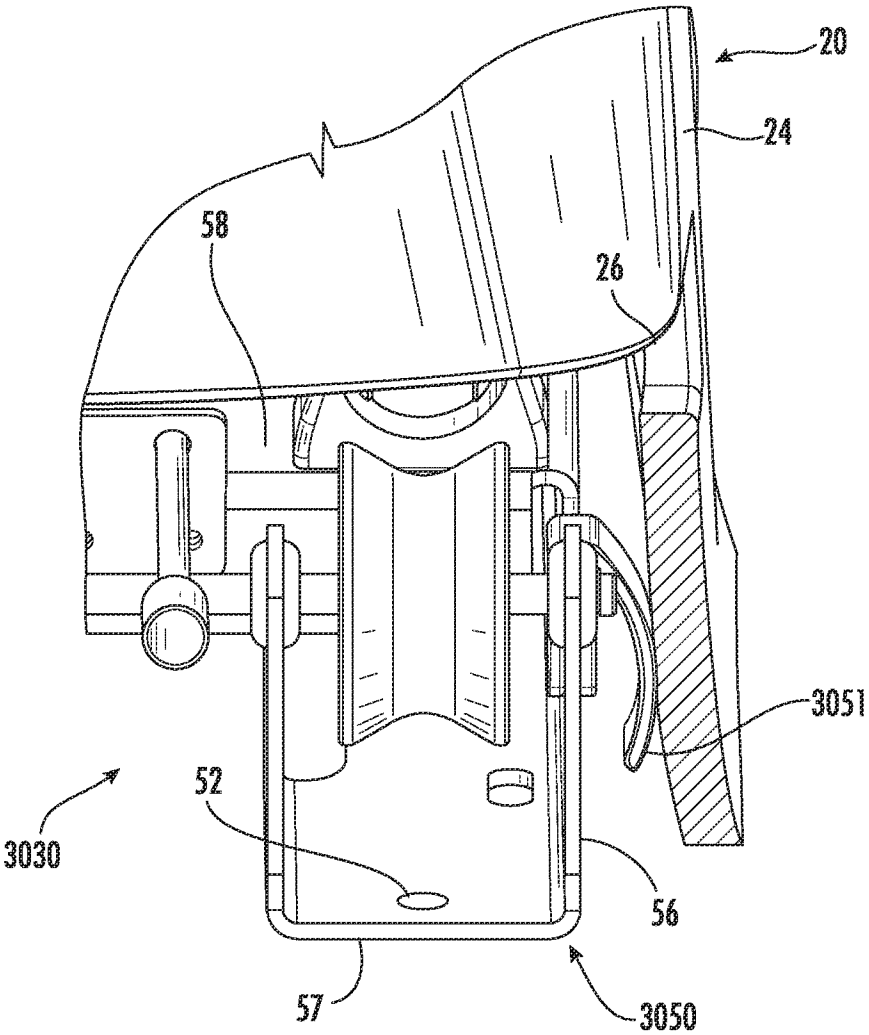
FIG. 90 is an enlarged view of a portion of FIG. 89.
Figure 89:
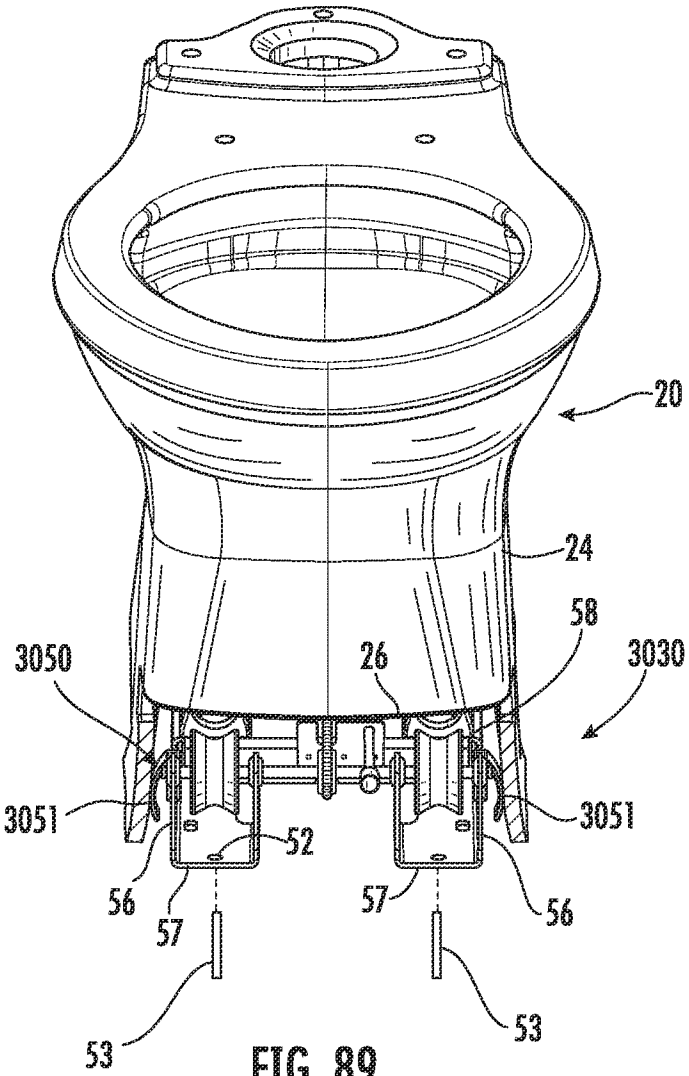
FIG. 89 is a front view of the foot ledge structure of FIG. 88 in a toilet base.

As shown in FIGS. 88-90, the base bracket 3050 further includes two centering side tabs 3051 that extend from the outer sides of the lower vertical extensions 56 and beyond the width of the horizontal extension 58. The side tabs 3051 are pivotably attached to the lower vertical extensions 56 and/or to the horizontal extension 58 such that the side tabs 3051 can flex and compress inwardly as the toilet base 24 is being mounted over the base bracket 3050 (or as the base bracket 3050 is being translated into an installed toilet base 24). Accordingly, the side tabs 3051 center the toilet base 24 over and onto the base bracket 3050, thereby aligning the toilet base 24 and the base bracket 3050 and thereby aligning the toilet base 24 (in particular the slot 26 of the toilet base 24) and the foot ledge 3040. The side tab 3051 may be a curved, flexible clip or spring (e.g., a leaf spring) that is attached to the lower vertical extensions 56 and/or to the horizontal extension 58 along one end. The side tabs 3051 may be positioned toward the front end of the base bracket 3050 and on opposite sides of the horizontal extension 58 along the width of the base bracket 3050. The side tabs 3051 may optionally be constructed out of plastic and may be plastic injection molded. Since the side tabs 3051 are flexible and provide a certain amount of clearance (e.g., ⅝ inch), the side tabs 3051 allow the foot ledge structure 3030 to be more easily and smoothly installed with the toilet 20.

The base bracket 3050 is configured to be statically, rigidly, and securely attached independently to the floor (separate from the toilet base 24) with a plurality of fasteners 53 (e.g., bolts). In particular, the base bracket 3050 is independently (and optionally directly) securely attachable to the floor without the aid of the toilet base 24. The base bracket 3050, however, may serve as an anchor to secure, install, and/or attach the rest of the toilet 20 (in particular the toilet base 24) to the floor. For example, the base bracket 3050 may attach the toilet base 24 to the floor (and the base bracket 3050 and the toilet base 24 may be secured together via the mounting cams 59, as described further herein). However, the base bracket 3050 is not dependent upon the toilet base 24 to securely attach to the floor. The base bracket 3050 is therefore separately and independently attachable to the floor from the toilet base 24, although it is understood that the base bracket 3050 and the toilet base 24 may be positioned next to each other and/or attached or connected to each other.

Figure 91:
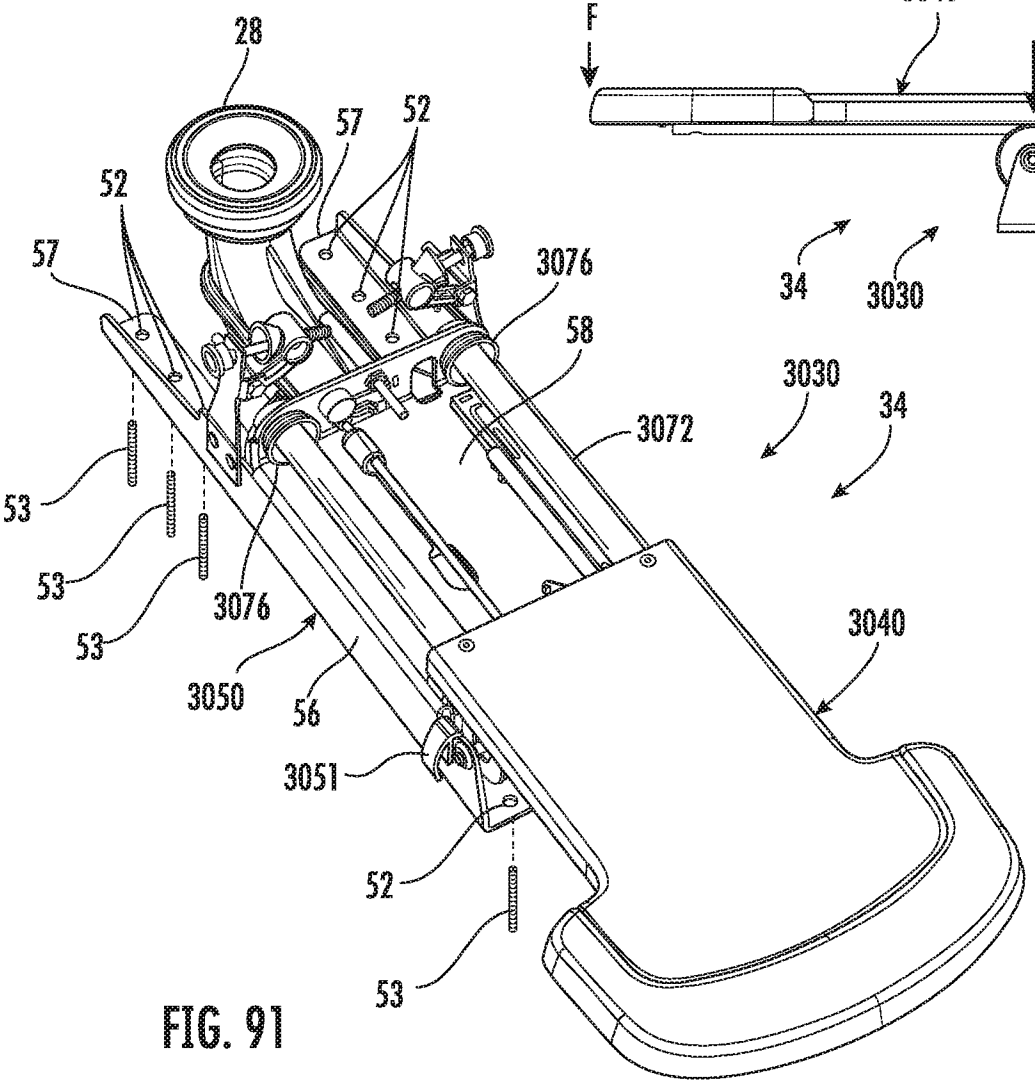
FIG. 91 is a top, perspective view of the foot ledge structure of FIG. 88.
Figure 93:
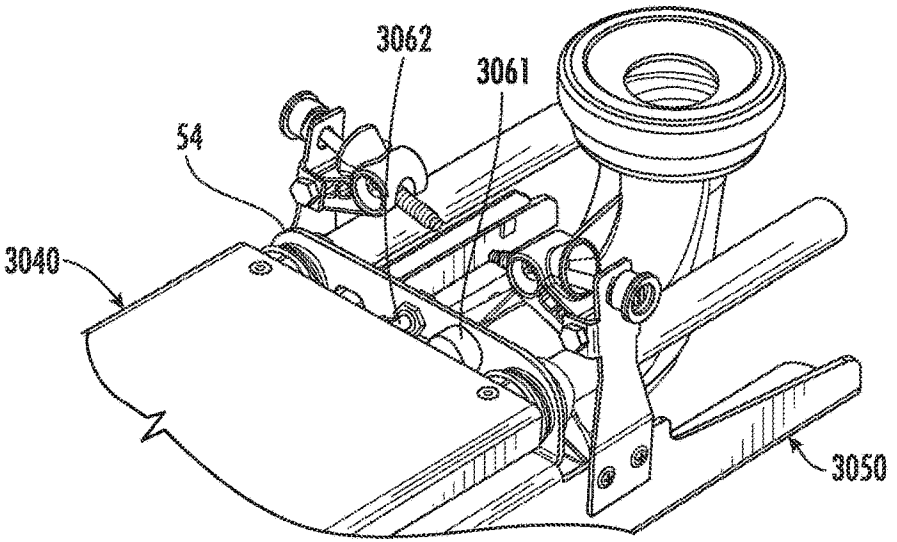
FIG. 93 is a perspective view of a back portion of the foot ledge structure of FIG. 88.

As shown in FIGS. 89-91, the base bracket 3050 includes a plurality of fastener holes (referred to herein as bolt holes 52, as described further herein) that extend through and are defined by the lower horizontal extension 57 and are configured to receive the fasteners 53. The bolts 52 secure the base bracket 3050 to the floor and prevent the base bracket 3050 from moving (in particular relative to the toilet base 24). Although the fasteners 53 are shown below the base bracket 3050, it is understood that the fasteners 53 may be inserted into each of the bolt holes 52 from above or below the lower horizontal extension 57, depending on the desired configuration.

As shown in FIG. 89, each of the lower horizontal extensions 57 defines a bolt hole 52 along the front portion of the base bracket 3050 (for two bolt holes 52 along the front portion of the base bracket 3050). By securing the base bracket 3050 to the floor at the front of the base bracket 3050, the base bracket 3050 is prevented from pivoting or moving along the front of the base bracket 3050. As shown in FIG. 91, each of the lower horizontal extensions 57 defines three bolt holes 52 along the back portion of the base bracket 3050 (for six bolt holes 52 along the front of the base bracket 3050). Accordingly, the base bracket 3050 may include eight bolt holes 52 (that are configured to receive eight fasteners 53) along the lower horizontal extensions 57, thereby allowing the base bracket 3050 to be attached (e.g., bolted) to the floor at eight different areas, which provides a high level of stability of the foot ledge structure 3030 (and a high sense of security for the user).

Figure 92:
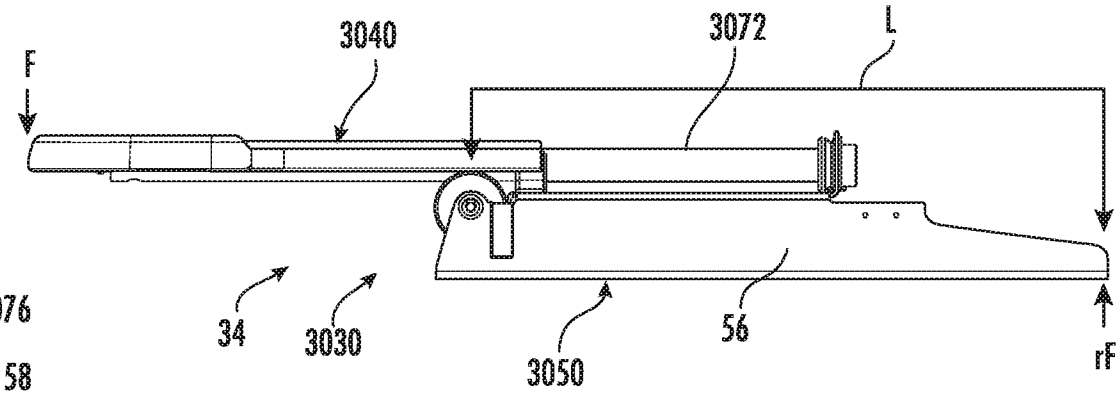
FIG. 92 is a side view of the foot ledge structure of FIG. 88.

As shown in FIG. 91, the horizontal extensions 57 (and optionally the lower vertical extensions 56) extend beyond the back end of the upper horizontal extension 58, along opposite sides of the trapway 28 (i.e., the upper horizontal extension 58 does not extend along the back portion of the base bracket 3050). The bolt holes 52 extend through this back portion of the base bracket 3050, along opposite sides of the trapway 28. By extending beyond the back end of the upper horizontal extension 58, the length of the base bracket 3050 is maximized, which maximizes the length L of the lever arm that extends between the fulcrum (at the front end of the base bracket 3050) and the back of the base bracket 3050 (along which the back bolt holes 52 are positioned), as shown in FIG. 92. By maximizing the length L of the lever arm, the mechanical strength of the foot ledge structure 3030 (as resistive force rF) to resist and withstand large loads on the foot ledge 3040 (in particular when a force F is exerted onto the front end of the foot ledge 3040) is increased, and the base bracket 3050 stays securely attached to the floor, independently and separately from the toilet base 24. Furthermore, since there are a large number of attachment points (e.g., 6 attachment points) to the floor along the back portion of the base bracket 3050, the base bracket 3050 (and therefore entire foot ledge structure 3030) stays securely and tightly attached and fixed to the floor, even when extreme loads are applied to the front end of the foot ledge 3040 to create the force F (such as a user standing on the front end of the foot ledge 3040).

Figure 94:
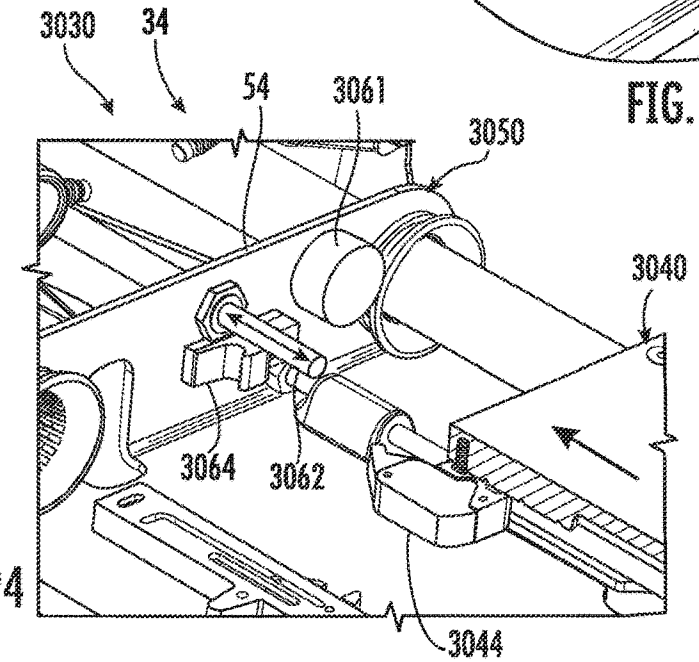
FIG. 94 is a perspective, partially cross-sectional view of a back portion of the foot ledge structure of FIG. 88 with the foot ledge in a partially extended position.
Figure 95:
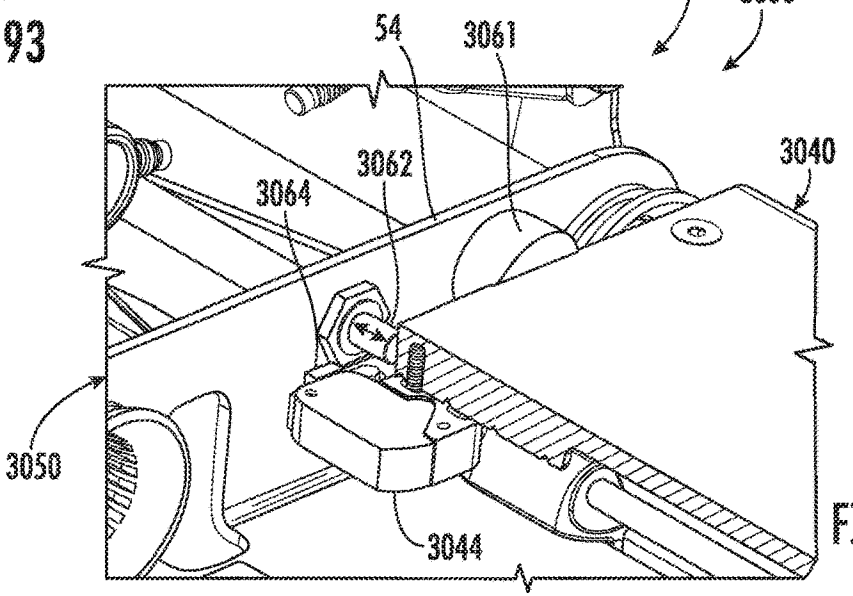
FIG. 95 is a perspective, partially cross-sectional view of a back portion of the foot ledge structure of FIG. 88 with the foot ledge in a retracted position.

The base bracket 3050 includes a number of components to control the movement of the foot ledge 3040 as the foot ledge 3040 moves between the retracted position 32 and the extended position 32. For example, as shown in FIGS. 88 and 93-95, the base bracket 3050 further comprises at least one bumper 3061 and at least one decelerator spring 3062 that both help control the deceleration and stop the foot ledge 3040 as the foot ledge 3040 moves from the extended position 34 into the retracted position 32 (when the foot ledge 3040 is pushed into the toilet 20 by the user, for example), thereby bringing the foot ledge 3040 into a controlled stop as the foot ledge 3040 moves into the retracted position 32, preventing the foot ledge 3040 from slamming into the retracted position 32, and protecting the latch 3044 from slamming against the vertical endplate 54. Both the bumper 3061 and the decelerator spring 3062 are positioned along (and extends in front of) the front surface of the vertical endplate 54 (that faces toward the front of the foot ledge structure 3030) and are each configured to directly abut the back end of the foot ledge 3040 in the retracted position 32, as shown in FIG. 95. The bumper 3061 and the decelerator spring 3062 are particularly useful in view of the weight and resulting momentum of the foot ledge 3040 that could otherwise cause damage to components and/or create a loud noise.

The bumper 3061 (e.g., a rubber bumper) and the decelerator spring 3062 are flexible and compressible components that are configured to compress as the foot ledge 3040 contacts the bumper 3061 and the decelerator spring 3062 while moving into the retracted position 32. FIG. 94 shows the bumper 3061 and the decelerator spring 3062 expanded while the foot ledge 3040 is in the extended position 34. FIG. 95 shows the bumper 3061 and the decelerator spring 3062 compressed while the back edge of the foot ledge 3040 is pressing against the bumper 3061 and the decelerator spring 3062 in the retracted position 32. Different sizes of the bumper 3061 and the decelerator spring 3062 may optionally be used to fine tune where the foot ledge 3040 is stopped in the retracted position 32. Additionally, when the foot ledge 3040 is being moved from the retracted position 32 to the extended position 34, the decelerator spring 3062 pushes (and thereby accelerates) the foot ledge 3040 into the extended position 34.

Additionally, as further shown in FIGS. 94-95, the foot ledge 3040 comprises a push-in latch 3044 and the base bracket 3050 comprises a latch receiver 3064 that is configured to receive and lock or engage with the latch 3044 when the foot ledge 3040 is in the retracted position 32 (as shown in FIG. 95), which locks or maintains the foot ledge 3040 in the retracted position 32. The interaction between the latch 3044 and the latch receiver 3064 keeps or retains the foot ledge 3040 in the retracted position 32 (until the user moves or actuates the foot ledge 3040 into the extended position 34). The latch 3044 is positioned along the bottom surface of the foot ledge 3040, between the two slides 3072 and extends at least partially beyond the end surface of the foot ledge 3040. The latch 3044 is configured to lock and maintain the foot ledge 3040 in the retracted position 32. The latch receiver 3064 is positioned along the vertical endplate 54 of the base bracket 3050 and is configured to receive and lock or engage with the latch 3044 when the foot ledge 3040 is in the retracted position 32 (to lock and maintain the foot ledge 3040 in the retracted position 32). Alternatively, according to another embodiment, the latch 3044 may be a part of the base bracket 3050, and the latch receiver 3064 may be a part of the foot ledge 3040.

As shown in FIG. 94, in the extended position 34, the latch 3044 and the latch receiver 3064 are unattached from each other, and the latch 3044 is in the unlocked position (e.g., with a pivotable extension extending out from a body of the latch 3044). As shown in FIG. 95, once the foot ledge 3040 is moved into the retracted position 32, the pivotable extension of the latch 3044 pivots inwardly as its abuts and is received by a hook of the latch receiver 3064 (which causes the latch 3044 to move into the locked position), thereby locking the latch 3044 and the latch receiver 3064 together, which retains the foot ledge 3040 in the retracted position 32. To unlock the latch 3044 from the latch receiver 3064 (i.e., to unlock the foot ledge 3040), the user can move or push the foot ledge 3040 slightly further into the toilet base 24 (in an opposite direction from the moving into extended position 34), which pushes the latch 3044 further toward the latch receiver 3064, thereby further pivoting the extension of the latch 3044. This movement unlocks the latch 3044, which releases the latch 3044 from the latch receiver 3064 and allows the foot ledge 3040 to move from the retracted position 32 to the extended position 34.

The rail mechanism 3070 allows the foot ledge 3040 to move or slide between the retracted position 32 and the extended position 34 relative to the base bracket 3050 and the rest of the toilet 20 (in particular the toilet base 24). Referring back to FIG. 88, the rail mechanism 3070 is attached to the bottom surface of the foot ledge 3040 and the top surface of the upper horizontal extension 58 of the base bracket 3050.

As further shown in FIG. 88, the rail mechanism 3070 comprises at least one rail, arm, tube, or slide 3072 that is statically attached to the bottom surface of the foot ledge 3040 and movably attached to the base bracket 3050 (as shown in FIG. 91) through other components of the rail mechanism 3070. The slides 3072 are round tubes that may be constructed out of cold-rolled steel and may have an approximately 1 inch outer diameter.

According to one embodiment as shown in FIGS. 88 and 96, the rail mechanism 3070 has two slides 3072 positioned on opposite sides of the foot ledge 3040 (along the width of the foot ledge 3040). The slides 3072 extend beyond the back end of the foot ledge 3040 to maximize how far the foot ledge 3040 can be moved. When in the retracted position 32, the respective back ends of the two slides 3072 are positioned along opposite sides of and partially aligned with or positioned behind the trapway 28 (see, for example, FIG. 112). The slides 3072 are spaced apart from each other (along the width of the foot ledge structure 3030) such that the trapway 28 can fit between the two slides 3072.

To guide the movement of the foot ledge 3040 between the retracted position 32 and the extended position 34, the rail mechanism 3070 comprises a foot ledge bearing assembly that comprises slide guides (i.e., a front guide 3074 and a back guide 3076) and a wheel assembly (i.e., wheels 3082, grommets 3084, and a shaft 3086). The foot ledge bearing assembly allows the foot ledge 3040 to move with minimal friction and while supporting loads up to 415 pounds.

As shown in FIGS. 88 and 96, the foot ledge bearing assembly of the rail mechanism 3070 comprises a pair of complementary and corresponding tube or slide bearings or guides for each of the slides 3072 that are statically attached to the base bracket 3050 and are configured to receive and guide the movement of the slides 3072 as the foot ledge 3040 is moved between the retracted position 32 and the extended position 34. To support and guide the two slides 3072, the rail mechanism 3070 comprises two pairs of the slide guides positioned on opposite sides of the base bracket 3050 (along the width of the base bracket 3050). Each of the pairs of slide guides comprises a front bearing or guide 3074 and a back bearing or guide 3076 that are statically attached to and positioned above the upper horizontal extension 58 of the base bracket 3050. Each of the slides 3072 is slidably positioned within a pair of the guides 3074, 3076. The guides 3074, 3076 guide the linear motion of the foot ledge 3040 (via the slides 3072) and minimize sliding friction as the foot ledge 3040 moves. The guides 3074, 3076 may be constructed out of a low-friction, Celcon material and may optionally be plastic, injection molded.

As shown in FIGS. 88 and 96, the front guide 3074 is positioned toward the front of the base bracket 3050 (and therefore toward the front of the toilet 20), and the back guide 3076 is positioned toward the back of the base bracket 3050 (and therefore toward the back of the toilet 20). Each of the guides 3074, 3076 define a central aperture that is sized to receive the slide 3072 such that the slide 3072 can move and slide within the guides 3074, 3076. The respective central apertures of the guides 3074, 3076 are aligned with each other along the length of the base bracket 3050 such that each of the of the slides 3072 can slide within both of the guides 3074, 3076 at the same time, thus allowing the foot ledge 3040 to be fully supported during movement. The guides 3074, 3076 thus control and guide the sliding movement of the foot ledge 3040 through the slides 3072.

The front guides 3074 have a c-shape and are open along the top portion of the front guides 3074 to avoid any interference with the area along which the slides 3072 attach to the bottom surface of the foot ledge 3040. Accordingly, the front guides 3074 do not extend along the top of the slides 3072 (as shown in FIG. 96), and the connection area between the slides 3072 and the bottom surface of the foot ledge 3040 extends through the open top portion of the front guides 3074. The front guides 3074 are statically attached directed to the top surface of the upper horizontal extension 58 of the base bracket 3050, along the front end of the base bracket 3050. The front guides 3074 may be constructed out of a low-friction silicone to allow the slides 3072 to move smoothly within and through the front guides 3074. The front guides 3074 help keep the slides 3072 aligned with the wheels 3082 and act as a brake to support heavy downward loads on the foot ledge 3040 (as described further herein).

The back guides 3076 extend completely in a circle such that the back guides 3076 extend completely around the outer surface of the back portion of the slides 3072 (where the back portion of the slides 3072 is the portion of the slides 3072 that extends beyond the end of the foot ledge 3040). Since weight is pressed along the front end of the foot ledge 3040 in use (along the side completely opposite the back guides 3076), the back guides 3076 support the resulting upward force or load (exerted onto the back guides 3076 by the slides 3072) and prevent the foot ledge 3040 from being inadvertently released during use by extending completely around the slides 3072, while minimizing friction. The back guides 3076 are positioned toward a back end of the base bracket 3050, in an area in front of the trapway 28. The back guides 3076 may extend through (and be defined by) holes in the vertical endplate 54 (e.g., the two back guides 3076 are positioned along opposite ends of the vertical endplate 54). The back guides 3076 allow the slides 3072 to move smoothly within and through the back guides 3076. For example, as shown in FIG. 98, the back guides 3076 may include inner bearings along the inner circumference of the back guides 3076. Alternatively, the back guides 3076 may be constructed out of a low-friction silicone.

The front and back guides 3074, 3076 are positioned and spaced apart from each other along the length of the foot ledge structure 3030 such that each of the slides 3072 are always supported by both the front guide 3074 and the back guide 3076, regardless of the position of the foot ledge 3040. As shown in FIG. 91, even in the fully extended position 34, the back ends of the slides 3072 are still positioned completely within the back guides 3076. Accordingly, each of the slides 3072 is stably supported by two contact points (i.e., a front guide 3074 and a back guide 3076) and the entire foot ledge 3040 is stably supported by four contact points (i.e., two front guides 3074 and two back guides 3076 along the two slides 3072) during all movement and adjustment. The guides 3074, 3076 work in unison to provide a smooth, low-friction movement of the foot ledge 3040.

As shown in FIGS. 88 and 96-98, the wheel assembly of the foot ledge bearing assembly comprises two wheels 3082 (for each of the two slides 3072), four grommets 3084 (for each of the two wheels 3082), and a wheel support shaft 3086 that extends through the wheels 3082 and the grommets 3084. The wheel assembly (in particular the wheel 3082) is positioned in front of the pair of guides (in particular the front guides 3074) along the base bracket 3050. As described further herein, upon excess load exerted onto the foot ledge 3040, the wheel assembly is configured to transfer the excess load from the wheels 3082 to the front guides 3074.

The shaft 3086 extends through apertures defined by the inner and outer lower vertical extensions 56 and is positioned along the front end of the base bracket 3050. The lower vertical extensions 56 elevate the shaft 3086 (and thus the wheels 3082) above the floor such that the wheels 3082 can rotate. The shaft 3086 may optionally be constructed out of stainless steel.

The wheels 3082 are configured to support the foot ledge 3040 (via a bottom surface of the slides 3072) as the foot ledge 3040 is moved between the retracted position 32 and the extended position 34. The wheels 3082 rotate as the foot ledge 3040 is moved while supporting the foot ledge 3040. Each of the wheels 3082 includes a v-shaped trough along its outer circumference that is configured to receive the bottom surface of the slide 3072 and reduce friction. Since the wheels 3082 are elevated above the floor, the wheels 3082 only contact the slides 3072 and the shaft 3086. Accordingly, the wheels 3082 directly transfer the load from the foot ledge 3040 (via the slides 3072) to the base bracket 3050 (via the shaft 3086 and the grommets 3084). The wheels 3082 may be press fit into position along opposite ends of the shaft 3086. The wheels 3082 may optionally be constructed out nylon, may include sealed bearings, and may have an outer diameter of approximately 58 millimeters.

The grommets 3084 are positioned within each of the apertures in the lower vertical extensions 56 (that the shaft 3086 is positioned within), such that the shaft 3086 extends through each of the grommets 3084. The grommets 3084 support the shaft 3086. Two grommets 3084 are positioned on opposite sides of the wheels 3082 along the length of the shaft 3086. The grommets 3084 are relatively soft and are configured to compress and give way under heavy loads. The grommets 3084 may optionally be constructed out of rubber.

Accordingly, when a heavy load is applied on top of the foot ledge 3040, the grommets 3084 compress, which lowers the shaft 3086 and the wheels 3082. The wheels 3082 are lowered below the front guides 3074 (as shown in FIG. 97). By lowering the wheels 3082 below the front guides 3074, the front portion of the foot ledge 3040 is lowered and the weight and force of the foot ledge 3040 is shifted from the wheels 3082 to the front guides 3074. Due to the increased weight (and thus increased generated friction) of the foot ledge 3040 onto the front guides 3074, the front guides 3074 subsequently acts as a brake and prevent the foot ledge 3040 from moving or sliding any further under the heavy load, thereby immobilizing the foot ledge 3040.

Furthermore, as shown in FIG. 98, the front guides 3074 manage the excess weight on the foot ledge 3040. In particular, the weight and force exerted onto the front guides 3074 from the foot ledge 3040 is transferred from the front guides 3074 onto the base bracket 3050. The shape and configuration of the base bracket 3050 is specifically designed to resist extreme loads applied directly to the front guides 3074. In particular, the folded bracket geometry (between the various extensions 54, 55, 56, 57, and 58) of the base bracket 3050 is configured to transfer loads directly to the floor, which prevents permanent damage to the base bracket 3050.

Figure 99:
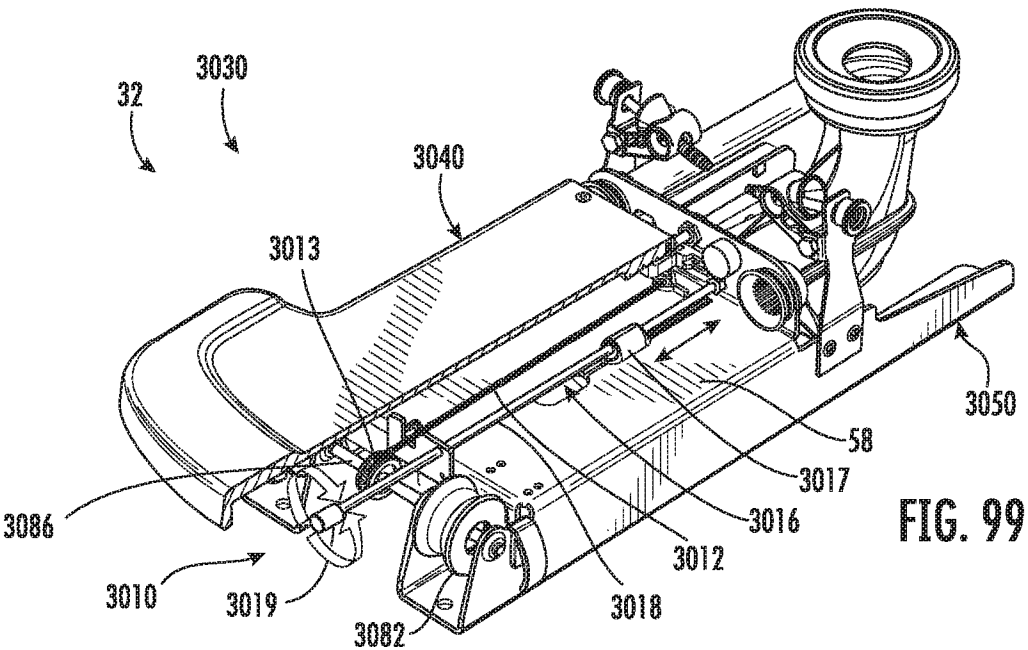
FIG. 99 is a perspective, top, partially cross-sectional view of the foot ledge structure of FIG. 88.
Figure 101:
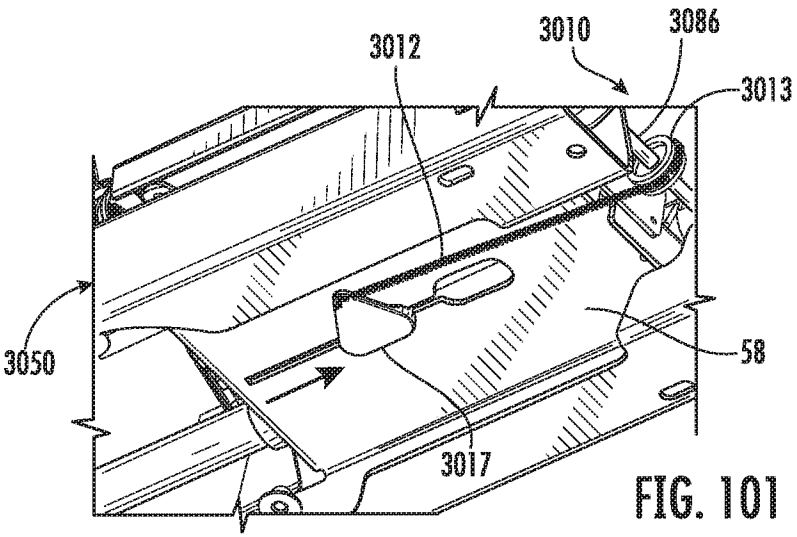
FIG. 101 is a perspective, bottom view of the foot ledge structure of FIG. 88 with the ejector spring relatively less tensioned.
Figure 100:
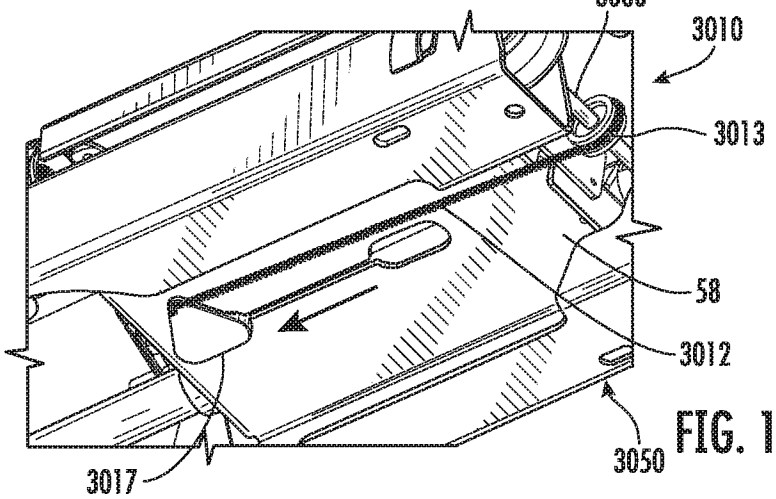
FIG. 100 is a perspective, bottom view of the foot ledge structure of FIG. 88 with an ejector spring relatively tensioned.
Figure 105:
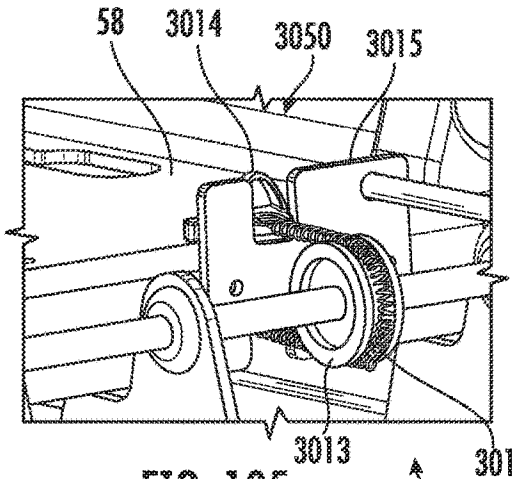
FIG. 105 is an enlarged view of a portion of FIG. 104.

The foot ledge structure 3030 comprises an ejector spring assembly 3010 that is configured to automatically move the foot ledge 3040 from the retracted position 32 to the extended position 34 once the foot ledge 3040 is unlocked and disengaged from the base bracket, as shown in FIGS. 99-101. The ejector spring assembly 3010 comprises an ejector spring 3012, an ejector wheel 3013, and a spring tension adjustor 3016. The ejector pulley or wheel 3013 is press fit into position onto the shaft 3086 and is positioned between the two wheels 3082 (as shown in FIG. 88). The ejector wheel 3013 may optionally be constructed out nylon, may include sealed bearings, and may have an outer diameter of approximately 30 millimeters (with a groove that is configured to accommodate and secure the outer surfaces of the ejector spring 3012, as shown in FIG. 105).

As shown in FIGS. 99-101, the ejector spring 3012 is removably and reattachably attached to the back end of the foot ledge 3040 (as described further herein) and extends from the back end of the foot ledge 3040, beneath the foot ledge 3040 and above the upper horizontal extension 58 (i.e., between the foot ledge 3040 and the top surface of the upper horizontal extension 58 of the base bracket 3050), around a portion of the outer circumference of the ejector wheel 3013, and beneath the upper horizontal extension 58, and is attached to a tensioning shuttle 3017 of the spring tension adjustor 3016. The ejector spring 3012 biases the foot ledge 3040 to move from the retracted position 32 to the extended position 34.

In particular, to move the foot ledge 3040 from the retracted position 32 to the extended position 34, the user actuates the movement of the foot ledge 3040 by pushing the foot ledge 3040 inward further into the toilet base 24, which unlocks the latch 3044 and releases the latch 3044 from the latch receiver 3064 (as described further herein). Once the foot ledge 3040 is unlocked (and the latch 3044 is disengaged from the latch receiver 3064), the ejector spring 3012 is allowed to compress, which pulls the back end of the foot ledge 3040 toward the front of the base bracket 3050 as the ejector spring 3012 compresses, thereby moving the foot ledge 3040 into the extended position 34.

Figure 102:
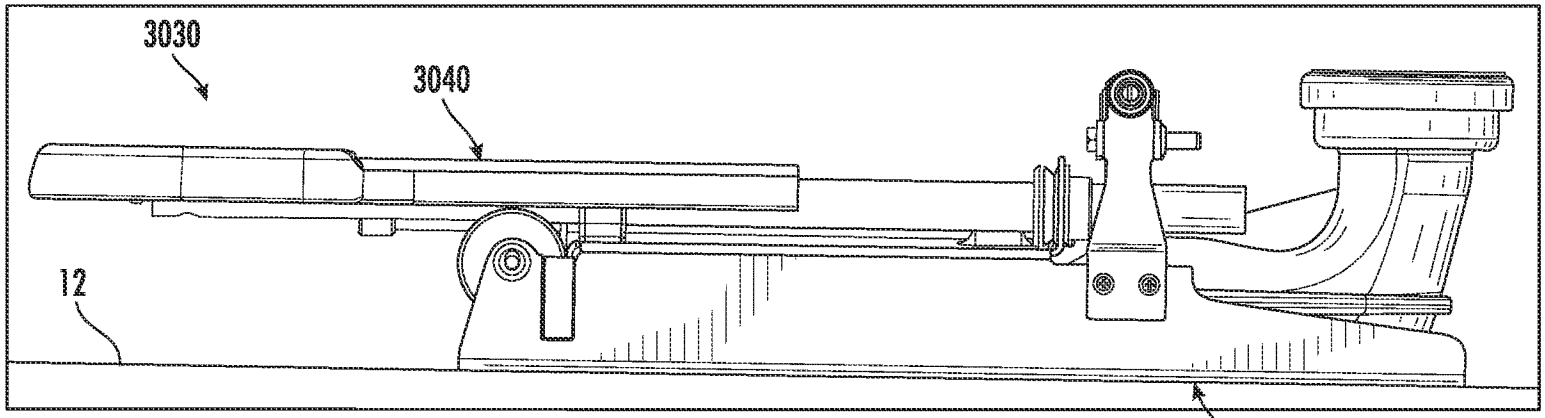
FIG. 102 is a side view of the foot ledge structure of FIG. 88 on an uneven floor.
Figure 103:
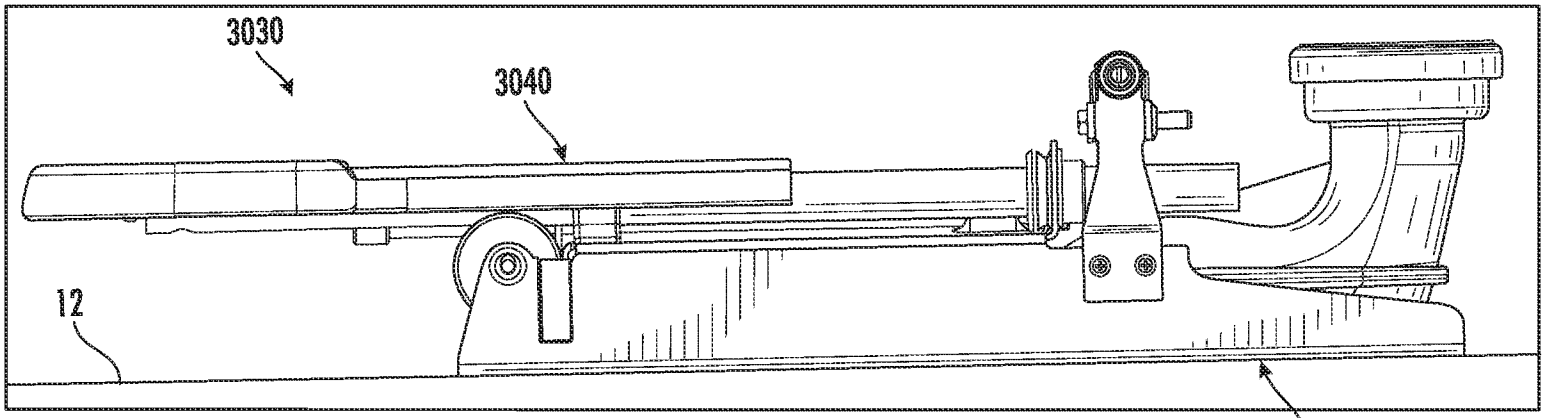
FIG. 103 is a side view of the foot ledge structure of FIG. 88 on another uneven floor.

The ejector spring 3012 has an adjustable spring tension to allow the foot ledge 3040 to effectively move from the retracted position 32 to the extended position 34 on uneven floors. In particular, the ejection spring tension adjustor 3016 (which may be referred to as the spring adjustment assembly) is configured to allow the user (or installer) to adjust the spring tension of the ejector spring 3012 to compensate for uneven floors 12 (as shown in FIGS. 102-103). The spring tension adjustor 3016 comprises a threaded rod or shaft 3018, a slide pivot or tensioning shuttle 3017, and a control knob 3019, as shown in FIG. 99. The threaded shaft 3018 is rotatably attached to the base bracket 3050 (and positioned above the upper horizontal extension 58 of the base bracket 3050). The tensioning shuttle 3017 is movably attached to and positioned along the length of the threaded shaft 3018 and extends through a longitudinal hole or slot in the upper horizontal extension 58, thereby extending both above and below the upper horizontal extension 58. The tensioning shuttle 3017 is slidably attached to the upper horizontal extension 58 (through the slot), but cannot rotate relative to the upper horizontal extension 58, which causes the tensioning shuttle 3017 to move along the length of the horizontal extension 58 when the threaded shaft 3018 is rotated. The tensioning shuttle 3017 may optionally be constructed out of plastic. The control knob 3019 is positioned along the front end of the threaded shaft 3018 and extends out in front of the base bracket 3050 in order to be accessible to the user. The control knob 3019 is positioned underneath the foot ledge 3040 (in both the retracted position 32 (as shown in FIG. 99) and the extended position 34 (as shown in FIGS. 102-103)).

To adjust the spring tension of the ejector spring 3012, the user can reach underneath the foot ledge 3040 and rotate the control knob 3019 (as shown in FIG. 99), which rotates the threaded shaft 3018. By rotating the threaded shaft 3018, the tensioning shuttle 3017 (that one end of the ejector spring 3012 is attached to) is moved up or down along the length of the threaded shaft 3018 (and along the length of the slot in the upper horizontal extension 58). This movement changes the position of the end of the ejector spring 3012, which therefore changes and fine-tunes (i.e., increases or decreases) the tension of the ejector spring 3012. By changing the tension of the ejector spring, the resulting force from the ejector spring 3012 that moves the foot ledge 3040 from the retracted position 32 into the extended position 34 is fine-tuned, thereby allowing the foot ledge structure 3030 to operate effectively, even when installed on uneven floors 12. For example, as shown in FIG. 100, by rotating the control knob 3019 in one direction, the tensioning shuttle 3017 is moved toward the back end of the base bracket 3050 along the slot in the upper horizontal extension 58, which moves the end of the ejector spring 3012 and increases the length (and therefore the spring tension) of the ejector spring 3012. Conversely, as shown in FIG. 101, by rotating the control knob 3019 in the opposite direction, the tensioning shuttle 3017 is moved toward the front end of the base bracket 3050 along the slot in the upper horizontal extension 58, which moves the end of the ejector spring 3012 and decreases or reduces the length (and therefore the spring tension) of the ejector spring 3012.

By adjusting and tuning the spring tension of the ejector spring 3012, the foot ledge structure 3030 can be used or installed on and accommodate (and be completely operable on) uneven floors 12, as shown in FIGS. 102-103. For example, as shown in FIG. 102, the uneven floor 12 is slanted upward toward the front end of the foot ledge structure 3030, thereby pointing the front of the foot ledge 3040 upward (and tilting the whole toilet 20 backward along the back of the toilet 20). Accordingly, the user can turn the control knob 3019 of the spring tension adjustor 3016 to increase the spring tension of the ejector spring 3012, which gives the foot ledge 3040 enough force to be moved (upward) into the extended position 34. Conversely, as shown in FIG. 103, the uneven floor 12 is slanted downward toward the front end of the foot ledge structure 3030, thereby pointing the front of the foot ledge 3040 downward (and tilting the whole toilet 20 backward along the back of the toilet 20). Accordingly, the user can turn the control knob 3019 of the spring tension adjustor 3016 to decrease the spring tension of the ejector spring 3012, which prevents the foot ledge 3040 from sliding out of the toilet base 24 into the extended position 34 too quickly and with too much force. The uneven floor 12 may, for example only, be titled at approximately 1° to the front or back of the toilet 20.

Figure 108:
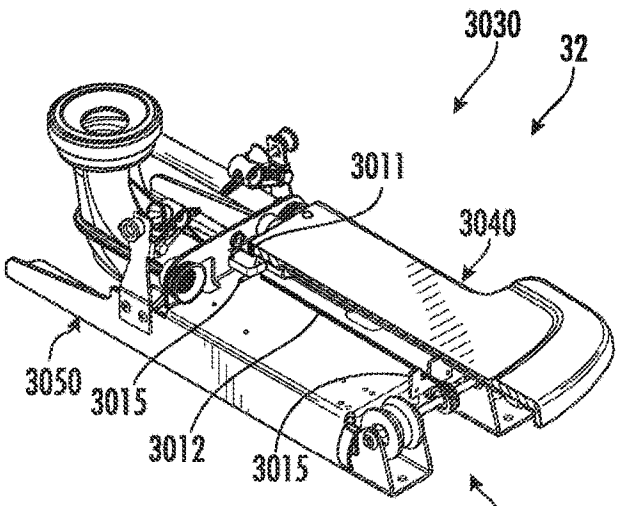
FIG. 108 is a perspective, partially cross-sectional view of the foot ledge structure of FIG. 88 with the foot ledge installed on the base bracket and in the retracted position.
Figure 109:
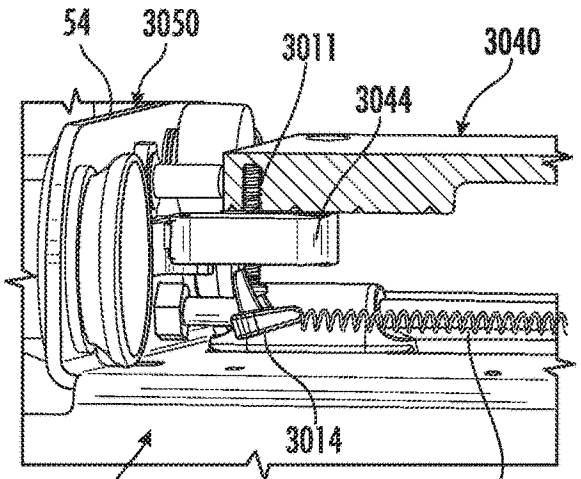
FIG. 109 is an enlarged view of a portion of FIG. 108.
Figure 106:
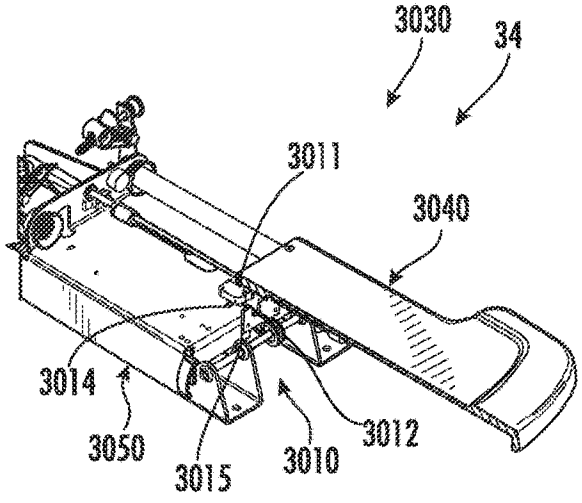
FIG. 106 is a perspective, partially cross-sectional view of the foot ledge structure of FIG. 88 with the foot ledge installed on the base bracket and in the extended position.
Figure 107:
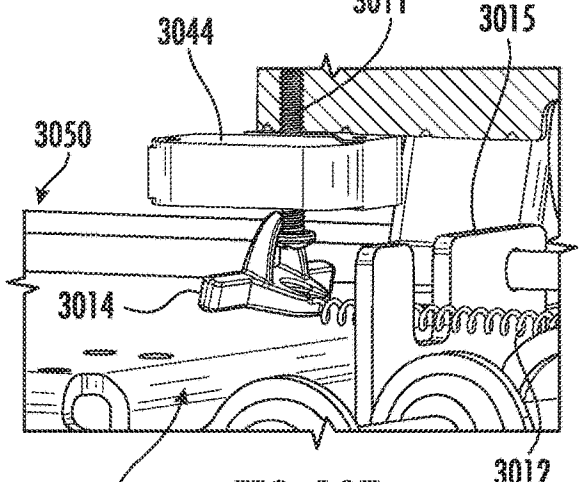
FIG. 107 is an enlarged view of a portion of FIG. 106.
Figure 111:
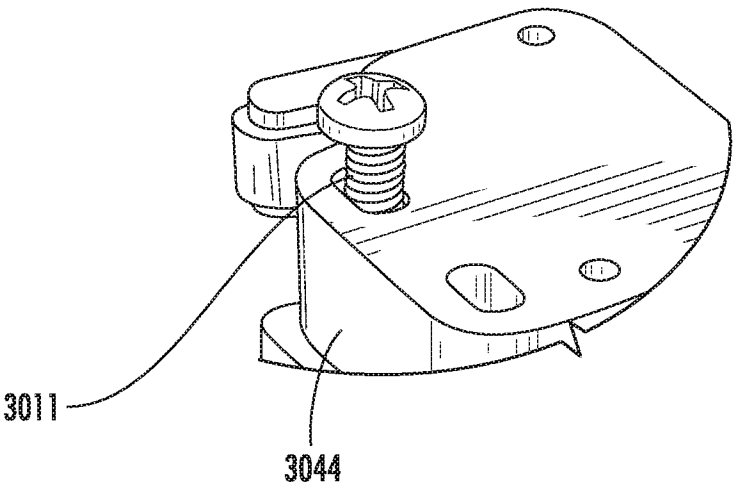
FIG. 111 is a perspective view of an anchor and a latch of the foot ledge structure of FIG. 88.
Figure 110:
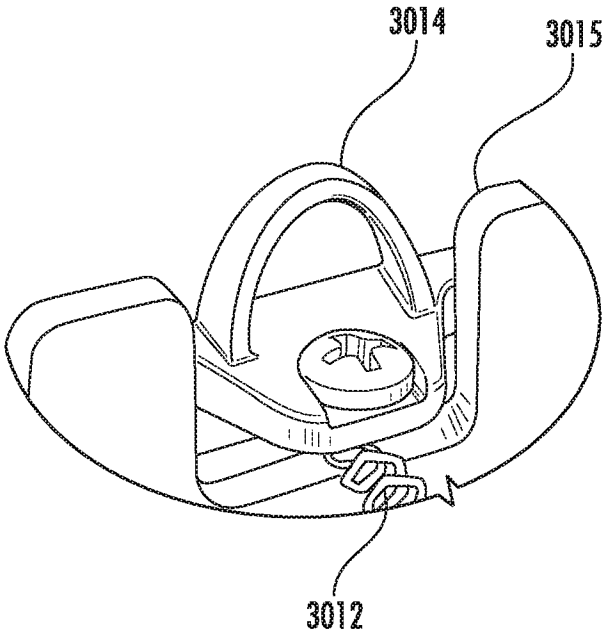
FIG. 110 is a perspective view of a spring hook and a hook retainer of the foot ledge structure of FIG. 88.

As shown in FIGS. 104-109, the ejector spring assembly 3010 is easily and automatically attached, unattached, and reattached to the foot ledge 3040 when the foot ledge 3040 is attached or removed from the rest of the foot ledge structure 3030 (which is particularly useful when installing or servicing the foot ledge structure 3030). In particular, the foot ledge 3040 is automatically detached (or disengaged) from and reattached (or reengaged) with the ejector spring 3012 when the foot ledge 3040 is removed (or uninstalled) from and reattached (or installed) to the base bracket 3050, respectively. Accordingly, the ejector spring assembly 3010 further comprises a spring disengagement system that includes a spring hook 3014, a hook retainer 3015, and an anchor 3011, as shown in FIGS. 110-111. The spring pull, wing, or hook 3014 is attached or fastened to the end of the ejector spring 3012 (that is opposite to the end of the ejector spring 3012 that is fastened to the tensioning shuttle 3017), as shown in FIGS. 105, 107, and 109. The spring hook 3014 is wider than the slot of the hook retainer 3015 (through which the ejector spring 3012 moves) such that the spring hook 3014 is stopped by the hook retainer 3015. As shown in FIG. 110, the hook portion of the spring hook 3014 may optionally extend above the hook retainer 3015 to easily engage with the anchor 3011.

Figure 104:
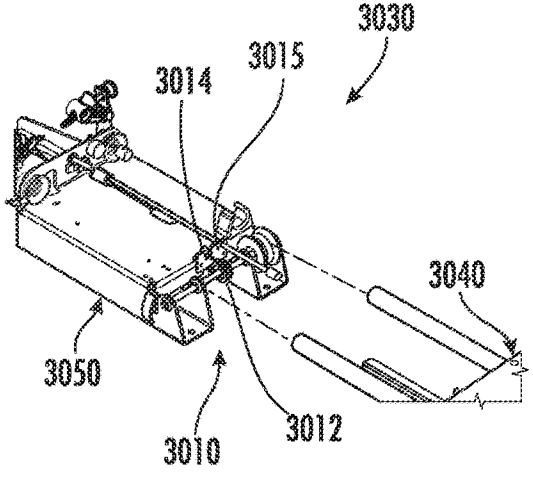
FIG. 104 is a perspective view of the foot ledge structure of FIG. 88 with the foot ledge uninstalled from the base bracket.

The hook stopper or retainer 3015 is statically attached to a front end of the base bracket 3050 (as shown in FIG. 104)

and defines a slot through which the ejector spring 3012 can move, but the spring hook 3014 cannot move (as shown in FIGS. 105 and 107). The hook retainer 3015 extends above the upper horizontal extension 58 of the base bracket 3050 in order to catch the spring hook 3014. The hook retainer 3015 is positioned in a middle portion along the width of the base bracket 3050 in order to align the slot of the hook retainer 3015 with the anchor 3011. The spring hook 3014 and the hook retainer 3015 may optionally be plastic injection molded.

The anchor 3011 (which may be an anchor bolt or screw) is statically attached to and extends downwardly from the bottom surface of the foot ledge 3040 (as shown in FIGS. 107 and 109). The head of the anchor 3011 protrudes downwardly from the bottom surface of the foot ledge 3040. As shown in FIG. 111, the anchor 3011 may optionally extend through and below the latch 3044 (as described further herein). The spring hook 3014 is configured to be hooked and moved by the anchor 3011 and stopped by the hook retainer 3015. The anchor 3011 is positioned between the two slides 3072 along the width of the foot ledge 3040.

In use, to completely remove and uninstalled the foot ledge 3040 from the base bracket 3050, the release lever 3046 is moved or pressed to release the foot ledge 3040 from the base bracket 3050 (as shown and described further herein), and the foot ledge 3040 is subsequently pulled or removed completely out of engagement from the base bracket 3050. As the foot ledge 3040 is completely removed and uninstalled from the base bracket 3050 (as shown in FIGS. 104-105), the spring hook 3014 is stopped from moving any further when the ends of the spring hook 3014 abut against a back surface of the hook retainer 3015 (and in particular against the walls of the hook retainer 3015 that define the slot through which the ejector spring 3012 moves). The spring tension of the ejector spring 3012 keeps the spring hook 3014 pressed up against the back surface of the hook retainer 3015, as shown in FIG. 105. In this position, the hook portion of the spring hook 3014 is aligned with the slot of the hook retainer 3015.

When the foot ledge 3040 is reattached or reinstalled to the base bracket 3050 (as shown in FIGS. 106-107), the ejector spring 3012 is automatically reengaged with the foot ledge 3040. In particular, the anchor 3011 is moved through the slot of the hook retainer 3015. The head of the anchor 3011 catches onto the hook portion of the spring hook 3014, thereby moving and pulling the spring hook 3014 with the foot ledge 3040 (and stretching or tensioning the ejector spring 3012 that is attached to the spring hook 3014). As the foot ledge 3040 moves from the extended position 34 to the retracted position 32, the foot ledge 3040 continues to move the spring hook 3014 (and therefore the ejector spring 3012) toward the back of the base bracket 3050, as shown in FIGS. 108-109, until the latch 3044 is received and locked to the latch receiver 3064 (as described further herein). Due to the spring tension of the ejector spring 3012 and the hooked engagement between the anchor 3011 and the spring hook 3014, the spring hook 3014 remains attached to the anchor 3011 (and therefore to the foot ledge 3040) in both the extended position 34 and the retracted position 32, as well as while the foot ledge 3040 moves between the extended position 34 and the retracted position 32.

To control the movement of the foot ledge 3040, the rail mechanism 3070 comprises a slow-stop position damper 3094 and a release lever assembly 3045 that interact together to control the movement of the foot ledge 3040, in particular as the foot ledge 3040 slows to a stop while moving from the retracted position 32 into the extended position 34. As shown in FIG. 88, the slow-close position damper 3094 is statically attached to the top surface of the upper surface of the upper horizontal extension 58 of the base bracket 3050, and the release lever assembly 3045 is positioned along and pivotably attached to the bottom surface of the foot ledge 3040 (between the two slides 3072 along the width of the foot ledge 3040).

Figure 112:
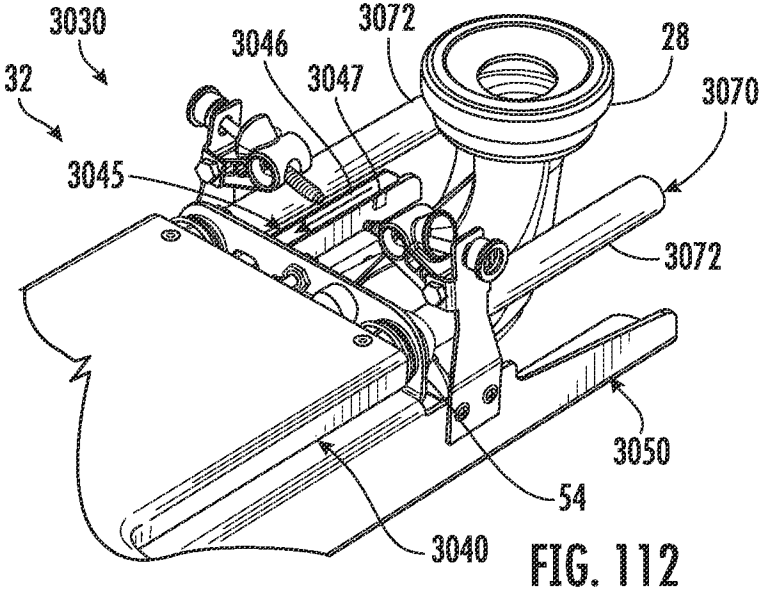
FIG. 112 is a perspective view of a back portion of the foot ledge structure of FIG. 88 in the retracted position.

The release lever assembly 3045 comprises a release lever 3046 that extends along at least a portion of the length of the foot ledge 3040 and is pivotable between a locked position and a release position (as described further herein). The release lever 3046 includes a release lever tab 3047 positioned along the back end of the release lever 3046 and extending vertically downward from the main body of the release lever 3046 (as shown in FIG. 112). The tab 3047 is configured to interact with and attach to the position damper 3094. The release lever 3046 (as well as the various components of the release lever assembly 3045) may optionally be laser cut and constructed out of brake-formed steel.

Figure 114:
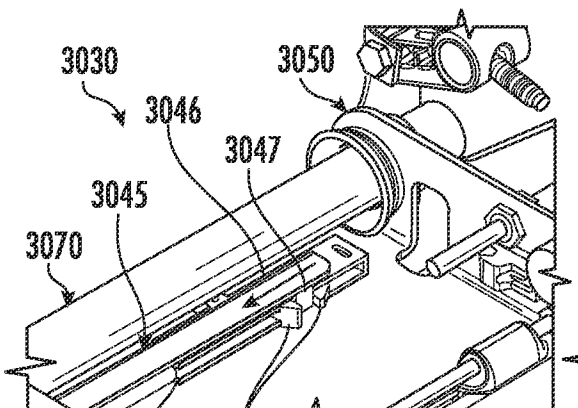

The position damper 3094 is configured to move and pull the foot ledge 3040 completely into the extended position 34 in a controlled manner and into a slow and controlled stop. In particular, the position damper 3094 is configured to control the movement of the foot ledge 3040 as the foot ledge 3040 moves from the retracted position 32 to the extended position 34 by dampening or slowing the movement of the foot ledge 3040. As shown in FIG. 114, the position damper 3094 comprises two tabs or notches 3097 that are configured to receive the tab 3047 of the release lever 3046 to control the movement of the foot ledge 3040. The notches 3097 extend outwardly from the body of the position damper 3094 along the width of the foot ledge structure 3030 and are movable along the length of the body of the position damper 3094. The position damper 3094 may include various internal springs to control the movement of the notches 3097 (which control the movement of the foot ledge 3040).

Figure 113:
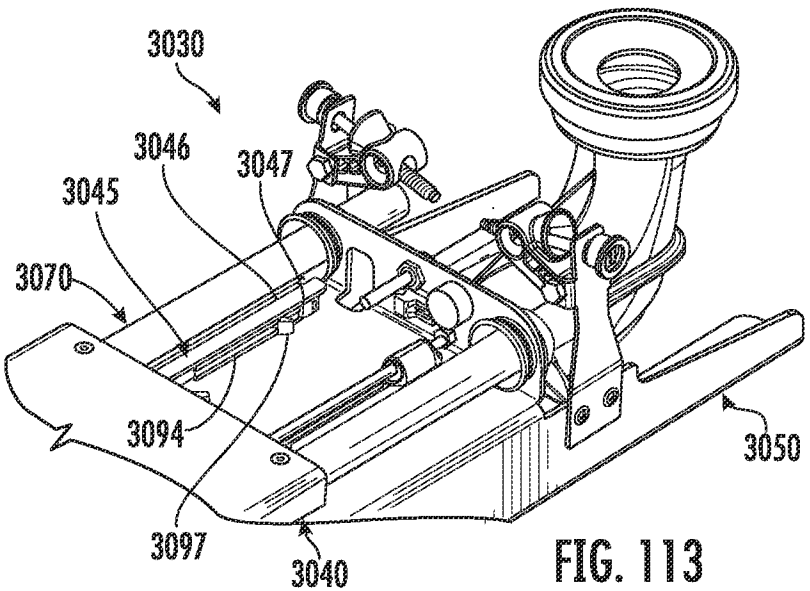
FIGS. 113-114 are perspective views of the back portion of the foot ledge structure of FIG. 88 moving from the retracted position to the extended position.
Figure 116:
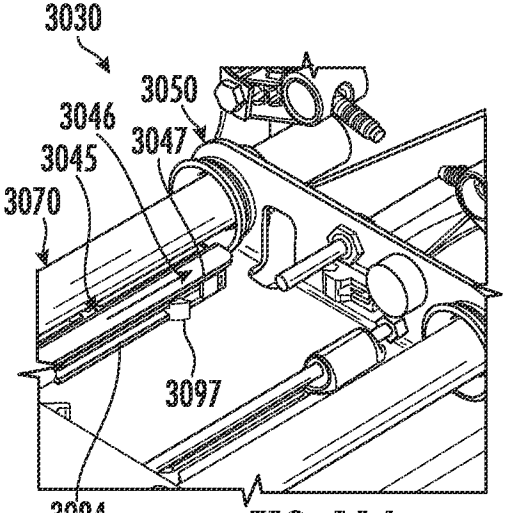
FIG. 116 is a perspective view of the back portion of the foot ledge structure of FIG. 88 moving from the extended position to the retracted position.
Figure 115:
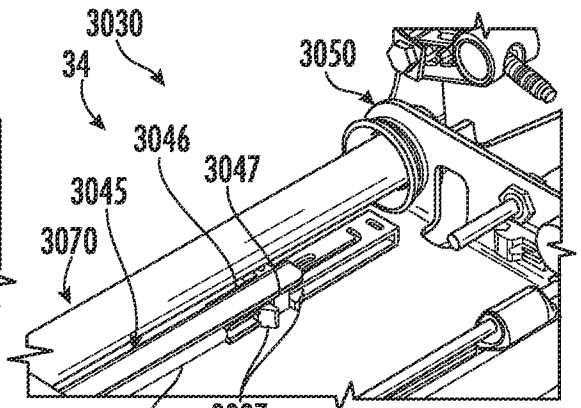
FIG. 115 is a perspective view of the back portion of the foot ledge structure of FIG. 88 in the extended position.

FIGS. 112-116 show the movement of the release lever assembly 3045 with respect to the position damper 3094 as the foot ledge 3040 moves. In particular, as shown in FIG. 112, in the retracted position 32, the release lever 3046 is disconnected from the position damper 3094 and extends through an opening in the vertical endplate 54 of the base bracket 3050 (the opening is easily seen in FIG. 113). As the foot ledge 3040 is moved forward from the retracted position 32 toward the extended position 34, the release lever 3046 is moved back through the opening in the vertical endplate 54. The tab 3047 of the release lever 3046 moves over the back notch 3097 of the position damper 3094 (as shown in FIG. 113) and is subsequently captured by, engaged with, and locked into position between the front and back notches 3097 of the position damper 3094. In this position, the movement of the foot ledge 3040 is controlled and dampened by the position damper 3094. Accordingly, as the ejector spring 3012 pulls the foot ledge 3040 into the extended position 34 (as described further herein), the position damper 3094 also controls the movement of the foot ledge 3040 and ensures that the foot ledge 3040 is moved in a slow and controlled manner into the fully extended position 34, bringing the foot ledge 3040 to a controlled stop into the extended position 34 (as shown in FIG. 115). The position damper 3094 may stop the foot ledge 3040 from moving after approximately 9 inches. As shown in FIG. 116, when the foot ledge 3040 is moved back from the extended position 34 into the retracted position 32, the tab 3047 again moves past the back notch 3097 (optionally pushing the back notch 3097 back into the body of the position damper 3094) and subsequently back through the opening in the vertical endplate 54. This movement loads the position damper 3094 to again receive and re-capture with the tab 3047 and control the movement of the foot ledge 3040 when the foot ledge 3040 is moved back toward the extended position 34 again.

Figure 117:
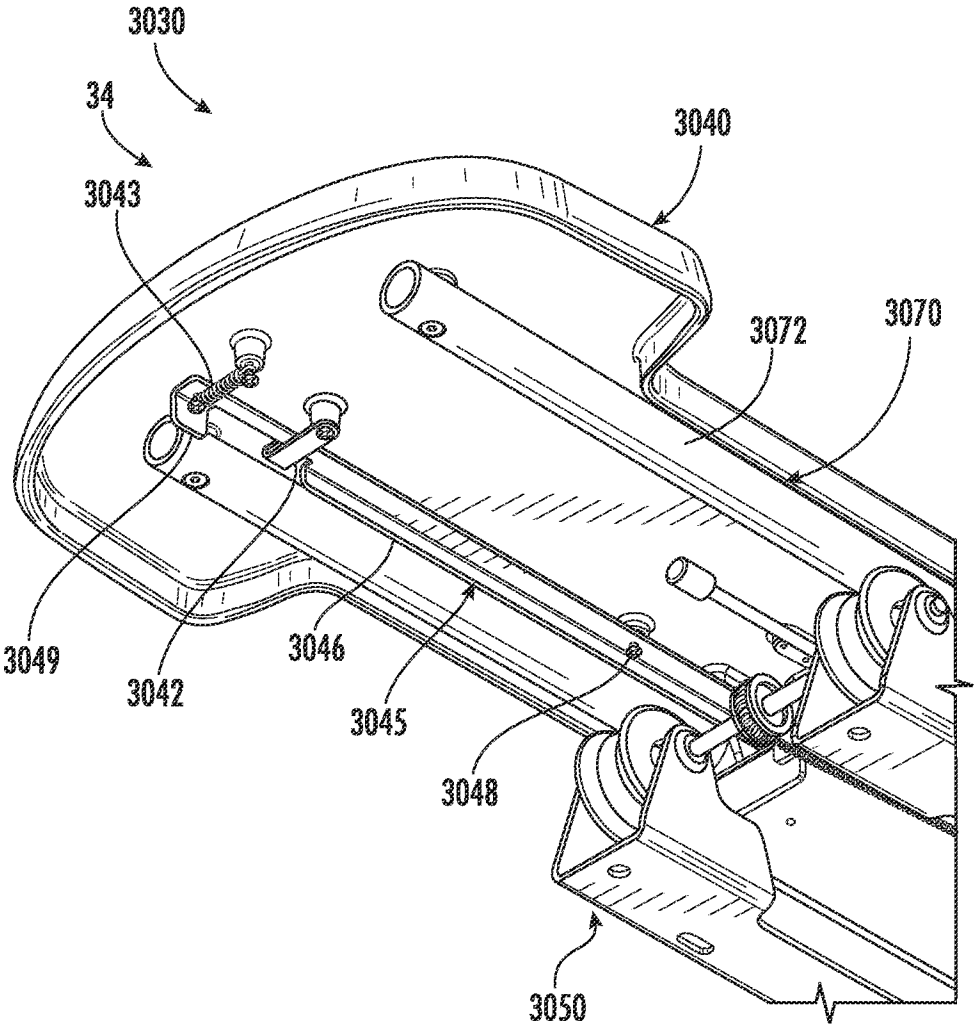
FIG. 117 is a bottom view of the foot ledge and a release lever assembly of the foot ledge structure of FIG. 88.

To remove the foot ledge 3040 from within the toilet base 24 and from the base bracket 3050, the release lever 3046 completely removable from the position damper 3094. In particular, the release lever 3046 is movable between a locked or engaged position (in which the foot ledge 3040 is engaged with and locked to the position damper 3094 (and the base bracket 3050) via the release lever 3046) and an unlocked or disengaged positon (in which the foot ledge 3040 is disengaged and unlocked from the position damper 3094 (and the base bracket 3050) via the release lever 3046). The release lever 3046 is pivotably attached to the bottom surface of the foot ledge 3040 at a pivot attachment point 3048 along a middle section of the release lever 3046 (along the length of the release lever 3046), as shown in FIGS. 88 and 117. The release lever 3046 further includes a finger actuating tab 3049 along the front end of the release lever 3046 (opposite the tab 3047 (along the length of the release lever 3046) that is for engaging with the position damper 3094).

Figure 118:
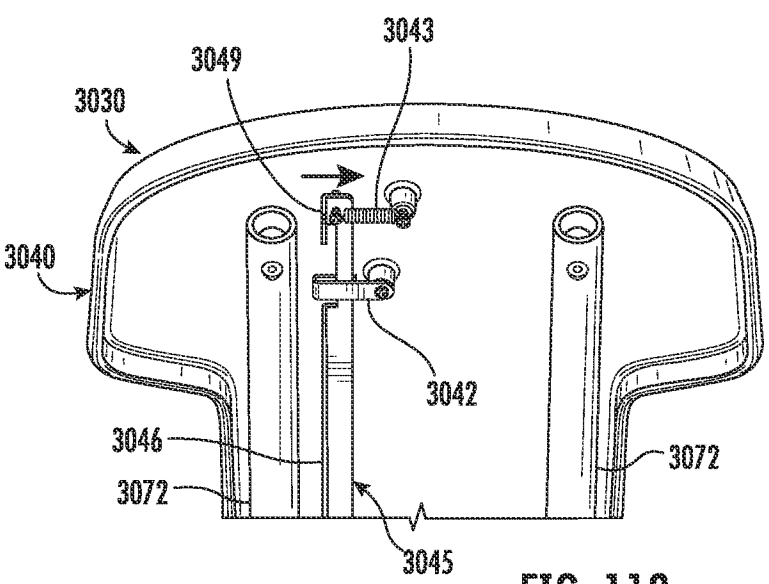
FIG. 118 is a bottom view of the front of the foot ledge and the release lever assembly of FIG. 117 in a locked position.
Figure 119:
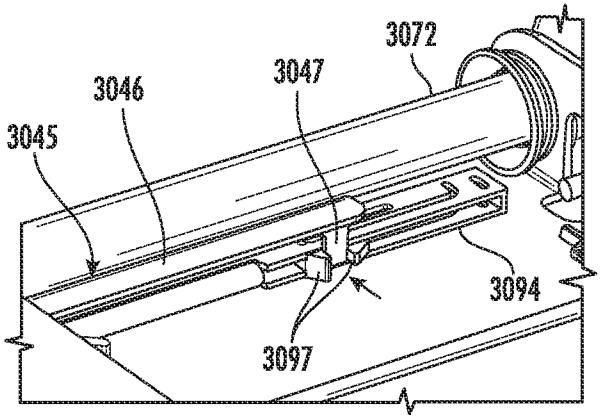
FIG. 119 is a top view of the back of the release lever assembly of FIG. 117 in the locked position.

The release lever assembly 3045 further includes a spring 3043 that is attached to the front end of the release lever 3046 (e.g., near the finger actuating tab 3049) and spring-loads the release lever 3046 into engagement with the position damper 3094. In particular, the spring 3043 biases the release lever 3046 to move or pivot toward engagement (i.e., in a default, locked and engaged position) with the position damper 3094 by pulling the front end of the release lever 3046 (as shown in FIG. 118), which pivots the release lever 3046 about the pivot attachment point 3048. As the release lever 3046 pivots about the pivot attachment point 3048, the back end of the release lever 3046 (and therefore the tab 3047) is moved or pivoted toward (and further into engagement with) the position damper 3094 (as shown in FIG. 119), between the notches 3097.

Figure 120:
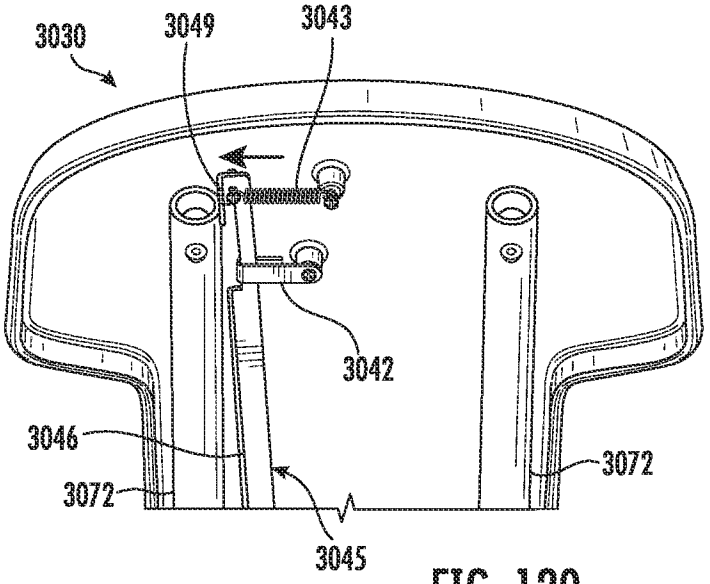
FIG. 120 is a bottom view of the front of the foot ledge and the release lever assembly of FIG. 117 in an unlocked position.
Figure 121:
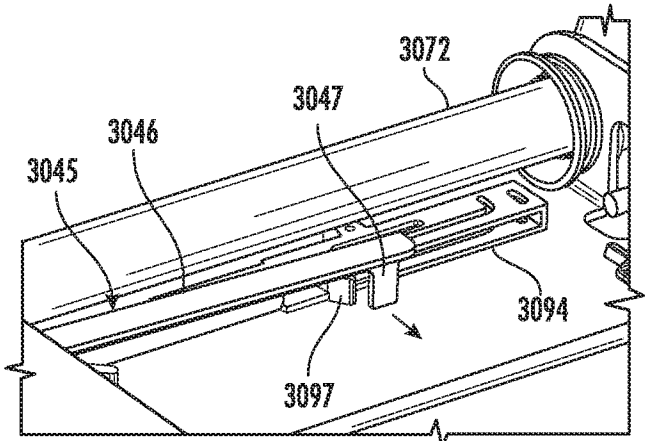
FIG. 121 is a top view of the back of the release lever assembly of FIG. 117 in the unlocked position.

To remove and disengage the foot ledge 3040 from the base bracket 3050, the user can reach their finger under the exposed front end of the foot ledge 3040 (in particular while the foot ledge 3040 is in the extended position 34), and move the finger actuating tab 3049 (in a direction counter to the biasing spring force of the spring 3043), as shown in FIG. 120. This motion pivots the release lever 3046 in the opposite direction about the pivot attachment point 3048, which moves or pivots the back end of the release lever 3046 (and therefore the tab 3047) away from (and out of engagement with) the position damper 3094 (as shown in FIG. 121), thereby moving the release lever 3046 from the locked position to the release and disengaged position. The user can then completely remove and slide out the foot ledge 3040 from within the toilet base 24 (and from an installed toilet 20) to easily service, clean, or replace the foot ledge 3040 (for example). Due to the spring 3043 biasing the release lever 3046 into engagement, when the foot ledge 3040 is inserted back into the toilet base 24, the foot ledge 3040 automatically snaps back into engagement with the position damper 3094.

The release lever assembly 3045 further comprises a release lever retaining bracket or guide 3042 that the release lever 3046 is positioned at least partially within and is pivotable within. As shown in FIG. 88, the release lever guide 3042 is positioned between the spring 3043 and the pivot attachment point 3048 along the length of the release lever 3046. The release lever guide 3042 is configured to control how far the release lever 3046 can travel or pivot when being moved in either direction, in particular while the release leaver 3046 is being moved into the unlocked position.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the toilet foot ledge as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the disclosure.

Other substitutions, modifications, changes and omissions may also be made in the design, operating conditions and arrangement of the various exemplary embodiments without departing from the scope of the present disclosure. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the disclosure.

We claim:

1. An apparatus comprising:

a toilet having at least a toilet base;

a foot ledge positioned at a front end of the toilet and operable in a retracted position and an extended position;

a base structure configured extend across the toilet base to elevate the toilet above a floor and support the foot ledge; and a rail mechanism configured to guide the movement of the foot ledge between the retracted position and the extended position.

2. The apparatus of claim 1, wherein the foot ledge extends beneath the bottom of the toilet base.

3. The apparatus of claim 1, wherein a top surface of the foot ledge is covered by the toilet base in the retracted position.

4. The apparatus of claim 1, wherein the base structure comprises at least one fastener to connect the base structure to the toilet base.

5. The apparatus of claim 1, wherein a height of the base structure contributes to an overall height of the toilet.

6. The apparatus of claim 1, wherein the rail mechanism is operable in a bump open configuration in which the foot ledge is automatically unlocked and moved from the retracted position to the extended position.

7. The apparatus of claim 1, wherein the rail mechanism is operable in a slow close configuration is automatically moved from the extended position to the retracted position.

8. A method comprising:

positioning a trapway in alignment with a drain in a floor;

securing the trapway to the floor;

attaching a base structure to the trapway, wherein the trapway extends through the base structure; and attaching the base structure to the floor.

9. The method of claim 8, further comprising:

placing a wax seal between the trapway and the floor.

10. The method of claim 9, wherein attaching the bases to the floor compresses the wax seal.

11. An apparatus for a toilet, the apparatus comprising:

a foot ledge positioned at a front end of the toilet and operable in a retracted position and an extended position;

a base structure configured extend across a base of the toilet to elevate the toilet above a floor and support the foot ledge; and a rail mechanism configured to guide the movement of the foot ledge between the retracted position and the extended position.

12. The method of claim 11, wherein the foot ledge extends beneath the bottom of the base of the toilet.

13. The method of claim 11, wherein a top surface of the foot ledge is covered by the base structure in the retracted position.

14. The method of claim 11, wherein the base structure comprises at least one fastener to connect the base structure to the base of the toilet.

15. The method of claim 11, wherein a height of the base structure corresponds to an overall height of the toilet.

16. The apparatus of claim 11, wherein the rail mechanism is operable in a bump open configuration in which the foot ledge is automatically unlocked and moved from the retracted position to the extended position.

17. The apparatus of claim 11, wherein the rail mechanism is operable in a slow close configuration is automatically moved from the extended position to the retracted position.

18. A toilet comprising:

a trapway positioned in alignment with a drain in a floor;

a first fastener configured to secure the trapway to the floor;

a base structure attached to the trapway, wherein the trapway extends through the base structure; and a second fastener configured to attach the base structure to the floor.

19. The toilet of claim 18, wherein a wax seal is compressed by the first fastener and the second fastener.

* * * * *